US011124323B2

(12) United States Patent
Sanfilippo et al.

(10) Patent No.: US 11,124,323 B2
(45) Date of Patent: Sep. 21, 2021

(54) FLEXIBLE, STACKABLE CONTAINER AND METHOD AND SYSTEM FOR MANUFACTURING THE SAME

(71) Applicant: PRIMAPAK, LLC., Elgin, IL (US)

(72) Inventors: John E. Sanfilippo, Barrington Hills, IL (US); James J. Sanfilippo, Barrington Hills, IL (US); Jeanne M. Skaggs, Arlington Heights, IL (US); Roy Speer, Barrington Hills, IL (US)

(73) Assignee: PRIMAPAK, LLC, Elgin, IL (US)

( * ) Notice: Subject to any disclaimer, the term of this patent is extended or adjusted under 35 U.S.C. 154(b) by 276 days.

(21) Appl. No.: 16/353,869

(22) Filed: Mar. 14, 2019

(65) Prior Publication Data

US 2019/0210752 A1 Jul. 11, 2019

Related U.S. Application Data

(60) Division of application No. 14/145,779, filed on Dec. 31, 2013, now Pat. No. 10,232,969, which is a (Continued)

(51) Int. Cl.
*B65D 75/58* (2006.01)
*B65B 9/20* (2012.01)
(Continued)

(52) U.S. Cl.
CPC ..... *B65B 43/10* (2013.01); *B31B 50/26* (2017.08); *B31B 50/62* (2017.08); *B31B 50/81* (2017.08);
(Continued)

(58) Field of Classification Search
CPC ..... B65D 75/008; B65D 75/5877; B65D 75/5838; B65D 21/0209; B65D 83/0805;
(Continued)

(56) References Cited

U.S. PATENT DOCUMENTS 724,316 A 3/1903 Staples
1,102,750 A 7/1914 Hawkins
(Continued)

FOREIGN PATENT DOCUMENTS

CH 614903 A5 12/1979
CN 1051332 A 5/1991
(Continued)

OTHER PUBLICATIONS

Australian Patent Application No. 2018203519, Examination Report No. 1, dated Jun. 21, 2019.
(Continued)

*Primary Examiner* — Andrew M Tecco
(74) *Attorney, Agent, or Firm* — Marshall, Gerstein & Borun LLP

(57) ABSTRACT

A flexible, stackable container for storing a quantity of a product may include a sealed package formed from a single sheet of film and retaining the quantity of the product disposed therein, and a lid fitment attached to a first side of the package. The first side of the package may have an outer first surface of the film and outwardly extending first corner seals formed in the film at the edges of the first side and surrounding the first side of the package. The package may also have a second side disposed opposite the first side and outwardly extending second corner seals formed in the film at the edges of the second side and surrounding the second side of the package.

16 Claims, 41 Drawing Sheets

Related U.S. Application Data continuation of application No. 14/089,581, filed on Nov. 25, 2013, now Pat. No. 10,023,337, which is a continuation of application No. 13/538,568, filed on Jun. 29, 2012, now Pat. No. 8,602,244, which is a continuation of application No. 12/266,495, filed on Nov. 6, 2008, now Pat. No. 8,231,024, which is a continuation-in-part of application No. 12/188,328, filed on Aug. 8, 2008, now Pat. No. 8,066,137.

(60) Provisional application No. 61/016,802, filed on Dec. 26, 2007, provisional application No. 60/989,635, filed on Nov. 21, 2007, provisional application No. 60/987,031, filed on Nov. 9, 2007, provisional application No. 60/954,609, filed on Aug. 8, 2007.

(51) Int. Cl.

| | |
|---|---|
| ***B65B 43/10*** | (2006.01) |
| ***B65B 1/02*** | (2006.01) |
| ***B65B 61/18*** | (2006.01) |
| ***B65D 5/74*** | (2006.01) |
| ***B65D 75/00*** | (2006.01) |
| ***B31B 50/26*** | (2017.01) |
| ***B31B 50/62*** | (2017.01) |
| ***B31B 50/81*** | (2017.01) |
| ***B65D 21/02*** | (2006.01) |
| ***B65B 9/08*** | (2012.01) |
| *B65B 3/02* | (2006.01) |
| *B65B 5/02* | (2006.01) |

(52) U.S. Cl.

CPC ..... *B65B 1/02* (2013.01); *B65B 9/08* (2013.01); *B65B 61/182* (2013.01); *B65B 61/186* (2013.01); *B65D 5/746* (2013.01); *B65D 21/0209* (2013.01); *B65D 75/008* (2013.01); *B65D 75/5877* (2013.01); *B65B 3/02* (2013.01); *B65B 5/022* (2013.01); *B65B 9/20* (2013.01); *B65B 2220/18* (2013.01); *B65D 2575/586* (2013.01)

(58) Field of Classification Search

CPC ..... B65D 2575/586; B65B 9/20; B65B 9/08; B65B 2220/18; B65B 43/10; B65B 61/186; B31B 50/81; B31B 50/26

See application file for complete search history.

(56) References Cited

U.S. PATENT DOCUMENTS 1,389,197 A 8/1921 Kusterer
1,395,229 A 10/1921 Inman et al.
1,747,618 A 2/1930 Burns
1,930,285 A 10/1933 Robinson
2,017,176 A 10/1935 Andrews
2,041,227 A 5/1936 Chalmers
2,048,122 A 7/1936 Howard
2,092,858 A 9/1937 Richard
2,106,907 A 2/1938 Brunt et al.
2,113,431 A 4/1938 Milliken
2,153,310 A 4/1939 Newman
2,180,841 A 11/1939 Vogt
2,239,398 A 4/1941 Palmer
2,251,283 A 8/1941 Johnson
2,259,866 A 10/1941 Stokes
2,260,064 A 10/1941 Stokes
2,291,063 A 7/1942 Staude et al.
2,311,857 A 2/1943 Noah
2,328,579 A 9/1943 Pelosi
2,330,015 A 9/1943 Stokes
2,339,156 A 1/1944 Duane
2,352,766 A 7/1944 Bogue
2,365,159 A 12/1944 Walton
2,385,898 A 10/1945 Waters
2,416,332 A 2/1947 Lehman
2,495,807 A 1/1950 Buttery
2,508,962 A 5/1950 Moore
2,524,766 A 10/1950 Carroll
2,619,226 A 11/1952 Adams
2,684,807 A 7/1954 Gerrish
2,695,847 A 11/1954 Fisher
2,719,663 A 10/1955 Meyer-Jagenberg
2,737,338 A 3/1956 Moore
2,749,245 A 6/1956 Peters
2,750,093 A 6/1956 Moore
2,758,775 A 8/1956 Moore
2,787,410 A 4/1957 Moore
2,819,831 A 1/1958 Polarek et al.
2,823,795 A 2/1958 Moore
2,864,710 A 12/1958 Pottle et al.
2,936,940 A 5/1960 Berghgracht
2,970,735 A 2/1961 Jacke
3,006,257 A 10/1961 Orsini
3,054,550 A 9/1962 Comstock
3,091,902 A 6/1963 Grafingholt
3,093,292 A 6/1963 Ahlbor
3,111,223 A 11/1963 Jacobi
3,116,153 A 12/1963 Selferth et al.
3,125,275 A 3/1964 Ehe
3,127,082 A 3/1964 Meyer-Jagenberg
3,143,276 A 8/1964 Nichols
3,155,304 A 11/1964 Beerend
3,172,769 A 3/1965 Horan
3,185,379 A 5/1965 Kohlhaas
3,206,094 A 9/1965 Humphrey
3,228,584 A 1/1966 Ashton
3,228,587 A 1/1966 Segebrecht
3,235,168 A 2/1966 Nichols
3,249,286 A 5/1966 Palmer
3,259,303 A 7/1966 Repko
3,259,507 A 7/1966 Smith
3,272,423 A 9/1966 Bjarno
3,275,214 A 9/1966 Carangelo
3,299,611 A 1/1967 Hendrick et al.
3,314,591 A 4/1967 Cheeley
3,318,204 A 5/1967 Crane
3,325,077 A 6/1967 Boegershausen
3,326,097 A 6/1967 Lokey
3,339,721 A 9/1967 Goldstein
3,349,959 A 10/1967 Watkins
3,373,917 A 3/1968 Cox
3,380,646 A 4/1968 Doyen et al.
3,423,007 A 1/1969 Christensson
3,426,499 A 2/1969 Paige
3,434,652 A 3/1969 Shore
3,437,258 A 4/1969 Kugler
3,462,067 A 8/1969 Shore
3,505,779 A * 4/1970 Kopp ..... B65D 75/12 53/550
3,515,270 A 6/1970 Yang et al.
3,521,807 A 7/1970 Weisberg
3,562,392 A 2/1971 Mylius
3,599,387 A 8/1971 James
3,604,491 A 9/1971 Spiess
3,621,637 A 11/1971 Sternau
3,738,567 A 6/1973 Ruda
3,739,977 A 6/1973 Shapiro et al.
3,785,112 A * 1/1974 Leasure ..... B65B 9/2042 53/451
3,838,787 A 10/1974 McCloskey
3,917,158 A 11/1975 Dorofachuk et al.
3,935,993 A 2/1976 Doyen et al.
3,940,054 A 2/1976 Goebel et al.
3,968,921 A 7/1976 Jewell
3,980,225 A 9/1976 Kan
4,004,398 A 1/1977 Larsson et al.
4,041,851 A 8/1977 Jentsch
4,069,348 A 1/1978 Bush
4,082,214 A 4/1978 Baker
4,082,216 A 4/1978 Clarke
4,101,051 A 7/1978 Reil

(56) References Cited

U.S. PATENT DOCUMENTS 4,129,976 A 12/1978 Grundler et al.
4,185,754 A 1/1980 Julius
4,192,420 A 3/1980 Worrell, Sr. et al.
4,197,949 A 4/1980 Carlsson
4,260,061 A 4/1981 Jacobs
4,291,826 A 9/1981 Swanson
4,308,679 A 1/1982 Ray, III et al.
4,338,766 A 7/1982 Hamilton
D265,777 S 8/1982 Elzea et al.
4,345,133 A 8/1982 Cherney et al.
4,345,393 A 8/1982 Price et al.
D266,049 S 9/1982 Conti
4,353,497 A 10/1982 Bustin
4,361,266 A 11/1982 Killy
4,367,842 A 1/1983 Rausing
4,420,080 A 12/1983 Nakamura
4,441,648 A 4/1984 Portsmouth
4,442,656 A 4/1984 Wylie, Sr.
4,531,668 A 7/1985 Forbes, Jr.
4,552,269 A 11/1985 Chang
4,554,190 A 11/1985 McHenry et al.
4,576,309 A 3/1986 Tzifkansky et al.
4,589,145 A 5/1986 Van Erden et al.
D286,745 S 11/1986 Forbes, Jr.
4,621,000 A 11/1986 Frick
4,651,874 A 3/1987 Nakamura
4,663,915 A 5/1987 Van Erden et al.
4,674,129 A 6/1987 Janhonen
4,679,693 A 7/1987 Forman
4,679,701 A 7/1987 Ackermann et al.
4,687,104 A 8/1987 Ielmini
4,696,404 A 9/1987 Corella
4,738,365 A 4/1988 Prater
D297,214 S 8/1988 Forbes, Jr.
4,786,192 A 11/1988 Graves et al.
4,790,436 A 12/1988 Nakamura
4,798,295 A 1/1989 Rausing
4,804,137 A 2/1989 Harby
4,808,421 A 2/1989 Mendenhall et al.
4,811,848 A 3/1989 Jud
4,837,849 A 6/1989 Erickson et al.
4,840,270 A 6/1989 Caputo et al.
4,848,575 A 7/1989 Nakamura et al.
4,851,246 A 7/1989 Maxwell et al.
4,858,793 A 8/1989 Stone
D304,016 S 10/1989 Forbes, Jr.
4,881,360 A 11/1989 Konzal et al.
4,886,373 A 12/1989 Corella
4,909,017 A 3/1990 McMahon et al.
4,954,124 A 9/1990 Erickson et al.
4,986,054 A 1/1991 McMahon
D315,099 S 3/1991 Alizard
4,997,416 A 3/1991 Mitchell et al.
5,031,826 A 7/1991 Seufert
5,036,997 A 8/1991 May et al.
5,044,777 A 9/1991 Watkins et al.
5,046,300 A 9/1991 Custer et al.
5,059,036 A 10/1991 Richison et al.
5,062,527 A 11/1991 Westerman
5,065,887 A 11/1991 Schuh et al.
5,078,509 A 1/1992 Center et al.
5,080,643 A 1/1992 Mitchell et al.
5,092,831 A 3/1992 James et al.
5,127,208 A 7/1992 Custer et al.
5,158,371 A 10/1992 Moravek
5,158,499 A 10/1992 Guckenberger
D332,399 S 1/1993 Neff
5,195,829 A * 3/1993 Watkins ..... B65D 81/3469 383/100
5,205,651 A 4/1993 Decottignies et al.
5,215,380 A 6/1993 Custer et al.
5,251,809 A 10/1993 Drummond et al.
5,254,073 A 10/1993 Richison et al.
5,255,497 A 10/1993 Zoromskl et al.
5,350,240 A 9/1994 Billman et al.
D351,090 S 10/1994 Narsutis
5,352,466 A 10/1994 Delonis
5,353,946 A 10/1994 Behrend
5,356,069 A 10/1994 Bochet et al.
5,366,104 A 11/1994 Armstrong
D354,436 S 1/1995 Krupa
5,417,035 A 5/1995 English
D364,563 S 11/1995 Miller et al.
5,463,851 A 11/1995 Nagai
5,484,101 A 1/1996 Hedberg
5,498,080 A 3/1996 Dales et al.
5,503,324 A 4/1996 Bacchetti et al.
5,505,040 A 4/1996 Janssen et al.
5,505,305 A 4/1996 Scholz et al.
5,542,902 A 8/1996 Richison et al.
5,545,420 A 8/1996 Lipinski et al.
5,556,026 A 9/1996 Blankitny
D374,774 S 10/1996 Cassel
5,561,966 A 10/1996 English
5,577,612 A 11/1996 Chesson et al.
5,611,452 A 3/1997 Bonora et al.
5,613,608 A 3/1997 Tronchetti et al.
5,655,706 A 8/1997 Vandiver
D386,001 S 11/1997 Saffran
5,687,848 A 11/1997 Scholz et al.
5,704,480 A 1/1998 Scholz et al.
5,704,541 A 1/1998 Mogard
D394,606 S 5/1998 Zorn et al.
5,749,512 A 5/1998 Gingras-Taylor
5,770,839 A 6/1998 Ruebush et al.
5,772,332 A 6/1998 Geller
D395,952 S 7/1998 Buczwinski et al.
5,785,179 A 7/1998 Buczwinski et al.
5,788,121 A 8/1998 Sasaki et al.
5,788,378 A 8/1998 Thomas
5,789,049 A 8/1998 Randles
5,791,465 A * 8/1998 Niki ..... B65D 75/5894 206/210
D398,526 S 9/1998 Schwarz et al.
D398,844 S 9/1998 Oberloier
5,799,863 A 9/1998 Capy et al.
5,818,016 A 10/1998 Lorence et al.
5,820,017 A 10/1998 Eliovson et al.
5,826,401 A 10/1998 Bois
5,832,701 A 11/1998 Hauers et al.
5,842,790 A * 12/1998 Imer ..... B65D 31/08 383/122
5,857,613 A 1/1999 Drummond et al.
5,858,543 A 1/1999 Futter et al.
5,862,652 A 1/1999 Schoeler
5,882,749 A 3/1999 Jones et al.
5,882,789 A 3/1999 Jones et al.
5,897,050 A 4/1999 Barnes
D409,484 S 5/1999 Tasker
5,908,246 A 6/1999 Arimura et al.
D412,439 S 8/1999 Cormack
5,937,615 A 8/1999 Forman
5,944,425 A 8/1999 Forman
5,972,396 A 10/1999 Jurgovan et al.
5,983,594 A 11/1999 Forman
5,993,593 A 11/1999 Swartz et al.
5,996,797 A 12/1999 Flaig
6,005,234 A 12/1999 Moseley et al.
6,021,624 A 2/2000 Richison et al.
6,023,914 A 2/2000 Richison et al.
6,026,953 A 2/2000 Nakamura et al.
D421,901 S 3/2000 Hill
D421,902 S 3/2000 Hill
6,036,365 A 3/2000 Imer
6,038,839 A 3/2000 Linkiewicz
6,056,141 A 5/2000 Navarini et al.
6,060,096 A 5/2000 Hanson et al.
D427,056 S 6/2000 Irace et al.
6,088,998 A 7/2000 Malin et al.
6,113,271 A 9/2000 Scott et al.
6,120,183 A 9/2000 Buchanan et al.
D431,464 S 10/2000 Collins et al.
6,132,351 A 10/2000 Lotto et al.
6,137,098 A 10/2000 Moseley et al.

(56) References Cited

U.S. PATENT DOCUMENTS 6,139,662 A 10/2000 Forman
6,149,304 A 11/2000 Hamilton et al.
D437,686 S 2/2001 Balzar et al.
6,182,887 B1 2/2001 Ljunstrom et al.
6,229,061 B1 5/2001 Dragoo et al.
6,231,237 B1 5/2001 Geller
6,234,676 B1 5/2001 Galomb et al.
6,245,367 B1 6/2001 Galomb
6,250,048 B1 6/2001 Linkiewicz
6,253,993 B1 7/2001 Lloyd et al.
6,254,907 B1 7/2001 Galomb
6,261,215 B1 7/2001 Imer
D446,014 S 8/2001 Adkins
6,273,610 B1 8/2001 Koyama et al.
6,274,181 B1 8/2001 Richison et al.
6,309,105 B1 10/2001 Palumbo
D450,960 S 11/2001 Boyea et al.
6,319,184 B1 11/2001 DeMatteis et al.
D452,374 S 12/2001 Kim
6,325,239 B2 12/2001 Randall et al.
6,350,057 B1 2/2002 Forman
6,354,062 B1 3/2002 Haughton et al.
6,361,212 B1 3/2002 Sprehe et al.
6,412,634 B1 7/2002 Telesca et al.
6,420,006 B1 7/2002 Scott
6,423,356 B2 7/2002 Richison et al.
D461,403 S 8/2002 Chomik et al.
6,428,867 B1 8/2002 Scott et al.
6,430,899 B1 8/2002 Cicha
6,431,434 B1 8/2002 Haughton et al.
D463,276 S 9/2002 Piscopo et al.
6,446,796 B1 9/2002 Schmidt
D464,884 S 10/2002 Sumpmann et al.
D464,894 S 10/2002 Mittersinker et al.
6,481,183 B1 * 11/2002 Schmidt ..... B65B 9/20 383/63
D466,807 S 12/2002 Buck et al.
6,488,556 B2 12/2002 Galomb
6,502,986 B1 1/2003 Bensur et al.
6,510,673 B1 1/2003 Visona'et al.
6,513,308 B1 2/2003 Meeuwesen et al.
D471,804 S 3/2003 Staples
6,533,456 B1 3/2003 Buchman
D473,461 S 4/2003 Joubert
6,554,134 B1 4/2003 Guibert
6,568,150 B2 5/2003 Forman
6,589,622 B1 7/2003 Scott
6,615,567 B2 9/2003 Kuhn et al.
6,659,645 B1 12/2003 Schulz
D485,461 S 1/2004 Sams et al.
6,679,034 B2 1/2004 Kohl et al.
6,695,757 B2 2/2004 Edwards et al.
D487,192 S 3/2004 Farnham et al.
6,702,109 B1 3/2004 Tabuchi
6,719,140 B1 4/2004 Rinsler
6,719,678 B1 4/2004 Stern
D489,530 S 5/2004 Lindsay
6,729,112 B2 5/2004 Kuss et al.
6,736,309 B1 5/2004 Westerman et al.
6,746,388 B2 6/2004 Edwards et al.
6,755,927 B2 6/2004 Forman
6,761,279 B1 7/2004 Martin et al.
6,783,277 B2 8/2004 Edwards et al.
6,817,160 B2 11/2004 Schmidt
6,820,391 B2 11/2004 Barmore et al.
D501,134 S 1/2005 Takahashi et al.
6,845,602 B2 1/2005 Drut
D502,095 S 2/2005 Tucker et al.
D503,336 S 3/2005 Tucker et al.
D504,622 S 5/2005 Takahashi et al.
6,886,313 B2 5/2005 Knoerzer et al.
6,913,389 B2 7/2005 Kannankeril et al.
6,918,532 B2 7/2005 Sierra-Gomez et al.
6,935,086 B2 8/2005 Brenkus et al.
6,953,069 B2 10/2005 Galomb
D513,870 S 1/2006 Rosine et al.
6,986,920 B2 1/2006 Forman et al.
D514,439 S 2/2006 Snedden et al.
7,051,877 B2 5/2006 Lin
7,059,466 B2 6/2006 Lees et al.
7,077,259 B2 7/2006 Breidenbach
7,080,726 B2 7/2006 Breidenbach et al.
D528,010 S 9/2006 Yashima et al.
7,108,441 B2 9/2006 Altonen et al.
7,128,200 B2 10/2006 Lees et al.
D531,894 S 11/2006 Ramirez et al.
7,153,026 B2 12/2006 Galomb
7,156,556 B2 * 1/2007 Takahashi ..... B65B 9/2049 383/104
D536,608 S 2/2007 Arkins
RE39,505 E 3/2007 Thomas et al.
7,205,016 B2 4/2007 Garwood
7,207,717 B2 4/2007 Steele
7,213,710 B2 5/2007 Cotert
D544,762 S 6/2007 Zimmerman
D545,186 S 6/2007 Liebe et al.
D548,080 S 8/2007 Brown et al.
D551,508 S 9/2007 Friedland et al.
D552,468 S 10/2007 Seum et al.
7,299,608 B2 11/2007 Kohl et al.
7,350,688 B2 4/2008 Sierra-Gomez et al.
D569,719 S 5/2008 Ross
7,371,008 B2 * 5/2008 Bonenfant ..... B65D 75/5838 383/5
D571,146 S 6/2008 Sanfilippo et al.
D571,197 S 6/2008 Sanfilippo et al.
7,475,781 B2 1/2009 Kobayashi et al.
D591,555 S 5/2009 Sanfilippo et al.
D593,369 S 6/2009 Green et al.
D608,193 S 1/2010 Sanfilippo et al.
7,665,629 B2 2/2010 Julius et al.
7,665,895 B2 2/2010 Takita et al.
7,717,620 B2 5/2010 Hebert et al.
7,744,517 B2 6/2010 Bonenfant
7,780,006 B2 8/2010 Clark, Jr. et al.
D629,296 S 12/2010 De Muynck
D637,577 S 5/2011 Han et al.
7,993,256 B2 8/2011 Takita et al.
8,006,833 B2 8/2011 Clark, Jr. et al.
8,038,349 B2 10/2011 Andersson et al.
D648,302 S 11/2011 Park et al.
8,066,137 B2 11/2011 Sanfilippo et al.
8,074,803 B2 12/2011 Motsch et al.
8,114,451 B2 2/2012 Sierra-Gomez et al.
8,132,395 B2 3/2012 Gehring et al.
8,182,891 B2 5/2012 Scott et al.
8,231,024 B2 7/2012 Sanfilippo et al.
8,245,865 B2 8/2012 Damaqhi et al.
8,276,353 B2 10/2012 Reaves et al.
D671,000 S 11/2012 O'Neill et al.
8,308,363 B2 11/2012 Vogt et al.
D676,014 S 2/2013 Chung
D682,244 S 5/2013 Park et al.
D686,181 S 7/2013 Jeong
D689,767 S 9/2013 Clark et al.
8,523,441 B2 9/2013 Goglio et al.
D696,107 S 12/2013 Kimple et al.
8,602,242 B2 12/2013 Sanfilippo et al.
8,602,244 B2 12/2013 Sanfilippo et al.
8,746,483 B2 6/2014 Sierra-Gomez et al.
8,951,591 B2 2/2015 Vogt et al.
9,162,786 B2 10/2015 Sanfilippo et al.
9,745,104 B2 8/2017 Sanfilippo et al.
9,850,036 B2 12/2017 Sanfilippo et al.
9,850,056 B2 12/2017 Shaw et al.
10,023,337 B2 7/2018 Sanfilippo et al.
10,207,850 B2 2/2019 Sanfilippo et al.
10,232,969 B2 3/2019 Sanfilippo et al.
10,399,746 B2 9/2019 Sanfilippo et al.
10,532,855 B2 1/2020 Sanfilippo et al.
2001/0005979 A1 7/2001 Kuss et al.
2001/0010253 A1 8/2001 Forman
2002/0009575 A1 1/2002 DeMatteis
2002/0090879 A1 7/2002 Galomb

(56) References Cited

U.S. PATENT DOCUMENTS

2002/0094922 A1 7/2002 Edwards et al.
2002/0112982 A1 8/2002 Stagray et al.
2002/0118896 A1 8/2002 Forman
2002/0144998 A1 10/2002 Lees et al.
2002/0147088 A1 10/2002 Edwards
2003/0001002 A1 1/2003 Haughton et al.
2003/0041564 A1 3/2003 Schmidt
2003/0054929 A1 3/2003 Post et al.
2003/0059130 A1 3/2003 Yoneyama et al.
2003/0063820 A1 4/2003 Buchman
2003/0085265 A1 5/2003 Haim
2003/0100424 A1 5/2003 Barmore et al.
2003/0111523 A1 6/2003 Haugan
2003/0113042 A1 6/2003 Yeager
2003/0152679 A1 8/2003 Garwood
2003/0165602 A1 9/2003 Garwood
2003/0170357 A1 9/2003 Garwood
2003/0170359 A1 9/2003 Garwood
2003/0175392 A1 9/2003 Garwood
2003/0185937 A1 10/2003 Garwood
2003/0185948 A1 10/2003 Garwood
2003/0230504 A1 12/2003 Hamming
2004/0025476 A1 2/2004 Oliverio et al.
2004/0031244 A1 2/2004 Steele
2004/0040261 A1 3/2004 Troyer et al.
2004/0058103 A1 3/2004 Anderson et al.
2004/0081729 A1 4/2004 Garwood
2004/0089578 A1* 5/2004 Lin ..... B65D 75/5838 206/494
2004/0099570 A1 5/2004 Cargile
2004/0105600 A1 6/2004 Floyd
2004/0114838 A1 6/2004 McGregor
2004/0120611 A1 6/2004 Kannankeril et al.
2004/0141664 A1 7/2004 Olsen et al.
2004/0146602 A1 7/2004 Garwood et al.
2004/0185154 A1 9/2004 Garwood
2004/0185155 A1 9/2004 Garwood
2004/0185156 A1 9/2004 Garwood
2004/0188457 A1 9/2004 Galomb
2004/0226625 A1 11/2004 Galomb
2004/0226849 A1 11/2004 Brenkus et al.
2004/0232029 A1 11/2004 Cotert
2004/0251163 A1 12/2004 Conde et al.
2004/0262322 A1 12/2004 Middleton et al.
2005/0011906 A1 1/2005 Buck et al.
2005/0031233 A1 2/2005 Varanese et al.
2005/0053315 A1 3/2005 Aasen
2005/0069227 A1 3/2005 Steele
2005/0069230 A1 3/2005 Takahashi et al.
2005/0084186 A1* 4/2005 Caris ..... B65D 75/5838 383/203
2005/0139645 A1 6/2005 Shean et al.
2005/0150785 A1* 7/2005 Julius ..... B65D 75/5838 206/233
2005/0189367 A1* 9/2005 Chasid ..... B65D 75/5838 221/35
2005/0208188 A1 9/2005 Garwood
2005/0238766 A1 10/2005 Henderson et al.
2005/0265636 A1 12/2005 Michalsky
2005/0276525 A1 12/2005 Hebert et al.
2005/0284776 A1 12/2005 Kobayashi et al.
2006/0006049 A1 1/2006 Breidenbach et al.
2006/0016865 A1 1/2006 Berglin et al.
2006/0076352 A1 4/2006 Peterson et al.
2006/0080944 A1 4/2006 Annehed et al.
2006/0113212 A1 6/2006 Steele
2006/0126970 A1 6/2006 Perell
2006/0169691 A1 8/2006 Rothschild et al.
2006/0210202 A1 9/2006 Plourde
2006/0283750 A1 12/2006 Villars et al.
2006/0285777 A1 12/2006 Howell et al.
2007/0080078 A1 4/2007 Hansen et al.
2007/0082096 A1 4/2007 Dougherty et al.
2007/0084142 A1 4/2007 Matthews
2007/0151887 A1* 7/2007 Clark, Jr. ..... B65D 77/04 206/494
2008/0053860 A1 3/2008 McDonald
2008/0274686 A1 11/2008 Kupferberg et al.
2009/0039078 A1 2/2009 Sanfilippo et al.
2009/0120828 A1 5/2009 Sanfilippo et al.
2009/0194560 A1 8/2009 Freeman et al.
2009/0232425 A1 9/2009 Tai et al.
2009/0273179 A1 11/2009 Scott et al.
2010/0002963 A1 1/2010 Holbert et al.
2010/0040311 A1 2/2010 Plate
2010/0092112 A1 4/2010 Goglio et al.
2010/0113240 A1 5/2010 Takita et al.
2010/0140129 A1 6/2010 Sanfilippo et al.
2010/0154264 A1 6/2010 Scott et al.
2010/0278454 A1 11/2010 Huffer
2011/0058755 A1 3/2011 Guibert
2011/0297690 A1 12/2011 Teys et al.
2012/0008884 A1 1/2012 Murray
2012/0125937 A1 5/2012 Ahlstrom et al.
2012/0128835 A1 5/2012 Lyzenga et al.
2012/0177307 A1 7/2012 Duan et al.
2012/0275727 A1 11/2012 Chang
2012/0321229 A1 12/2012 Surdziel et al.
2013/0004626 A1 1/2013 Renders et al.
2013/0011527 A1 1/2013 Renders et al.
2013/0114918 A1 5/2013 Lyzenga et al.
2013/0266244 A1 10/2013 Doll et al.
2014/0083897 A1 3/2014 Sanfilippo et al.
2014/0102936 A1 4/2014 Sanfilippo et al.
2014/0109522 A1 4/2014 Sanfilippo et al.
2014/0185962 A1 7/2014 Sanfilippo et al.
2014/0196406 A1 7/2014 Sanfilippo et al.
2014/0301674 A1 10/2014 Sanfilippo et al.
2014/0307985 A1 10/2014 Sanfilippo et al.
2014/0328552 A1 11/2014 Sanfilippo et al.
2015/0001234 A1 1/2015 Sanfilippo et al.
2019/0210752 A1 7/2019 Sanfilippo et al.
2019/0210782 A1 7/2019 Sanfilippo et al.

FOREIGN PATENT DOCUMENTS

CN 1237941 A 12/1999
CN 1642831 A 7/2005
CN 1781819 A 6/2006
CN 100335382 C 9/2007
CN 102317173 A 1/2012
DE 1913258 U 4/1965
DE 102010019867 A1 9/2011
EP 0734966 A1 10/1996
EP 0822142 A1 2/1998
EP 0879767 A1 11/1998
EP 1106508 A1 6/2001
EP 1437311 A 7/2004
EP 1508531 A1 2/2005
EP 1547924 A1 6/2005
EP 1637472 A1 3/2006
EP 1749756 A2 2/2007
EP 2141090 A1 1/2010
EP 2347971 A1 7/2011
EP 2586716 A1 5/2013
FR 2766794 A1 2/1999
FR 2772009 A1 6/1999
GB 1311447 A 3/1973
GB 2399331 A 9/2004
IT 1274100 B 7/1997
JP 01167084 6/1989
JP 01226579 9/1989
JP 01267182 10/1989
JP 09142551 6/1997
JP 10-203560 8/1998
JP 2003-221068 A 8/2003
JP 2005320032 A 11/2005
WO WO-86/06344 A1 11/1986
WO WO-94/11270 A1 5/1994
WO WO-00/12407 A1 3/2000
WO WO-02/085726 A1 10/2002
WO WO-2004/024588 A1 3/2004
WO WO-2004/110885 12/2004

(56) References Cited

FOREIGN PATENT DOCUMENTS

| | | | |
|---|---|---|---|
| WO | WO-2006/091821 | A2 | 8/2006 |
| WO | WO-2007/058689 | A1 | 5/2007 |
| WO | WO-2009/061959 | A1 | 5/2009 |

OTHER PUBLICATIONS

Brody et al., *Encyclopedia of Packaging Technology*, 2nd ed., New York, NY: John Wiley & Sons (1993).
Chinese Patent Application No. 201810782940.9, Search Report and First Office Action, dated Jun. 28, 2019.
Chinese Patent Application No. 201810783006.9, First Office Action, dated Apr. 15, 2019.
Chinese Patent Application No. 201810783006.9, Search Report, dated Apr. 4, 2019.
European patent application No. 18161260, European Search Report, dated Sep. 19, 2018.
Extended European Search Report, European application No. EP 09825498.0, dated Nov. 22, 2012.
Indian Patent Application No. 4342/DELNP/2015, Examination Report, dated Mar. 29, 2019.
International Search Report and Written Opinion for counterpart International Application No. PCT/US08/072554, dated Feb. 23, 2009.
International Search Report and Written Opinion for International Application No. PCT/US2008/082689, dated Mar. 24, 2009.
International Search Report and Written Opinion for International Application No. PCT/US2009/063591, dated Jun. 18, 2010.
International Search Report and Written Opinion for International Application No. PCT/US2015/022859, dated Oct. 12, 2015.
International Search Report and Written Opinion from corresponding International Application No. PCT/US2013/066985, dated Jan. 29, 2014.
Japanese patent application No. 2015-539877, Notice of Reasons for Refusal, dated Oct. 10, 2017.
Photographs of flexible container packaging, "Minibrick Pack", from Sonoco (Hartsville, South Carolina, USA) (became aware of in Dec. 2007).
SBS Special Top Design Machine, product sheet from Rovema Packaging Machines L.P. (Lawrenceville, Georgia, USA) (1 pg.) (2005).
Search Report and Second Office Action (English translation), Chinese patent application No. 201380068596.2, dated May 4, 2017.
Singapore Patent Application No. 11201503075S, Examination Report, dated Jan. 17, 2019.
Third Office Action (English translation), Chinese patent application No. 201380068596.2, dated Nov. 10, 2017.
U.S. Appl. No. 14/333,420, Nonfinal Office Action, dated Feb. 16, 2018.
U.S. Appl. No. 14/333,420, Nonfinal Office Action, dated Feb. 7, 2019.

* cited by examiner

FLEXIBLE, STACKABLE CONTAINER AND METHOD AND SYSTEM FOR MANUFACTURING THE SAME

CROSS-REFERENCE TO RELATED APPLICATIONS

This application is a divisional of U.S. patent application Ser. No. 14/145,779 filed Dec. 31, 2013, which is the continuation of U.S. patent application Ser. No. 14/089,581 filed Nov. 25, 2013 (U.S. Pat. No. 10,023,337), which is a continuation of Ser. No. 13/538,568 filed Jun. 29, 2012 (U.S. Pat. No. 8,605,244), which is a continuation of U.S. Ser. No. 12/266,495 filed Nov. 6, 2008 (U.S. Pat. No. 8,231,024), which is a continuation of U.S. Ser. No. 12/188,328 filed Aug. 8, 2008 (U.S. Pat. No. 8,066,137), which claims the benefit of priority U.S. Provisional Patent Application Nos. 61/016,802 filed on Dec. 26, 2007, 60/989,635 filed on Nov. 21, 2007, 60/987,031 filed on Nov. 9, 2007, and 60/954,609 filed on Aug. 8, 2007. The respective disclosures are hereby expressly incorporated by reference herein in their entirety.

TECHNICAL FIELD

The present disclosure is directed to a flexible, stackable container for transporting and storing food items, liquids, powders, chemicals, detergent, dry goods pharmaceuticals, nutraceuticals and other packaged products, for example, and to methods and systems for manufacturing the same and, in particular to a flexible, stackable container having a sealed bag or package formed from a flexible film and recloseable fitment or lid attached thereto, or having a recloseable flap or other easy-opening feature without an additional fitment and/or lid.

BACKGROUND OF THE DISCLOSURE

Vertical form, fill, and seal (VFFS) packaging machines are commonly used in the snack food industry for forming, filling and sealing bags of nuts, chips, crackers and other products. Such packaging machines take a packaging film from a sheet roll and form the film into a vertical tube around a product delivery cylinder. One disadvantage of these packages is that the resulting filled package is not rigid enough to allow the stacking of one package on top of another in a display.

Another disadvantage to these packages is that they do not retain their shape after the package is opened, and a portion of the contents removed.

There are rigid packages and canisters that are stackable and do retain their shape after opening. However, these rigid packages that may overcome these disadvantages have their own disadvantages. One disadvantage is that the packages are often composed of composite material that is costly to produce. Another disadvantage is that rigid composite packages are often not recyclable. The ability to recycle a product container is increasingly becoming a demand from companies that produce and/or sell consumable products as well as a demand from consumers that are environmentally conscious. A demand also exists for containers that, if not recyclable, minimize the waste transported to a landfill. Once in the landfill, a demand also exists for materials that are degradable or biodegradable to further reduce the amount of material contained in the landfill.

Yet another disadvantage of many non-flexible and/or rigid containers is the shape of the container. Many product containers have cross sections that are round. In the market place where shelf space is at a premium, round containers require more shelf space than a square or rectangular container holding the same amount of product. Similarly, shipping round or other irregularly shaped containers requires more space than shipping square or rectangular containers that are more efficiently packed together in the transport containers. Moreover, round containers do not display graphics as well as containers having flatter sides. The graphics wrap around the curved surfaces of the containers, and the containers must be in order to fully view and read the graphical information. Inefficiency in shipping and displaying packaged products adds to the overall cost of the product. Additionally, inefficiency in packing round or irregularly shaped containers increases the number of shipping containers and vehicles, ships and planes required to transport the shipping containers. This adds to the cost of the product, but more importantly, results in the increased emission of environmentally damaging pollutants.

Another disadvantage to shipping many non-flexible containers is the weight of the container as compared to the weight of a flexible container manufactured to hold a like amount of product. Increased weight adds to shipping costs as well as adds to the amount of material that, if not recyclable, ends up in a landfill. Additionally, the material cost for the non-flexible containers is usually greater than the material cost for flexible containers.

It would, therefore, be desirable to provide a container that overcomes these and other disadvantages.

Figure 1:
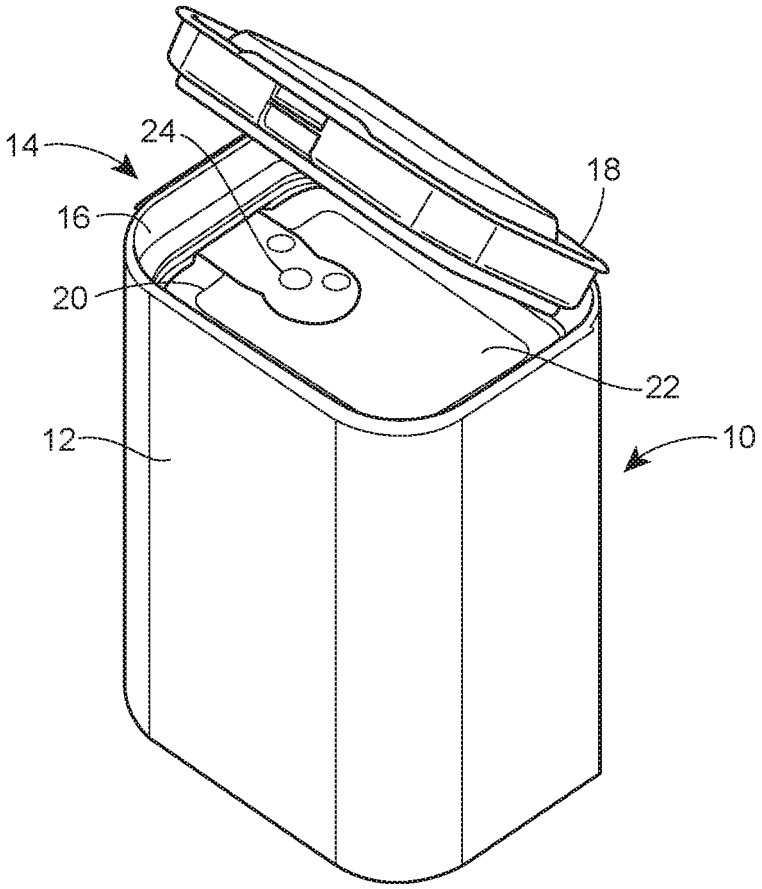
FIG. 1 is an isometric view of a flexible, stackable container in accordance with the present disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term ' ' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 2:
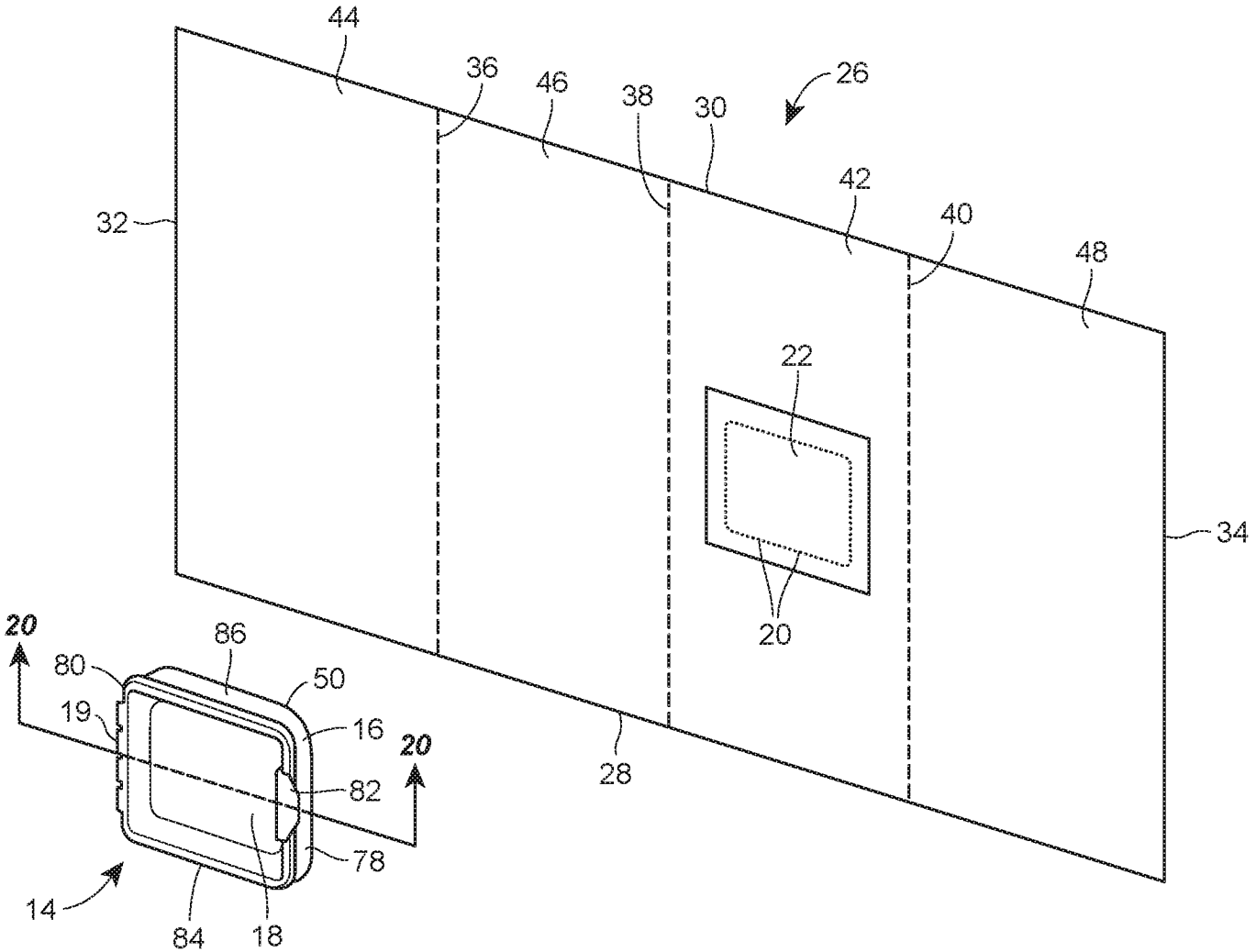
FIG. 2 is an isometric view of an unfolded sheet of film and a lid fitment of the flexible, stackable container of FIG. 1.

FIG. 1 illustrates an embodiment of a flexible, stackable container 10 in accordance with the present disclosure. The container 10 includes a flexible package 12 having a lid fitment 14 attached to one end to provide a recloseable/resealable access to the package 12 and to reinforce the package 12 to allow for stacking of the package 12 without collapsing. The package 12 as illustrated is the type of flexible packaging known to those skilled in the art as a quad seal package for the four corner seals formed in the corners of the bag. This feature will be described more fully below. The package 12 has a generally rectangular shape to conform to the shape of the lid fitment 14, but other shapes may be used. The lid fitment 14 is attached to a top side of the package 12 and is encircled by the corresponding corner seals. Depending on the particular configuration of the package 12 and lid fitment 14, and the requirements for the product packaged therein, the lid fitment 14 may be secured to the package 12 by seals formed between the lid fitment 14 and the corner seals, between the lid fitment and the surface of the side of the package 12 at which the lid fitment 14 is disposed, or a combination thereof. Alternative attachment configurations will be discussed more fully below. The lid fitment 14 includes a base 16 and a lid 18 pivotally connected by a living hinge 19 (FIG. 2). The base 16 and lid 18 have complimentary shapes so that a seal is formed therebetween when the lid 18 is closed down onto the base 16. In the illustrated embodiment, the top side of the package 12 disposed under the lid 18 has perforations 20 defining a flap 22 that may be punctured and removed by a consumer after purchase in order to access the interior of the package 12. To facilitate the removal of the flap 22, a pull tab 24 may be attached thereto in a manner that causes the perforations 20 to yield and the flap 22 to tear away when the pull tab 24 is pulled upwardly.

The package 12 may be formed from a sheet of film having a composition and structure that are appropriate for the product to be stored therein, and that may be designed to exhibit desired characteristics after disposal of the container 10. The sheet of film for the package 12 may be formed from materials such as polypropylene (PP), ethyl vinyl alcohol, polyethylene, EVA co-polymers, foil (such as aluminum foil), paper, polyester (PE), nylon (poly amide), and/or composites thereof. In other embodiments, the sheet of film may be formed from metalized oriented polypropylene (OPP) or metalized polyethylene terephthalate (PET), or combinations of such materials. Still further, the sheet of film may include or be infused with a degradable or biodegradable component that may allow the container to degrade in a relatively short amount of time after the useful life of the container 10, such as after the container 10 is disposed in a landfill or other disposal facility. If necessary or desired based on the implementation, the film may include an outer ply of heat sealable oriented polypropylene or other material suitable for heat sealing so that the seals joining portions of the film as the container 10 is fabricated may be sealed and/or attached to the outer surface of the package 12 to form and shape the container 10.

The lid fitment 14 may be made from any appropriate material having the necessary properties to be sealed to the film of the package 12. For example, the lid fitment 14 may be made from a plastic material, such as PE, polyethylene terephthalate (PETE), polyactic acid (PLA), polyvinyl chloride (PVC), polystyrene (PS), PP, and the like, by means of an appropriate forming process, such as thermoforming, injection molding, casting or blow molding. As with the sheet of film, the fitment material may also include a degradable or biodegradable component to facilitate the breakdown of the container 10 after disposal. In alternative embodiments, the containers 10 may be constructed with lid fitments 14 having varying configurations, or without lid fitments. For example, the container 10 may include a fitment having the base 16 of the lid fitment 14, but omitting the lid 18 to leave the surface of the top side exposed. The perforations 20 may extend around a portion of the flap 22 so that the flap 22 may be opened but not completely detached from the package 12, and the pull tab 24 may cover and extend beyond the flap 22 and include a tacky substance that allows the pull tab 24 to reseal to the top surface of the package. Still further, the fitment may be eliminated completely in favor of the recloseable flap 22. Additional configurations are contemplated by the inventors as having use in containers 10 in accordance with the present disclosure.

The formation of the container 10 will now be described with reference to FIGS. 2-8. Referring to FIG. 2, a film sheet 26 from which the package 12 will be formed and the lid fitment 14 are shown separately. The container 10 may be formed by manually folding the film sheet 26 and attaching the lid fitment 14 thereto. However, when the containers 10 are mass produced, the film sheets 26 are formed on a continuous web of film that may be fed through a VFFS packaging machine. While the discussion herein relates to the formation of the containers 10 on VFFS machines, those skilled in the art will understand that the containers 10 may be formed by other types of machines or combinations of machines, such as horizontal form, fill and seal (HFFS) machines, Stand-Up Pouch type machines, sequential assembly machines and the like, and the use of such machines or combinations of machines performing the various tasks in forming containers in accordance with the present disclosure is contemplated by the inventors. For consistency with the discussion below of the VFFS packaging machine 100 shown in FIG. 9, the elements of the film sheet 26 will be referenced with respect to their orientation as the film sheet 26 passes through the packaging machine 100. Consequently, the film sheet 26 has a lower leading edge 28, an upper trailing edge 30, and oppositely disposed lateral edges 32, 34. The dashed lines 36-40 in FIG. 2 indicate the separate top, bottom, rear and front sides 42-48 of the package 12 that will be defined as the film sheet 26 is folded and sealed to form the package 12. Prior to forming the package 12 from the film sheet 26, the perforations 20 are formed in a top side 42 by laser scoring, mechanical scoring or a similar process for forming perforations 42 in the film sheet 26 without puncturing the sheet 26, but allowing puncturing if necessary or desired based on the requirements for the container 10 and/or the stored product. Alternatively, blade scoring with approximately 60%-80% penetration, for example, may be used to form a score line defining the flap 22 instead of individual perforations 20. In other embodiments, full penetration through the top side 42 of the film sheet 26 may be performed by blade scoring to facilitate detachment of the flap 22. For example, a continuous blade score with full penetration through the sheet 26 may be performed with intermittent interruptions or bridges in the score line being provided to hold the flap 22 in place until a peel tab may be put in place of the consumer opens the container 10. The distance between the bridges may range from 0.1" to 2.0", and the length of the bridges may fall within the range of 0.002" to 0.090" depending on the implementation. Various alternative easy-opening features are discussed further below.

The lid fitment 14 is oriented with a bottom surface 50 facing the top side 42 to be formed in the film sheet 26. The lid fitment 14 has a front side 78 that may be oriented at the front of the container 10 and a rear side 80 opposite thereof. The living hinge 19 may rotatably connect the lid 18 to the base 16 at the rear side 80 of the lid fitment 14, and the front of the lid 18 may include a grip 82 to assist in opening the lid 18. Additional leverage tabs (not shown) may extend from the base 16 proximate the grip 82 to further facilitate opening of the lid 18 by allowing a user to press upwardly on the grip 82 and downwardly on the tab(s) to separate the lid 18 from the base 16. Lateral sides 84, 86 of the lid fitment 14 further assist in defining the shape of the container 10 as discussed more fully below. It should be noted at this point that relational terms such as top, bottom, front, rear and the like used in reference to the components and orientations of the container 10, package 12 and lid fitment 14 are used for consistency with the orientation of the container 10 as illustrated in FIG. 1 and clarity in describing the container 10. However, the container 10 may be implemented in other orientations as desired with the lid fitment 14 being disposed on any of the sides of the container 10 as may be dictated by the product stored therein, shipping or display requirements, marketing and/or advertising strategies and the like. In addition to reorientation of the container 10, it should also be noted that the lid fitment 14 may be attached to sides of the package 12 other than the top side 42, and the perforations 20 may define the flap 22 in sides other than the top side 42 as illustrated herein. Moreover, the side to which the lid fitment 14 is attached may, but is not required to, include corner seals as discussed herein for attachment of the lid fitment 14 to the package 12.

Figure 3:
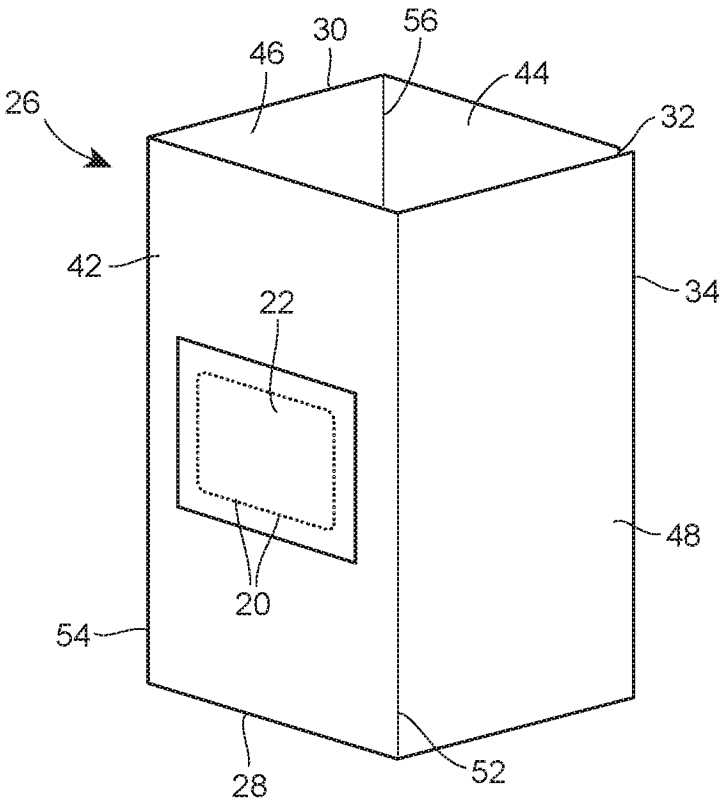
FIG. 3 is an isometric view of the sheet of film of FIG. 2 formed to define top, bottom and lateral sides.

The first step in forming the package 12 is illustrated in FIG. 3. The film sheet 26 is wrapped inwardly to form the desired shape based on the characteristics of the final package design. In the present example, the formed sheet 26 has a generally square or rectangular shape with corners 52-56 defining the top, bottom, rear and front sides 42-48. The lateral edges 32, 34 are disposed proximate each other and will ultimately have the corresponding portions of the sheet of film joined to form an edge seal at the fourth corner of the formed sheet 26, with the lateral edges 32, 34 and corresponding edge seal being disposed at the corner of the package 12. The seal at the corner may be any appropriate seal between the portions of the sheet of film proximate the lateral edges 32, 34, such as a fin seal wherein the inner surfaces of the film proximate the lateral edges are seal together, or a lap seal wherein the portions of the sheet of film are overlapped and sealed together. While the lateral edges 32, 34 are illustrated as meeting at one of the corners of the package 12, those skilled in the art will understand that the edges 32, 34 and the fin, lap or other appropriate seal may be disposed at any corner 52-56 or at any point along one of the sides 42-48 of the package 12 if desired.

Figure 4:
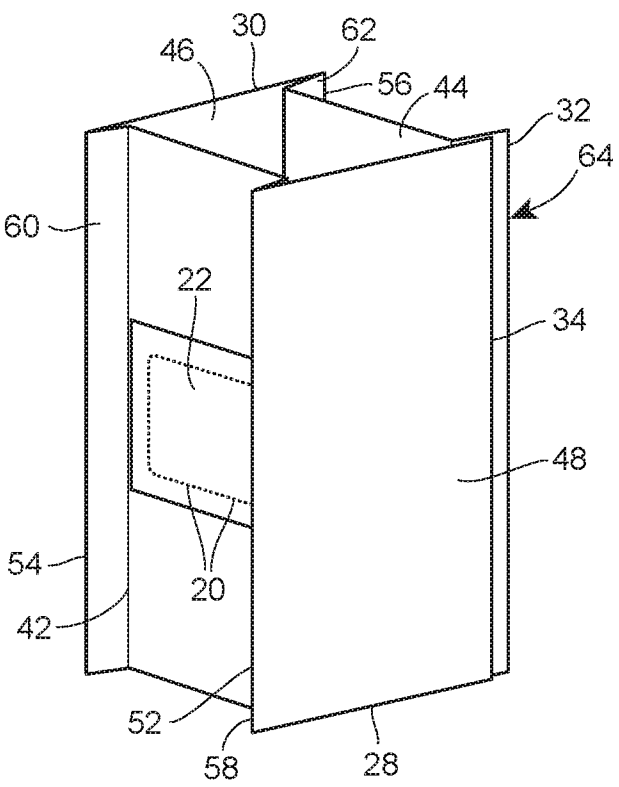
FIG. 4 is an isometric view of the sheet of film of FIG. 3 having corner seals formed at the corners.
Figure 5A:
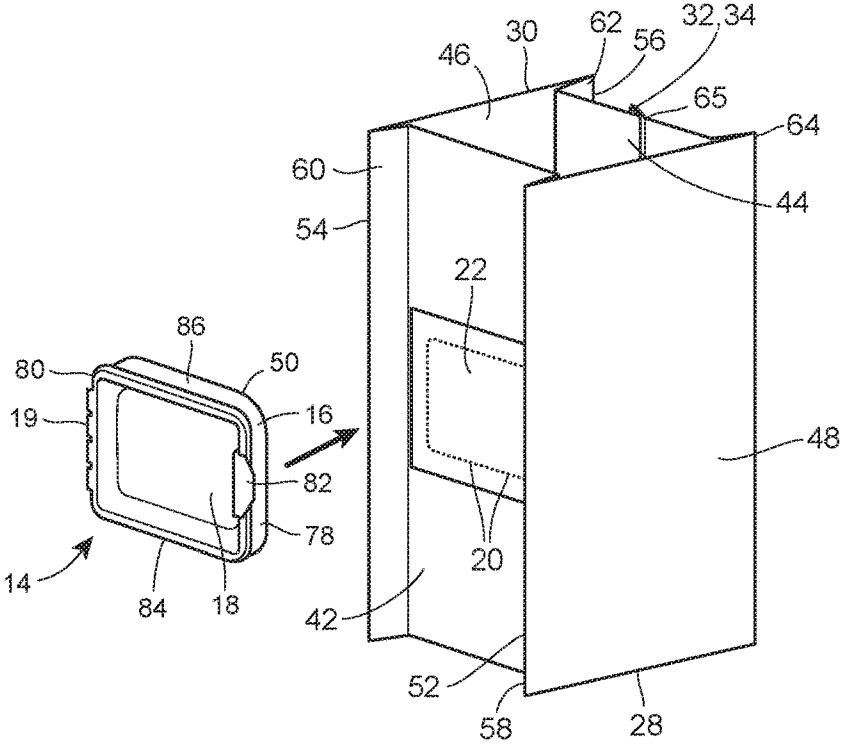
FIG. 5A is an isometric view of an alternative embodiment of the sheet of film of FIG. 4 and lid fitment of FIG. 2 with the lateral edges disposed and forming an edge seal on the bottom side of the package.
Figure 5:
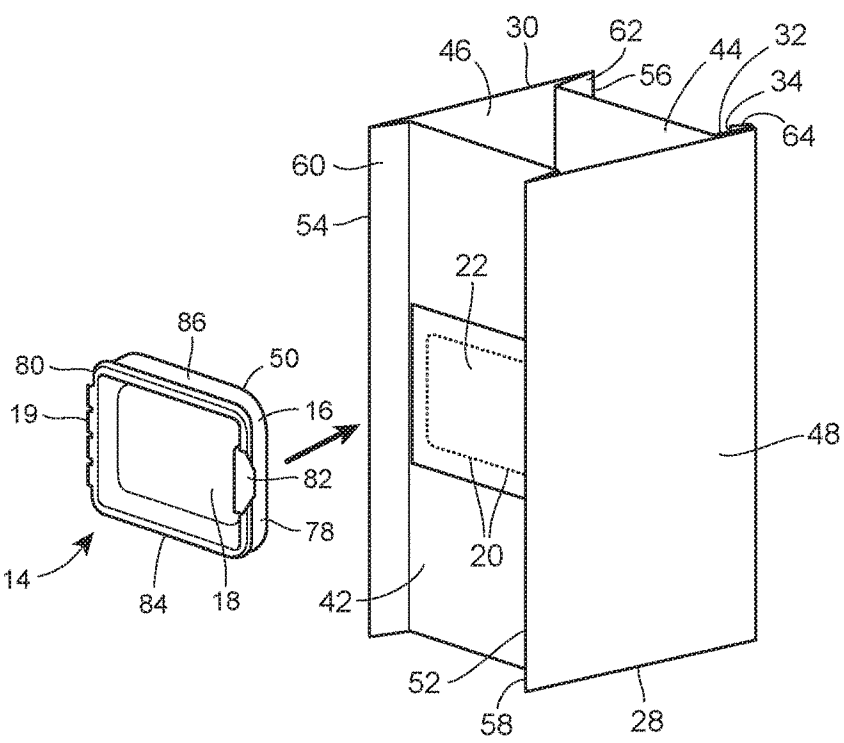
FIG. 5 is an isometric view of the sheet of film of FIG. 4 and lid fitment of FIG. 2 with the lateral edges of the sheet of film folded and sealed to form a combined edge seal and corner seal.

Turning to FIG. 4, after forming the film sheet into the desired shape, corner seals 58-64 are formed at the corners 52-56 and at the corner at which the lateral edges 32, 34 meet. Folds are made in the top and bottom sides 42, 44 of the film sheet 26 inwardly from both corners 52-56 to bring the folded portions into contact with the inner surfaces of the sides 46, 48. Once folded inwardly, the folded portions are welded, adhered or otherwise sealed to sides 46, 48. As a result, the four corner seals 58-64 extend outwardly substantially perpendicular to the top and bottom sides 42, 44 of the film sheet 26. The lateral edges 32, 34 may also be sealed together to form a combination edge seal and corner seal 64 as shown in FIG. 5. The inner surface of the folded portion of the bottom side 44 is brought into alignment and contact with the inner surface of the corresponding portion of the front side 48 proximate the lateral edge 34. The surfaces are then sealed together in a similar manner as the other corner seals 58-62. To further reinforce the combination edge seal and corner seal 64, a portion of the seal 64 may be folded inwardly and into contact with the unfolded portion of the combination seal 64. If necessary or desired, the folded and unfolded portions of the combination seal 64 may also be sealed for further reinforcement. With the corner seals 58-64 formed, the lid fitment 14 may be connected to the package 12 proximate the flap 22 on the top side 42. Those skilled in the art will understand that the forming steps illustrated in FIGS. 3-5 may occur separately or may be performed together by an appropriately configured packaging machine.

If desired or dictated by the requirements of the particular container 10, the film sheet 26 and the packaging machine 100 may be configured to form a package 12 having the edge seal disposed at a location other than at one of the corner seals. As shown in an alternative configuration of the package 12 in FIG. 5A, the lateral edges 32, 34 of the film sheet 26 may meet in the middle of the bottom side 44. Instead of being a combined edge and corner seal, the seal 64 is a corner seal formed in a similar manner as the other corner seals 58-62. At the point where the edges 32, 34 meet, an edge seal 65 is formed by bringing the portions of the film sheet 26 proximate the lateral edges 32, 34 together and forming a seal therebetween, such as a fin or lap seal, using heat sealing or other appropriate sealing method. Once sealed, the edge seal 65 in the form of a fin seal may be folded over and tacked to the outer surface of the bottom side 44 if desired.

Figure 6:
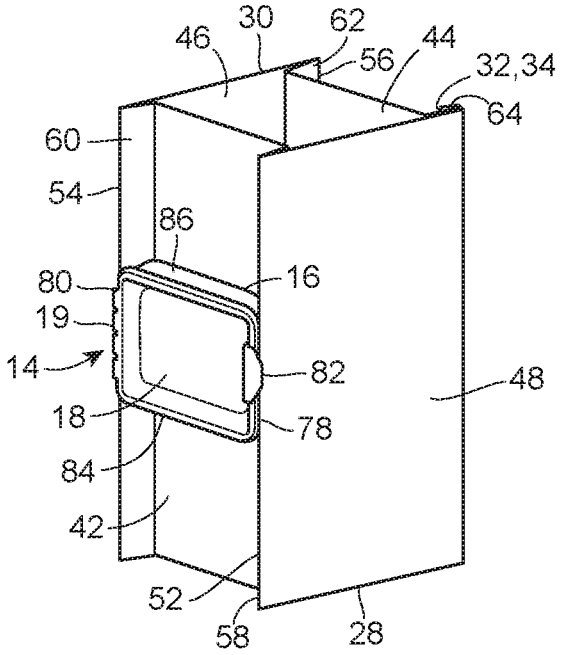
FIG. 6 is an isometric view of the sheet of film of FIG. 5 with the lid fitment attached to a top side thereof.

As shown in FIG. 6, the lid fitment 14 is disposed with the bottom surface 50 facing the outer surface of the top side 42 of the package 12. In this embodiment, the front and rear sides 78, 80 of the lid fitment 14 are disposed adjacent to the corner seals 58, 60 of the top side 42. In one embodiment, the corner seals 58, 60 are then sealed to the sides 78, 80 of the base 16 of the lid fitment 14. For example, the corner seals 58, 60 may be heat sealed to the sides 78, 80 of the lid fitment 14, or may be attached using time or pressure seals, adhesive seals, welding or any other appropriate fastening mechanism. In alternative embodiments, the bottom surface 50 of the base 16 of the lid fitment 14 may be sealed to the outer surface of the top side 42 of the package 12 using one of the sealing mechanisms discussed above or another appropriate mechanism. Still further, the lid fitment 14 may be attached with seals formed with both the corner seals 58, 60 and the outer surface of the top side 42.

Figure 7:
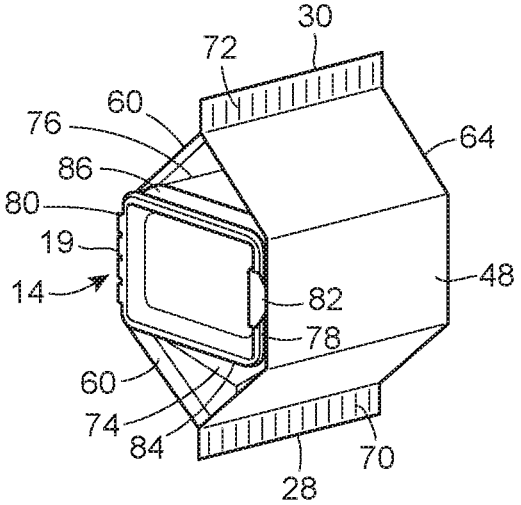
FIG. 7 is an isometric view of the sheet of film and lid fitment of FIG. 6 with the leading and trailing edges sealed to form leading and trailing seals.

Once the lid fitment 14 is attached, the open ends of the package 12 may be sealed to close the package 12, and folded and tacked down to conform the shape of the package 12 to the lid fitment 14. Referring to FIG. 7, the lateral side portions of the leading and trailing edges 28, 30 are brought toward each other and sealed together to form leading and trailing seals 70, 72. In order to ensure the leading and trailing seals 70, 72 of the package 12 wrap around the outer surface of the package 12 and the lid fitment 14 neatly to form a relatively smooth and uniform outer surface for the container 10, it may be necessary to tuck the film between the corner seals 58-64 on the top and/or bottom sides 42, 44 of the package 12 at the time the leading and trailing seals 70, 72 are formed. To accomplish this, when the leading and trailing edges 70, 72 of the package 12 are brought together, the corresponding portions of the top and bottom sides 42, 44 may be moved inwardly to tuck the sides 42, 44 as the edges 28, 30 move together and are sealed to form the leading and trailing seals 70, 72 of the package 12. As the leading and trailing seals 70, 72 are being formed, the package 12 may be filled with a quantity of the product for which the container 10 is designed. Consequently, the leading seal 70 may be formed first, the product deposited in the package 12, and then the trailing seal 72 may be formed, or the trailing seal 72 may be formed first if necessary to facilitate the manufacturing of the container 10.

Figure 8:
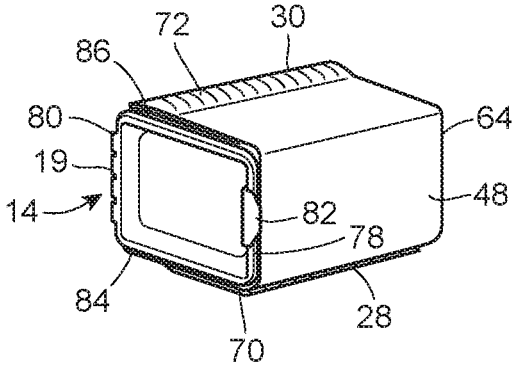
FIG. 8 is an isometric view of the sheet of film and lid fitment of FIG. 7 with the leading and trailing seals folded over and tacked to the outer surfaces of the package.

Having formed the leading and trailing seals 70, 72, the seals 70, 72 and the corresponding loose portions of the film proximate thereto may be folded over and attached to the outer surface of the package 12 to complete the formation of the container 10 as shown in FIG. 8. The seals 70, 72 may be wrapped around the lid fitment 14 to conform the loose portion to the outer surfaces of the lid fitment 14 and the package 12, and the seals 70, 72 may be attached to the outer surface of the package 12. The seals 70, 72 may be attached to the surface of the package 12 using heat, time or pressure sealing techniques, or by applying a hot tack adhesive between the seal 70, 72 and the outer surface, or other welding processes. The loose portion of the film should lay relatively flat and conform to the stationary portion of the package 12 when folded and sealed due to the tucks 74, 76 made in the sides 42, 44 at the time the leading and trailing seals 70, 72 were formed. Once the seals 70, 72 are folded and tacked, the portions of the corner seals 58, 60 proximate the lateral sides 84, 86 of the lid fitment 14 may be sealed thereto in a similar manner as to the front and rear sides 78, 80.

The steps performed in the process described in FIGS. 2-8 and the orders in which they are formed are exemplary. Those skilled in the art will understand that the process may be varied to form the container 10, and the configuration of the container 10 may also be varied, and such variations are contemplated by the inventors. For example, the lid fitment 14 may be attached to film sheet 26 prior to folding the sheet 26 to form the sides 42-48. Alternatively, the package 12 may be fully formed as shown in FIG. 8 before the lid fitment 14 is sealed thereto. Even where the lid fitment 14 is attached to the top side 42 as shown in FIG. 6, the lid fitment 14 may be merely tacked in place at that time to assist in properly shaping the package 12, with the seals between the base 16 of the lid fitment 14 and the corner seals 58, 60 and/or the top surface of the top side 42 being made after the package 12 is fully formed. Still further, in a manner illustrated more fully below, the package 12 may be formed with the leading edge 28 sealed and the trailing edge 30 open, and with the lid fitment 14 being attached before or after the product is dispensed into the package 12. Of course, the container 10 may be formed with the lid fitment 14 attached to any of the sides of the package, as well as without including a lid fitment 14 as discussed above. The steps may also be varied to allow the product to be deposited in the package 12 at an appropriate point in the process. As an example, it may be advantageous to form the leading seal 70, and fold over and tack the seal 70 to the surface of the package 12 before depositing the product in the package 12 so that the product does not interfere with folding over the seal 70. Once the product is deposited, the trailing seal 72 may then be formed, folded over and tacked to the surface of the package 12.

The configuration of the container 10 may also be varied as desired while still forming a sealed package 12 from a sheet of film 26 and sealing a lid fitment 14 thereto in a manner that allows the container 10 to be reclosed after the package 12 is opened. For example, the package 12 may be formed with only the corner seals 58, 60 that surround the top side 42 of the package, and without the corner seals 62, 64 at the bottom side 44, thereby allowing the container 10 to rest on the outer surface of the bottom side 44 when stored on a shelf or when stacked on top of another container 10. In such embodiments, the corner seals 62, 64 of FIGS. 5 and 5A may be omitted, and the edge seal 65 may be formed at one of the corners of the bottom surface 44, or at a point along the bottom surface 44. With the omission of the corner seals 62, 64, the edge seal 65 may still be formed before the leading seal 70 and trailing seal 72 are formed, or the seals 70, 72 may be formed prior to forming the edge seal 65 in the bottom surface 44. In some implementations, an additional sheet of film, paper label, fitment structure or the like may be attached to the bottom side 44 having corner seals 62, 64 or to the flat bottom side 44 to ensure the integrity of the seals of the film sheet 26 on the bottom side 44, to facilitate the stacking of the container 10 on a shelf or on other containers 10 and/or to provide additional usable printable space on the exterior of the container 10 for bar codes and other relevant product information. The corner seals 58, 60 may be formed with an orientation other than perpendicular to the top side 42 of the package 12, and the base 16 of the lid fitment 14 may have a complimentary shape to the orientation of the corner seals 58, 60 so that the corner seals 58, 60 may be sealed thereto. Alternatively, the corner seals 58, 60 may also be omitted, and the bottom surface 50 of the base 16 may the sealed directly to outer surface of the top side 42. Where the corner seals 58, 60 are not formed to surround the top side 42, the base 16 may be configured to slip over the edges of the top side 44 and have an inner surface sealed to the outer surfaces of the front, rear and lateral sides of the package 12 proximate the top side 42. Still further, the package 12 may be formed into other shapes than the generally cubic shapes illustrated herein, and may have more or fewer than the six sides. For example, the container may have a substantially cylindrical shape such that the top and bottom sides are circular or ovoid, with the lid fitment 14 having a complimentary shape to facilitate formation of the seal(s) between the package 12 and the lid fitment 14. Other package 12 and lid fitment 14 geometries that may be used in containers 10 an accordance with the present disclosure will be apparent to those skilled in the art and are contemplated by the inventors.

The type of seals formed at the seals 58-64, 70, 72 and between the sides 78, 80, 84, 86 of the lid fitment 14 and the top side 42 and/or corner seals 58, 60 may be dictated by the product to be stored within the container 10. The seals formed for the container 10 may be only those necessary to retain the product within the container 10 both when the package 12 is sealed and when the top surface of the package 12 is punctured and the lid 18 is closed down onto the base 16 of the lid fitment 14 to reclose the container 10. For example, it may not be necessary to incur the expense of forming air and water tight seals where the container 10 will store non-perishable or non-spoilable products, such as BBs and the like. These types of products may also allow for greater fault tolerance for gaps, channels, wrinkles and other imperfections or "channel leakers" that are unintentionally formed in the seals but do not allow the stored produce to leak from the container 10. Of course, non-perishable items having smaller granules, such as powdered detergents, may require more impervious types of seals, as well as greater reliability and fewer imperfections in the sealing processes.

Liquids may similarly require liquid-impervious seals that are reliably formed in the container 10.

For food items such as potato chips and cereal, or other types of products where freshness and crispness of the product should be maintained prior to and after the package 12 is opened, hermetic seals may be formed to protect from or prevent the passage of air and/or moisture through the seals. Other food items may require packaging that can breathe for proper storage. For example, lettuce and other produce may continue to respire while in the container to convert carbon dioxide into oxygen, and consequently require a certain level of venting of the air within the package to maintain a desired atmosphere in the container 10. Alternatively, a specific film structure having the desired venting properties or some other form of appropriate package venting may be used instead of relying on the seals to provide the necessary ventilation. As another example, coffee beans may continue to release gases after roasting, thereby increasing the pressure within the package, and consequently necessitating air flow through the seals and/or the film so that excessive pressure does not build up within the package after the package is sealed. Still other products may require certain levels of water vapor transmission rates to adequately store the product in the container 10 for the expected storage duration. Those skilled in the art will understand that the particular seals formed in the container 10 as well as the properties of the sheet of film 26 from which the package 12 is manufactured in a particular implementation may be configured as necessary to meet the varying needs of the stored products, if any, for air and water transmission between the interior of container 10 and the external environment. Consequently, seals as used herein in the descriptions of the various embodiments of the containers 10 is not intended to be limiting on the type of seal being formed except where noted.

Figure 9:
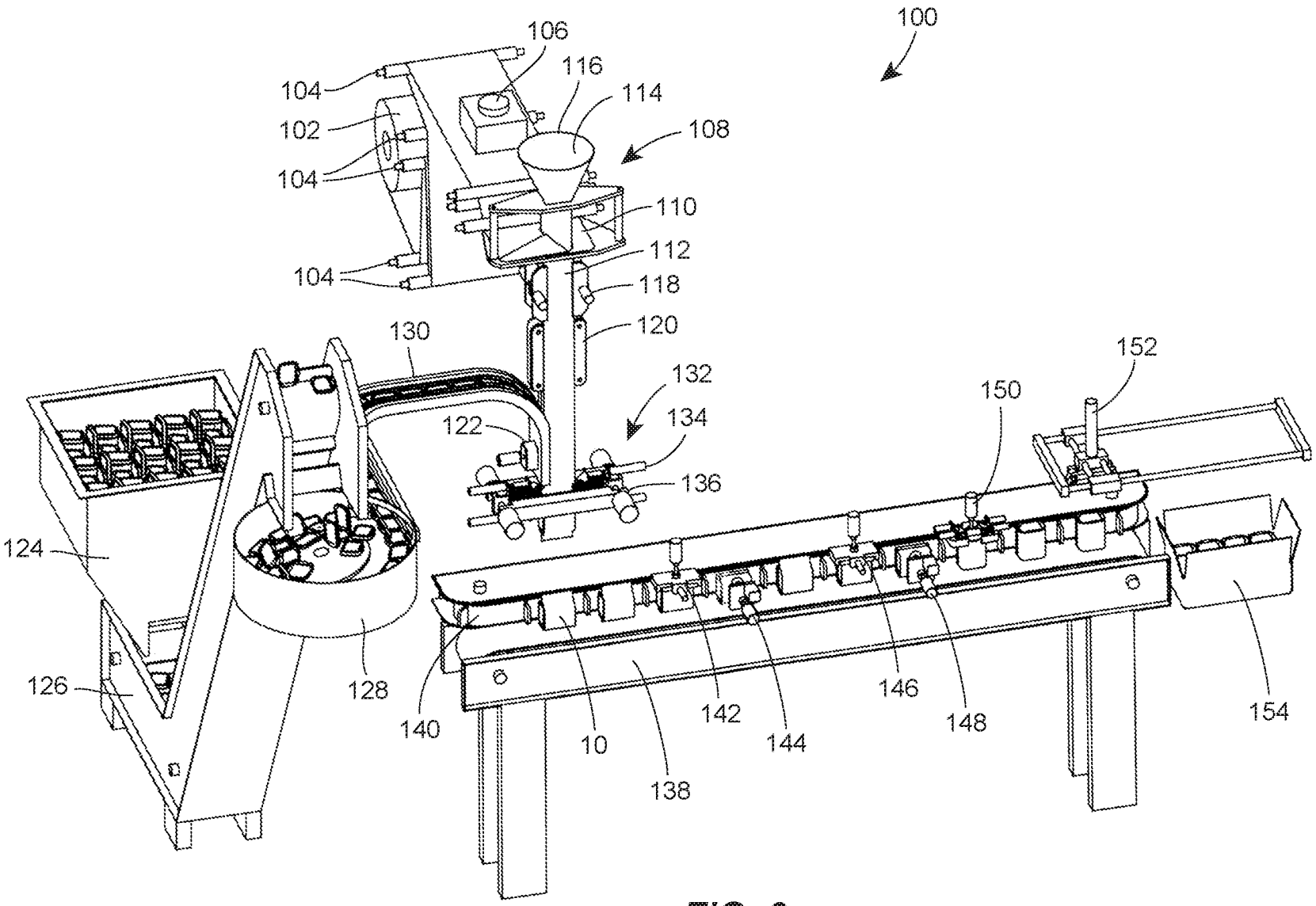
FIG. 9 is a schematic illustration of a packaging machine configured to produce the flexible, stackable container of FIG. 1.

FIG. 9 schematically illustrates one example of a packaging machine 100 configured to produce flexible stackable containers 10 in accordance with the present disclosure. For example, the machine 100 may produce the container 10 discussed previously. The machine 100 may be of the type known to those skilled in the art as a vertical form, fill and seal (VFFS) packaging machine. The packaging machine 100 is capable of continuously forming a series of containers 10 from a web of film that may be fed into the packaging machine 100. In most applications, the web is pre-printed with graphics relating to the product to be disposed within the container, such as product information, manufacturer information, nutritional information, bar coding and the like. The web of packaging film is provided on a film roll 102 rotatably mounted on a shaft at the inlet end of the packaging machine 100. The packaging film is typically fed into the packaging machine 100 over a series of dancer rolls and guide rolls 104, one or more of which may be driven to direct the web of film in the direction of the transport path of the packaging machine 100.

Before being formed into the shape of the flexible package 12 for the container 10, the film may be directed through a pre-processing station 106 for additional treatment of the film that may not have been practical or desired at the time the film was prepared and wound onto the film roll 102. The treatments performed at the pre-processing station 106 may include mechanical or laser perforating, scoring or punching or other appropriate processing for defining the flap 22 that may be disposed under the lid fitment 14, application of a peel or pull tab 24 to the flap 22, code dating, applying RFID chips, or any other appropriate pre-processing of the film that should occur at the time the containers 10 are formed. In some embodiments of the packaging machine 100, it may even be desirable to attach the lid fitments 14 at the pre-processing station 106 prior to forming the film into the flexible packages 12. In other embodiments, the pre-processing station 106 may be omitted such that no pre-processing occurs as the sheet of film is unrolled from the film roll 102.

After passing through the pre-processing station(s) 106, the web of film is directed to a forming station 108 having a forming shoulder 110, or other device such as a forming box or sequential folding system, configured to wrap the film around a forming tube 112 in a manner known in the art. In the present example, the forming tube 112 is a product fill tube 114 having a funnel 116 for receiving the product to be disposed in the container 10 and filling the container 10 with the product as the film proceeds along the forming tube 112 as discussed more fully below. The forming tube 112 is configured to form the film into the desired shape based on the characteristics of the final package design, such as square, rectangular, oval, trapezoidal, round, irregular and the like. Depending on the characteristics of the film being processed and/or the container 10 being manufacture and other factors, the film may merely be wrapped completely or partially around the forming tube 112 to shape the film, or folding devices may be used to form creases at the corners 52-56 of the film if more permanent shaping is desired during the initial stages of the package forming process. Of course, where other types of non-VFFS packaging machines are used, a forming tube may not necessarily be used, and instead the film may be wrapped directly around the product to be stored in the container 10.

After the film is formed around the forming tube 112, the web of film moves along the transport path to a combination edge seal/corner seal station 118 to form corner seals 58-62 at the corners 52-56 between the sides 42-48 of the package 12, and to create a combination edge seal and corner seal 64 at the lateral edges 32, 34 of the web of film. In one implementation of the packaging machine 100, the corner seals 56-64 may be formed at the station 118 by providing flat forming plates projecting outwardly from the square or rectangular forming tube 112. The forming plates each extend from a corner of the forming tube 112 in parallel planes that are perpendicular to the surface of the side 42 to which the lid fitment 14 is to be secured and to the opposite side 44 of the package 12 such that two plates extend from the corners defining the lateral edges of the top side 42 and two plates extend from the corners defining the bottom side 44 of the package 12. So that the film properly wraps around the forming plates, the station 118 may further include a shaping bar disposed between each pair of forming plates to shape the film in preparation for sealing the corner seals 58-64. After the web of film passes the forming plates and shaping bars, the web of film is directed past welding devices of the station 118 that weld the overlapping portions of the film at the corners 52-56 and lateral edges 32, 34 to complete the corner seals 58-64. Any appropriate welding device capable of sealing the film to form the corner seals 58-64 may be implemented, including heat sealing devices, mechanical sealing devices such as nip wheels, and the like. Depending on the configuration of the container 10, the forming plates could project outwardly in planes that are not perpendicular to the surface of the top side 42 such that the corner seals 58-64 are not perpendicular to the top side 42. In such implementations, the base 16 of the lid fitment 14 may be formed with a shape that is complementary to the orientation of the corner seals 58-64.

At one corner of the forming tube 112, portions of the film proximate the lateral edges 32, 34 of the film are joined to form the combination edge seal and corner seal 64. To ensure the integrity of the combined edge seal and corner seal 64 during the use of the container 10, an additional fold may be formed at the corner, with the folded portion being welded to the mating portion of the seal 64 to reinforce the corner seal 64. Downstream of the corner seal welding devices, an additional forming shoulder may be provided to fold a portion of the combination seal 64 formed at the lateral edges 32, 34 inwardly upon itself to overlap the unfolded portion. An additional welding device may be provided to form a second weld at the corner seal 64 after the film passes the forming shoulder to preserve the additional fold. Alternatively, the portion of the corner seal 64 may be folded outwardly and welded in a similar manner. While the present example illustrates the lateral edges 32, 34 meeting at a corner of the package 12 and being welded to form the combination edge seal and corner seal 64, those skilled in the art will understand that the packaging machine 100 may be configured such that the lateral edges 32, 34 meet at any of the corners 52, 56 of the package 12, or at any point along any of the flat surfaces such that a fin seal, a lap seal or other appropriate edge seal is formed separately from the corner seals. In the illustrated example, an edge seal may be formed at one of the corner seals 64 to maximize the amount of printable space available on the exterior of the container 10. As discussed above, the edge seal may be disposed along a side of the package 12 instead of at one of the corners. In such configurations, the station 118 may be configured to form the corner seal 64 in a similar manner as the other corner seals 58-62, and to form a fin, lap or other seal at the intersection of the lateral edges 32, 34. Of course, the corner seals 56-62 and the edge seal may be formed by different work stations depending on the particular configuration of the packaging machine.

In order to further control the movement of the web of film along the forming tube 112 and the transport path, pull belts 120 may be provided after the stations 118 to engage the film and pull the film through the previous stations 106, 108, 118. Once the corner seals 58-64 are formed in the corners of the package 12, the lid fitment 14 may be installed on the package 12 at a desired location and preferably overlying the removable/recloseable flap 22 at a lid application station 122. The lid fitments 14 may be delivered to the lid application station 122 from a supply of lid fitments 14 at a lid bulk hopper 124. Lid fitments 14 from the hopper 124 may be transferred via a lid elevator 126 to a lid sorter/orientator 128. The sorter/orientator 128 is configured to position the lid fitments 14 in the proper orientation for delivery to the lid application station 122. At the outlet of the sorter/orientator 128, the properly oriented lid fitments 14 may be delivered to the lid application station 122 by a lid feed conveyor 130.

At the lid application station 122, the lid fitments 14 are positioned against and secured to the proper location on the packages 12 as the packages 12 pass the lid application station 122 on the forming tube 112. In the present example, the bottom surface 50 of the lid fitment 14 is placed against the top side 42 of the package 12 at the location of the removable flap 22 with front and rear sides 78, 80 of the lid fitment 14 being disposed at corresponding portions of the corner seals 58, 60 defining the edges of the top side 42. When the package 12 is disposed at the proper location adjacent the lid application station 122, a plunger, mandrel or other positioning device of the lid application station 122 may actuate to push the next lid fitment 14 from the lid feed conveyor 130 toward the forming tube 112 with the bottom surface 50 of the lid fitment 14 engaging the surface of the top side 42 of the package 12. The head of the mandrel or plunger may be shaped to conform to the inner recess of the top surface of the lid fitment 14 for properly aligning the lid fitment 14 with the surface of the package 12 and for applying an appropriate amount of pressure to the surface of the film. Once in place, sealing devices of the station 122 may form seals between the front and rear sides 78, 80 of the lid fitment 14 and the corresponding portions of the corner seals 58, 60 of the top side 42. For example, the sealing devices may be heat sealers forming heat seals between the sides 78, 80 of the lid fitment 14 and the corner seals 58, 60 of the package 12. Of course, other types of seals may be formed such that the sides 78, 80 of the lid fitment 14 are sealed to the corner seals 58, 60 such as by heat, time or pressure sealing techniques, adhesive attachment, welding and the like. Moreover, the lid fitment 14 may alternatively be connected to the top side 42 of the package 12 by forming a seal between the bottom surface 50 of the lid fitment 14 and the surface of the top side 42 of the package 12. The particular sealing mechanism and location may be determined based on the particular configurations of the lid fitments 14 and the packages 12 to which they are being attached or based on the processes used to attach the lid fitment 14 to the package 12, and alternative attachment configurations will be apparent to those skilled in the art.

Once the lid fitment 14 is attached, the leading and trailing edges 28, 30 of the package 12 may be sealed to close the package 12, and folded and tacked down to conform the shape of the package 12 to the lid fitment 14. The package 12 with the lid fitment 14 attached passes from the lid application station 122 to a closing station 132. In order to ensure the edges 28, 30 of the package 12 wrap around the lid fitment 14 neatly to form a relatively smooth and uniform outer surface for the container 10, it may be necessary to tuck the film between the corner seals 58-64 on the top and/or bottom sides 42, 44 of the package 12 at the time the leading and trailing seals 70, 72 are formed. To accomplish this, the closing station 132 may include film tuck bars 134 disposed above seal bars 136 of the closing station 132. When the leading edge 28 of the package 12 is aligned at the seal bars 136, the film tuck bars 134 may move inwardly toward the corresponding sides 42, 44 of the package 12 and engage the surfaces of the sides 42, 44 to tuck the sides 42, 44 inwardly as the seal bars 136 move together to engage and seal the leading edge 28 of the package 12. It should be noted that since the packages 12 are being formed from a continuous web of film, the seal bars 136 simultaneously close upon the film and may seal the trailing edge 30 of the preceding package 12. Consequently, additional film tuck bars 134 may be provided below the seal bars 136 to tuck the sides 42, 44 at the trailing edge 30 of the preceding package 12. While not shown in the present process of FIG. 9, in an alternate embodiment the closing station 132 may seal only the leading seal 28 of the upper package 12 and leave the trailing edge 30 of the packages 12 open. For example, the seal bars 136 may be double seal bars that are heated separately to seal either the trailing seal 72 of the bottom package 12 or the leading seal 70 of the upper package 12 if desired. Moreover, the double seal bars may engage separately so that only one of the packages 12 is engaged by the seal bars 136 when the packages 12 pass through the closing station 132.

As discussed above, the forming tube 112 of the illustrated embodiment of the packaging machine 100 is a product fill tube 114. Once the leading edge 28 of the package 12 is closed during the sealing process at the closing station 132, the product may be added to the package 12. At that point, a specified amount of the product may be poured through the funnel 116 into the fill tube 114 and drop into the package 12 where the product is retained due to the seal 70 at the leading edge 28 of the package 12. After or as the package 12 receives the product, the package 12 advances to align the trailing edge 30 of the package 12 at the closing station 132 and the trailing edge 30 is tucked and sealed in the manner described above, thereby sealing the package 12 with the product disposed therein. In some implementations, the additional weight of the product in the package 12 may pull on the film and increase the tightness of the film at the closing station 132. In order to control the tightness in the film while forming the seals 70, 72 at the closing station 132, it may be necessary to provide a lifting mechanism to engage and lift the downstream package 12 sufficiently to relieve some or all of the tension in the film such that the seals 70, 72 are properly formed in the packages 12.

At the same time the seals 70, 72 of the adjacent packages 12 are formed, a gas flushing operation may be performed if necessary to place a desired atmosphere in the package 12. Of course, gas flushing may occur continuously or at other times as the package 12 is formed and filled. Additionally, deflators or inflators, or heated gas or cooled gas may be provided and used during one or more of the previous steps to achieve a desired looseness or tightness to the package 12. Once the package 12 is sealed, it may be detached from the web of film in preparation for any final processing steps and containerization. Consequently, the closing station 132 may further include a knife or other separation device (not shown) proximate the seal bars 136 to cut the common seal 70/72 and separate the adjacent packages 12. Alternatively, the separation may occur at a downstream station. After separation, the package 12 may drop or otherwise be transported to a conveyor 138 for delivery to the remaining processing stations.

The conveyor 138 may include a timing belt or timing chain 140 for maintaining proper spacing between the packages 12 and alignment with the remaining processing stations. Other types of conveyors may be used, such as intermittent motion type conveyor belts, shuttle type transfer devices and the like. If necessary, the conveyor 138 may include guide rails or other package control devices to ensure that the packages are properly aligned and spaced as they move along the conveyor 138. The first station along the conveyor 138 may be a top bag seal folder/sealer station 142. The folder/sealer station 142 may fold the trailing seal 72 and the corresponding loose portion of the film around the lid fitment 14 and outer surface of the relatively stationary portion of the package 12 to conform the loose portion to the outer surfaces of the lid fitment 14 and the package 12, and attach the seal to the outer surface of the package 12. The seal 72 may be attached to the surface of the package 12 using heat, time or pressure sealing techniques, or by applying a hot tack adhesive between the seal and the outer surface, or other welding processes. The loose portion of the film should lay relatively flat and conform to the stationary portion of the package 12 when folded and sealed due to the tucks made in the sides 42, 44 at the time the edge seals 70, 72 were formed. After the trailing seal 72 is sealed to the package 12, the timing belt or chain 140 may reposition the package 12 at a first package turner 144 that may reorient the package 12 for folding and sealing of the leading seal 70. The reorientation may be a 180° rotation of the container to place the leading seal 70 at the top of the package 12. Once the package 12 is rotated, the timing belt or chain 140 may transfer the package 12 to a bottom bag seal folder/sealer station 146 for attaching the leading seal 70 to the outer surface of the package 12 in a similar manner as described for the folder/sealer station 142. Alternatively, the leading seal 70 may be folded and attached without reorienting the package 12 or at the same time as the trailing seal is folded and attached.

Once the seals 70, 72 are attached to the outer surface of the package 12, the lateral sides 84, 86 of the lid fitment 14 may be sealed to the corresponding portions of the corner seal 58, 60 of the package 12 so that the container 10 may properly store and maintain the freshness of the product stored therein after the flap 22 is removed and the package 12 is no longer sealed. In preparation, the timing belt or chain 140 may first position the package 12 at a second package turner 148 that may rotate the package 12 so that the lid fitment 14 is disposed at the top. The timing belt or chain 140 may then move the package 12 to a lid final sealer 150 that may be configured to seal the lateral sides 84, 86 of the lid fitment 14 to the corresponding portions of the corner seals 58, 60 and/or seal the bottom surface 50 of the base 16 to the top surface of the top side 42. The final sealer 150 may perform a similar sealing process as that performed at the lid application station 122, such as heat sealing, adhesive sealing or the like, or other welding processes. If necessary, a post-processing station(s) (not shown) may be included along the conveyor 138 for any additional operations to be performed prior to shipment, such as code dating, weight checking, quality control, labeling or marking, RFID installation, and the like. At the conclusion of the sealing and post-processing activities, the finished containers 10 may be removed from the conveyor 138 by a case packer 152 and placed into a carton 154 for storage and/or shipment to retail customers.

The components of the packaging machine 100 and the steps for forming the containers 10 therein may be rearranged as necessary to properly form the containers 10, and to do so in an efficient and cost-effective manner. For example, if necessary to correctly form and shape the package 12, the lid application station 122 may be positioned upstream of the seal station 118 to apply the lid fitment 14 to the sheet of film 26 prior to forming the corner seals 58-64. Alternatively, to increase efficiency or to compensate for space limitations, for example, it may be necessary or desired to position the lid application station 122 along the conveyor 138 to apply and seal the lid fitment 14 to the package 12 after the package 12 is formed. For example, the lid application station 122 could be positioned upstream of the folder/sealer station 142 to apply the lid fitment 14 to the package 12 prior to attaching the trailing seal 72 to the surface of the package 12. Other configurations of the components of the packaging machine 100 will be apparent to those skilled in the art.

Figure 10:
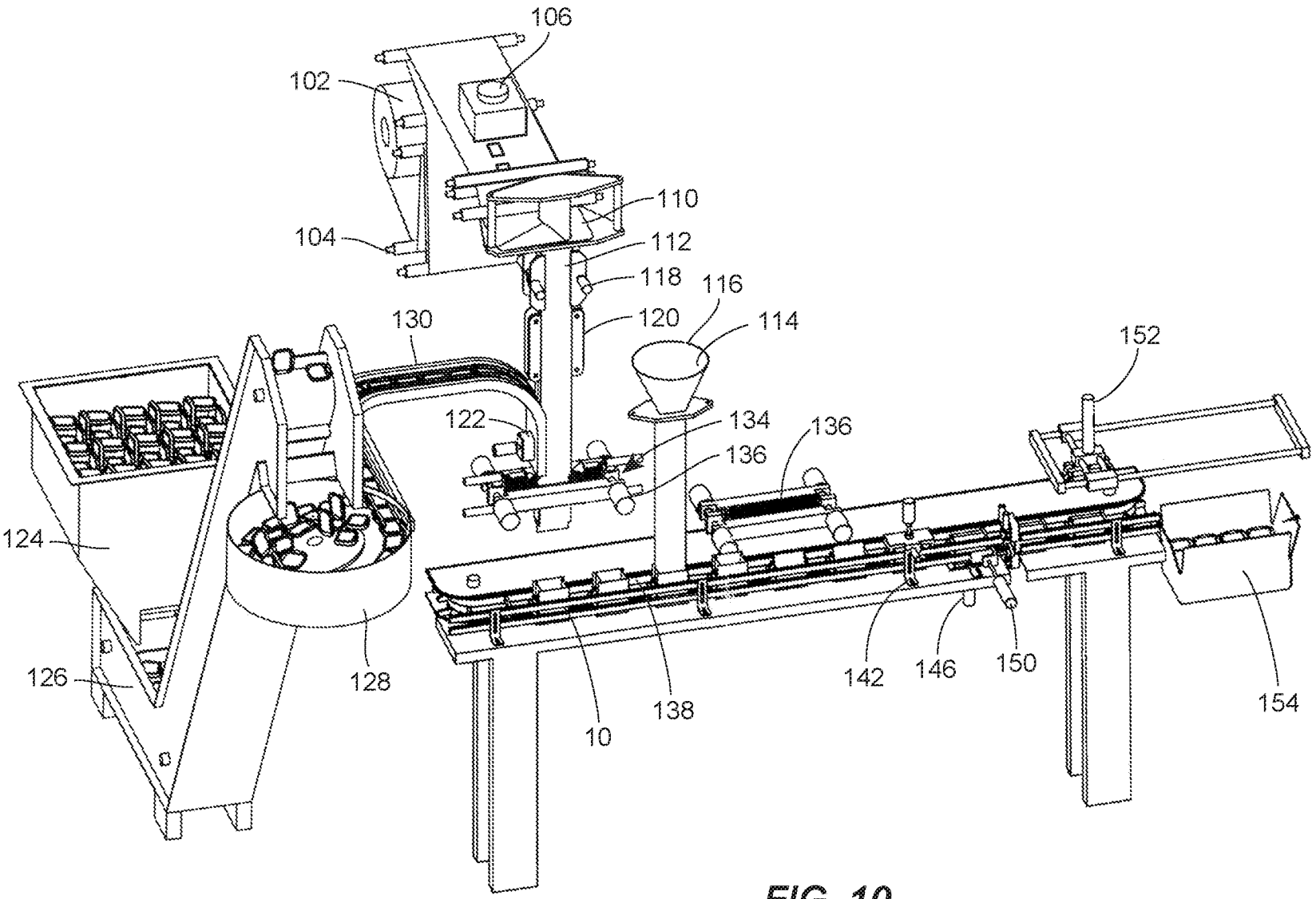
FIG. 10 is a schematic illustration of a further alternative embodiment of a packaging machine configured to produce the flexible, stackable container of FIG. 1 with the container being filled with the quantity of product to be stored therein on the conveyor.

FIG. 10 is a schematic illustration of an alternative embodiment of a packaging machine configured to produce the flexible, stackable container 10 of FIG. 1. The packaging machine in FIG. 10 and many of its components are generally similar to the packaging machine 100 and components of FIG. 9. However, in this embodiment, the product fill tube and funnel are separate from the forming tube and disposed along the conveyor to fill the package 12 after the sheet of film 26 is detached from the web of film. The closing station along the forming tube is configured to form the leading seal 70 of one package 12 without sealing the adjacent trailing edge 30 of the preceding package 12, and to sever the concurrent leading and trailing edges 28, 30 to separate the downstream package 12 from the web of film.

The separated packages 12 having the unsealed trailing edges 30 are transferred to the conveyor via an appropriate active or passive transfer mechanism and disposed along the timing belt or chain with the trailing edges 30 facing upwardly. As the packages 12 are moved into alignment with the lower end of the product fill tube, a specified amount of the product may be poured through the funnel into the fill tube 114 and drop into the package 12. The product-filled packages 12 move along the conveyor to a trailing seal closing station having a pair of seal bars that engage the trailing edges 30 of the packages 12 to form the trailing seal 102 and seal the packages 12. Once sealed, the packages 12 may be conveyed through folder/sealer stations and a lid final sealer station similar to those illustrated and described for the packaging machine of FIG. 9. As a further alternative, the lid application station 122 may be positioned along the conveyor for attachment of the lid fitment 14 at an appropriate location, such as upstream of sealing and folding the trailing seal 72.

Figure 11A:
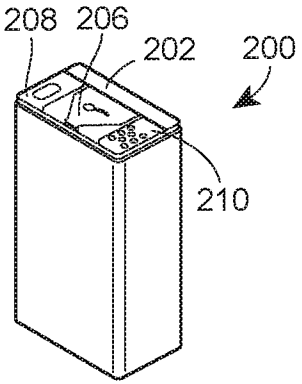
FIGS. 11*a* and 11*b* are isometric illustrations of an alternative embodiment of a flexible, stackable container and lid fitment directed to a spice can.
Figure 11B:
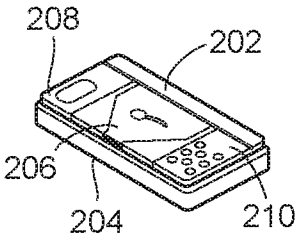

FIGS. 11*a* and 11*b* illustrate an alternate embodiment of a container 200 and lid fitment 202. The lid fitment 202 includes a base 204 that may be similar to the base 16 described above for the lid fitment 14 that may be heat sealed or otherwise attached to the corner seals 58, 60 and/or the surface of the top side 42 of the package 12 and having a central opening for access to a portion of the top surface of the top side 42. In this embodiment, however, the lid fitment 202 may include a plurality of recloseable lids similar to the recloseable lids of a pepper or spice can. For example, the lid fitment 202 may include a first lid 206 that opens to expose a fast pour or free-flowing opening, a second lid 208 that opens to expose a medium pour or large sifting area, and a third lid 210 that opens to expose a slow pour or small sifting area. Each of the lids may have a complementary shape to a portion of the base of the lid fitment to form a seal therebetween when the lid is closed down onto the base 204.

Figure 12A:
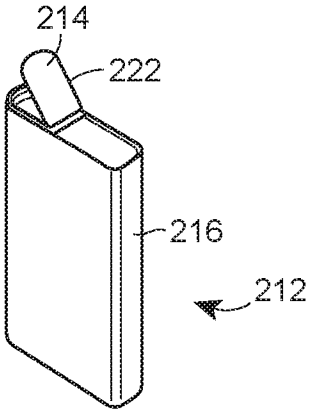
FIGS. 12*a* and 12*b* are isometric illustrations of a further alternative embodiment of a flexible, stackable container and lid fitment directed to a cereal container.
Figure 12B:
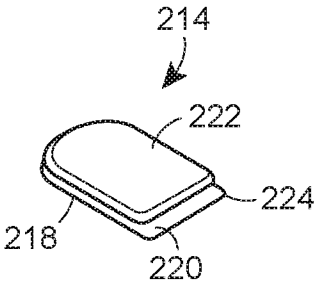

FIGS. 12*a* and 12*b* illustrate a further alternate embodiment of a container 212 and lid fitment 214 that may be particularly applicable to a container in accordance with the present disclosure configured for use as a cereal container. As shown in FIG. 12*a*, the package 216 formed by the packaging machine may be taller and wider than the previously illustrated packages, and components of the packaging machine may be configured to form such a package 216. The lid fitment 214 for the cereal container 212 may be dimensioned to be applied to only a portion of the top side of the package 216 and form a spout for pouring the cereal out of the container 212. Because the lid fitment 214 does not cover the entire top surface of the top side surrounded by the corner seals 58, 60, it may be necessary to seal the bottom surface 218 of the base 220 to the surface of the top side 42 to ensure the necessary moisture and aroma barrier is provided when the lid 222 is closed down onto the base 220 to reseal the cereal box 212. The base 220 may further include an outwardly extending flange 224 at the bottom surface 218 to ensure that a sufficient area of contact exists between the bottom surface of the lid fitment 214 and the top surface of the top side to form the necessary seal there between. In other embodiments, the lid fitment 214 for the cereal container 212 may extend across the entire width of the package 216. Such a configuration may be desirable where the cereal container 212 encloses a toy or prize, and the opening of the lid fitment 214 may be dimensioned such that a person may insert their hand into the container 212 to remove the toy or prize without pouring out the cereal or destroying the cereal container 212. It should also be noted again that the lid fitment for the container 212 or other containers in accordance with the present disclosure may be attached to faces of the package other than the top face or side depending on the product to be stored therein and the manner in which the product is to be dispensed. For example, a fitment configured as a pouring spout may be attached to a side surface of a package to facilitate pouring from a salt or liquid container.

Figure 13A:
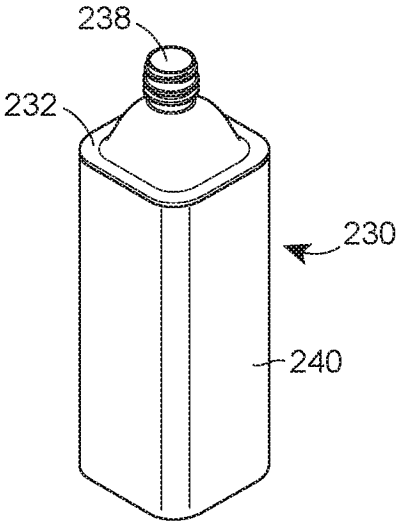
FIGS. 13*a* and 13*b* are isometric illustrations of another alternative embodiment of a flexible, stackable container and lid fitment directed to liquid container.
Figure 13B:
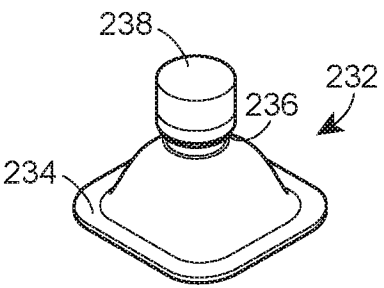

FIGS. 13*a* and 13*b* illustrate a further alternate embodiment of a container 230 and lid fitment 232 that may be particularly applicable to a container in accordance with the present disclosure configured for use as a water bottle or container for other liquids. In contrast to the lid fitments previously illustrated and described herein, the lid fitment 232 for the liquid container 230 may include a base 234 having an externally threaded neck 236, and a detachable lid or cap 238 having internal threads mating with the external threads of the neck 236 so that an appropriate seal maybe formed between the base/neck 234/236 and the cap 238 when the cap 238 is screwed onto the base 234. If necessary, an additional gasket, washer or other appropriate sealing device or tamper-evident feature may be included. The base 234 may extend outwardly toward the corner seals 58, 60 of the package 240 so that the bottom surface 50 may be sealed to the top surface of the top side of the package 240 with sufficient area of contact to form the necessary seal therebetween. Alternatively, the sides of the base 234 may be sealed to the corner seals 58, 60. The top side of the liquid container 230 may include an easy-opening feature similar to those previously discussed that may be configured to be accessible through neck 236 when the cap 238 is removed to open that package 240 and allow the liquid contained therein to be poured out. Alternatively, the packaging machine may be reconfigured to include a punch or other device for punching a hole in the top side of the package before the lid fitment 232 is sealed thereto so that the liquid may be poured out when the cap 238 is unscrewed from the neck.

Figure 14A:
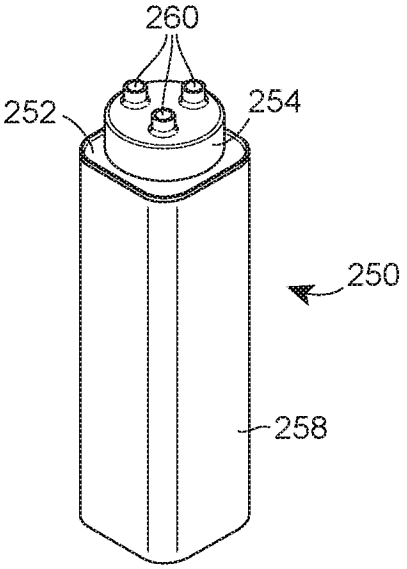
FIGS. 14*a* and 14*b* are isometric illustrations of a still further alternative embodiment of a flexible, stackable container and lid fitment directed to a condiment dispenser.
Figure 14B:
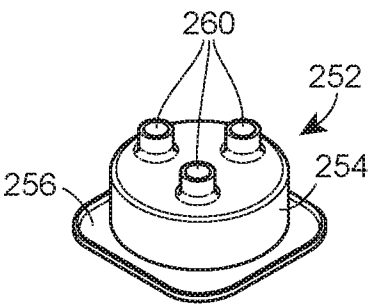

FIGS. 14*a* and 14*b* illustrate an alternate embodiment similar to the liquid container 250 of FIGS. 13*a* and 13*b* in the form of a condiment bottle 250 having a removable spout 254. As with the liquid container 230 of FIGS. 13*a* and 13*b*, the lid fitment 252 of the condiment container 250 may include a base 256 having an externally threaded neck, and a detachable cap 254 having internal threads mating with the external threads of the neck. If necessary, an additional gasket, washer or other appropriate sealing device or tamper-evident feature may be included. The base 256 may extend outwardly toward the corner seals 58, 60 of the package 258 so that the bottom surface 50 may be sealed to the top surface of the top side of the package 258 with sufficient area of contact to form the necessary seal therebetween. Alternatively, the sides of the base 256 may be sealed to the corner seals 58, 60 in a similar manner as discussed above. Three spouts 260 are shown on the cap 254, but fewer or more spouts 260 may be provided, and the spouts 260 may be spaced about the cap 254 as shown on in another desired pattern (multiple rows, concentric circles, etc.), or arranged in-line or collinearly if desired. While most of the containers discussed herein are stackable in addition to being flexible, those skilled in the art will understand that containers such as the liquid container 230 and the condiment container 250 may not necessarily be stackable on top of each other individually due to the configurations of the lid fitments 232 and 252, respectively. Such containers, however, are contemplated by the inventors as being flexible containers in accordance with the present disclosure and to be within the scope of claims directed to flexible, stackable containers unless excluded by limitations of such claims as specifically recited therein.

Figure 15A:
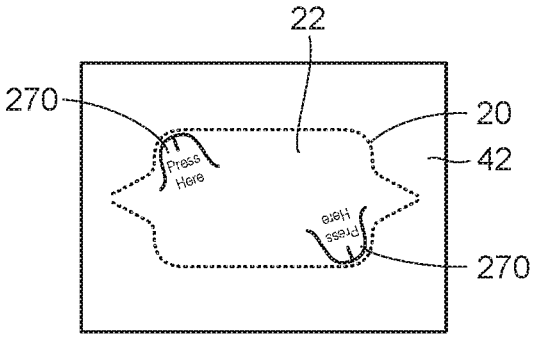
FIGS. 15*a* and 15*b* are multiple plan views of an easy-opening feature that may be implemented in the flexible, stackable container of FIG. 1.
Figure 15B:
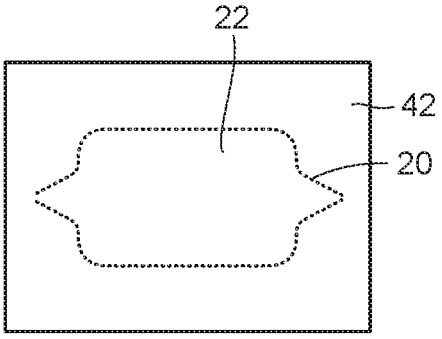

FIGS. 15*a* and 15*b* provide a graphical illustration of an embodiment of an easy-opening feature for the top side 42 of the flexible, stackable containers, such as the container 10 of FIG. 1. A series of perforations 20 to an approximate maximum depth of 50% of the thickness of the film sheet 26 are made in a manner that defines the shape of the flap 22. Indicia 270 may be visible from the outer surface of the top side 42 on the flap 22 and may indicate to a user the location at which to apply pressure to detach the flap 22 from the top side 42. A greater frequency of perforations 20, such as approximately 66.7 perforations per inch, may be provided proximate the indicia 270 to initiate the detachment of the flap 22, while a relatively lower frequency of perforations 20, such as approximately 20.4 perforations per inch, may be provided along the remainder of the line of perforations 20 defining the flap 22. When pressure is applied, the sheet of film 26 yields at the perforations 20 to breach the outer surface of the package 12 and expose the interior of the package 12. If desired, the flap 22 may be pulled outwardly for complete detachment from the package 12. Other penetration depths, shapes, spacing, etc. for the perforations 20 and flap 22 are contemplated by the inventors. For example, the depth of the perforations may be a factor of the materials and the film structure of the film sheet 26. For some films, 50% percent penetration may be adequate for detachment of the flap 22, while other films may require more or less penetration for the perforations 20.

Figure 16A:
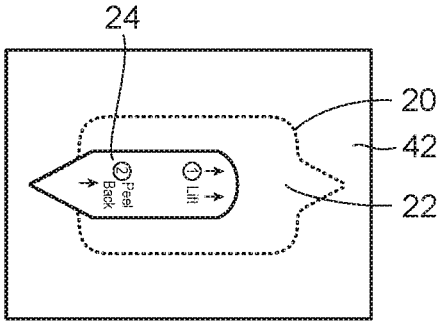
FIGS. 16*a*-16*c* are multiple plan views of an alternative embodiment of an easy-opening feature that may be implemented in the flexible, stackable container of FIG. 1.
Figure 16B:
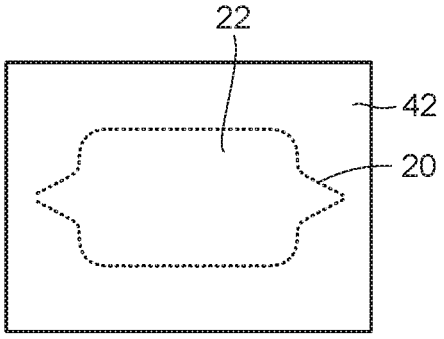
Figure 16C:
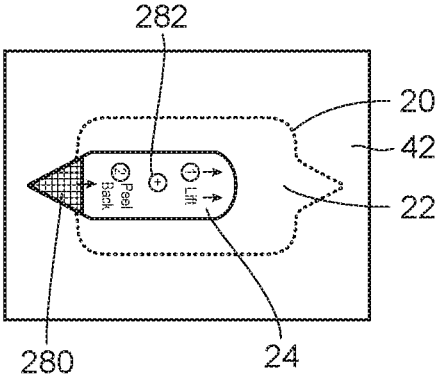

FIGS. 16*a*-16*c* illustrate an alternative embodiment of an easy-opening feature for the top side 42 of the flexible, stackable container 10 of FIG. 1. In this embodiment, the flap 22 may be defined by perforations 20 in a similar manner as in the previous embodiment. The feature may further include the pull tab 24 to be used to pull up on the flap 22 and separate the flap 22 from the sheet of film 26. The pull tab 24 may have a portion 280 welded or otherwise tightly sealed to the flap 22, and an additional tack seal area 282 that may hold the pull tab 24 against the outer surface of the sheet of film 26 as the container 10 is formed. When the lid 18 of the lid fitment 14 is opened, the pull tab 24 may be pulled to detach the flap 22. The relatively weak tack seal area 282 may detach as the pull tab 24 is pulled, but the stronger seal at the welded portion 280 may hold such that the perforations 20 defining the flap 22 yield before the weld separates to detach the flap 22 from the package 12. The frequency of perforations 20 may be adjusted accordingly to ensure that the flap 22 begins to separate from the sheet of film 26 in the desired location, such as proximate the welded portion 280 of the pull tab 24.

Figure 17A:
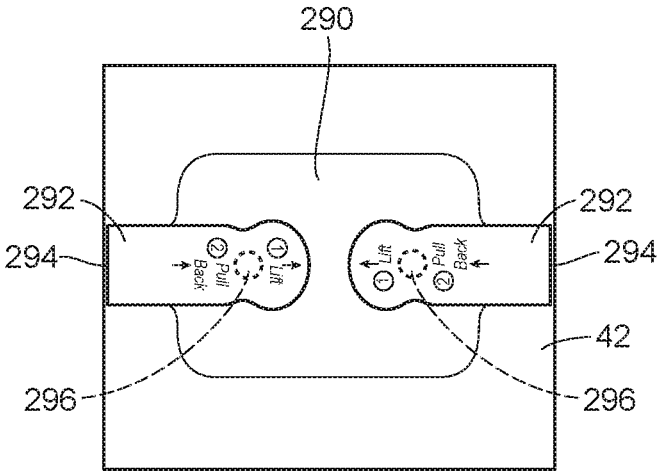
FIGS. 17*a*-17*c* are multiple plan views of a further alternative embodiment of an easy-opening feature that may be implemented in the flexible, stackable container of FIG. 1.
Figure 17B:
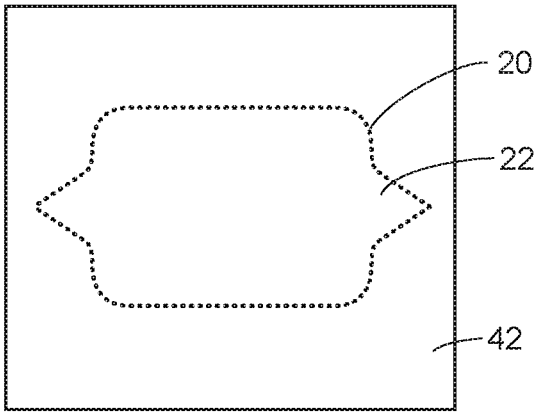
Figure 17C:
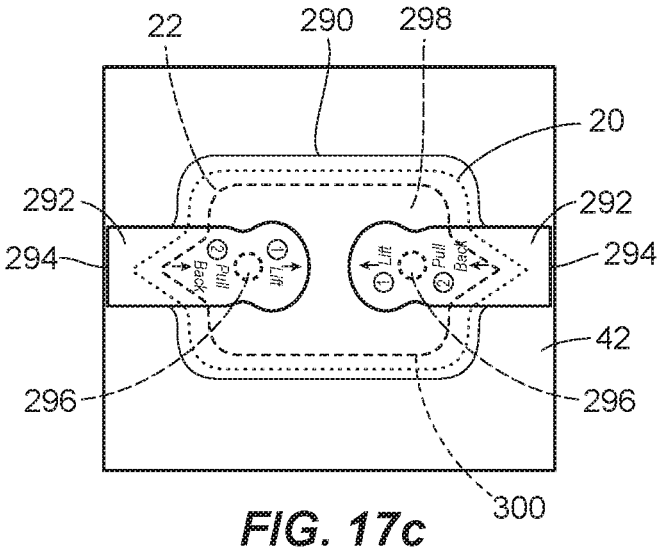

FIGS. 17*a*-17*c* graphically illustrate a further alternative embodiment of an easy-opening feature for the top side 42 of the flexible, stackable container 10 of FIG. 1. In this embodiment, the flap 22 may be defined by perforations 20 penetrating 100% through the sheet of film 26 and defining the flap 22. The feature may further include the pull tab in the form of a cover portion 290 formed from foil or another appropriate material and having a complimentary geometric shape but being larger than the flap 22 so that the cover portion 290 of the pull tab extend beyond the edges of the flap 22 with tabs 292 being folded over at folds 294 to form the graspable portions of the pull tab. Tack seal areas 296 may hold the tabs 292 to the top surface of the cover portion 290 as the container 10 is being formed. The area 298 of the cover portion 290 overlying the flap 22 may be secured thereto with a lock-up seal that will not detach when the flap 22 is pulled free of the sheet of film 26. The lock-up seal area 298 may extend to the perforations 20, or may be disposed inwardly from the perimeter of the flap 22. The portions of the pull tab 24 extending beyond the lock-up seal area 298 may be attached to the outer surface of the top side 42 to form a peelable seal area 300, such as that formed by a pressure sensitive adhesive or other similar coating. When the pull tab is initially attached to the top side 42, the cover portion 290 completely overlies the flap 22 with the peelable seal area 300 serving to seal the package 12 despite the full penetration of the perforations 20. Moreover, the cover portion 290 covers the perforations 20 to prevent the perforations 20 and air or liquids that may be able to pass there through from affecting the barrier properties of the film sheet 26. After the pull tab is pulled to separate the flap 22 from the sheet of film 26, the flap 22 and cover portion 290 may be pressed back down onto the top side 42 such that the peelable seal is reformed around the opening created by the detachment of the flap 22 to re-seal the package 12 and provide a level of barrier protection for the product stored therein. However, the seal may be configured to detach when the pull tab 24 is pulled open, but not reform a seal when the cover portion 290 is pressed back down, such as where the cover portion 290 is heat sealed to the top side 42 of the sheet of film 26.

Figure 18A:
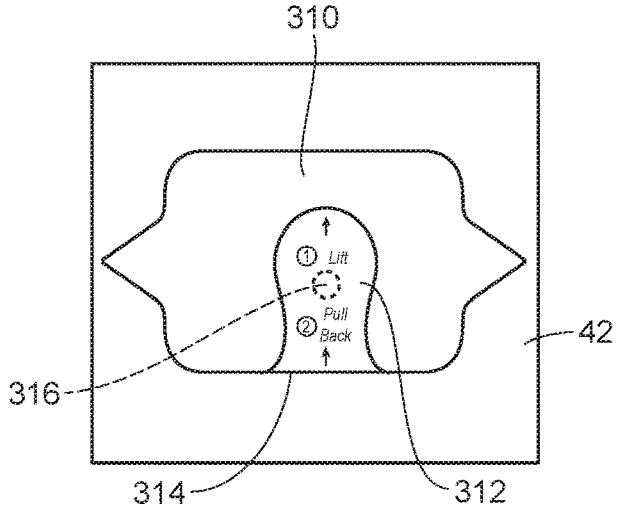
FIGS. 18*a*-18*c* are multiple plan views of another alternative embodiment of an easy-opening feature that may be implemented in the flexible, stackable container of FIG. 1.
Figure 18B:
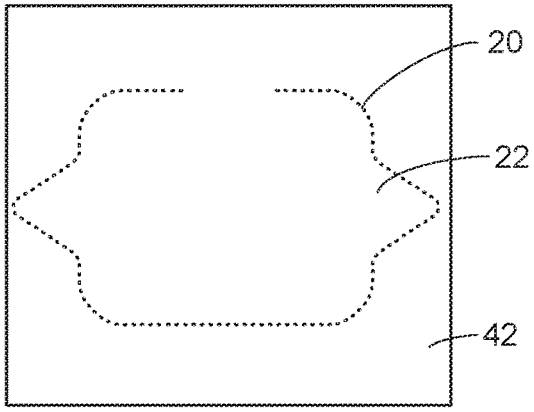
Figure 18C:
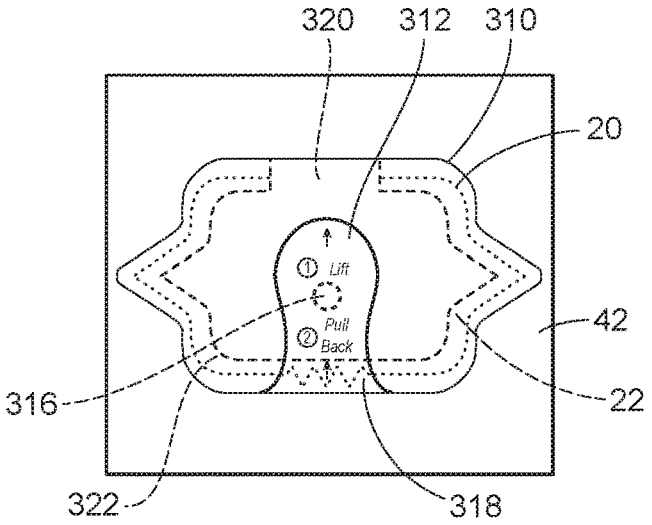

FIGS. 18*a*-18*c* graphically illustrate another alternative embodiment of an easy-opening feature for the top side 42 of the flexible, stackable container 10 of FIG. 1. The easy-opening feature includes the flap 22 and a cover portion 310 of a pull tab in similar configurations as in FIGS. 17*a*-17*c*, but configured so the flap does not completely detach from the film sheet 26 during normal use. The perforations 20 may extend most of the way but not entirely around the entire periphery of the flap 22. The cover portion 310 also includes a single tab 312 folded back over a fold 314 and held down by a tack seal area 316. The tab 312 may be disposed opposite the side of the flap 22 that is not perforated. The perforations 20 may also be provided at the peel tab area in a zig-zag configuration 318 to create a point of weakness at which the tearing or peeling of the flap 22 will be initiated. Of course, other configurations of the perforations 20 may be used to create the point of weakness, such as larger and/or deeper perforations, and other geometric configurations of perforations 20, including configurations having a higher density of perforations 20 at the pull tab area. The cover portion 310 further includes a lock-up seal area 320 attached to the flap 22 within the area defined by the perforations, and a peelable seal area 322 extending beyond the flap 22. When the tab 312 is pulled, the flap 22 does not completely detach from the sheet of film 26 and the flap 22 and cover portion 310 are not completely removed from the package 12. Configured in this way, the flap 22 and cover portion 310 are properly aligned with the opening in the top side 42 of the package 12 when they are replaced over the opening to reclose and seal the package 12.

Figure 19A:
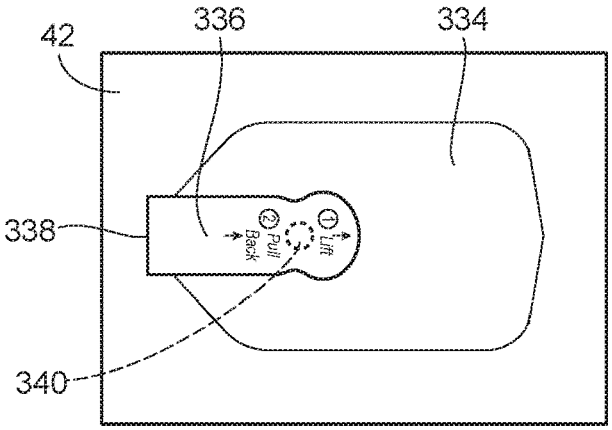
FIGS. 19*a*-19*c* are multiple plan views of a still further alternative embodiment of an easy-opening feature that may be implemented in the flexible, stackable container of FIG. 1.
Figure 19B:
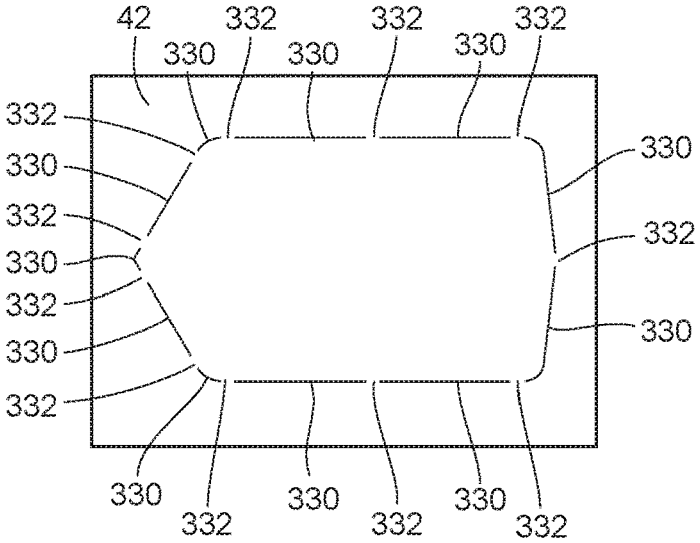
Figure 19C:
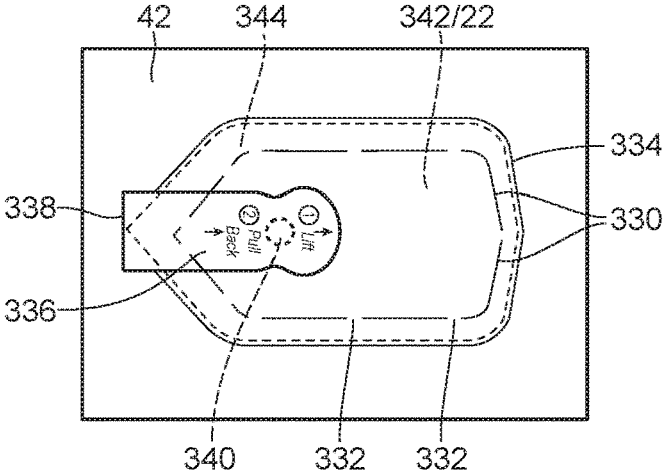

FIGS. 19*a*-19*c* graphically illustrate a still further alternative embodiment of an easy-opening feature for the top side 42 of the flexible, stackable container 10 of FIG. 1. In this embodiment, the flap 22 may be defined by a line of reduced strength formed by a series of alternating score lines 330 and interruptions in the scoring or bridges 332. The score lines 330 may have full penetration through the film sheet 26, while the bridges 332 are areas of no penetration, or of partial penetration but less than 100% penetration such that the bridges 332 maintain the attachment of the flap 22. The length of the score lines between the bridges may range from 0.1" to 2.0", and the length of the bridges may fall within the range of 0.002" to 0.090" depending on the implementation. The pull tab may be similar to that shown in FIGS. 17*a*-17*c*, and include a cover portion 334 overlying the flap 22, and with a single tab 336 folded back over a fold 338 and held down by a tack seal area 340. A lock-up seal area 342 of the cover portion 334 is attached to the film sheet 26 at the flap 22, and may extend to the score lines 330 as shown, or may be disposed inwardly from the perimeter of the flap 22. A peelable seal area 344 extends beyond the lock-up seal area 342 and may be attached to the outer surface of the top side 42 with a pressure sensitive adhesive or other similar coating. When the pull tab is initially attached to the top side 42, the cover portion 334 completely overlies the flap 22 with the peelable seal area 344 serving to seal the package 12 despite the full penetration of the score lines 330. The tab 336 is pulled away from the top side 42 of the package 12 to detach the flap 22 at the bridges 332 for removal of the flap 22 and cover portion 334. If desired, the flap 22 and cover portion 334 may be pressed back down onto the top side 42 such that the peelable seal is reformed around the opening created by the detachment of the flap 22 to re-seal the package 12. Depending on the adhesive being used, the configurations of the score lines and the bridges and the properties of the film sheet 26, the same adhesive or same type of seal may be used in both the lock-up seal area 342 and the peelable seal area 344 if the strength of the adhesive is sufficient to detach the flap 22 at the bridges without the cover portion 334 separating from the flap 22.

Figure 20A:
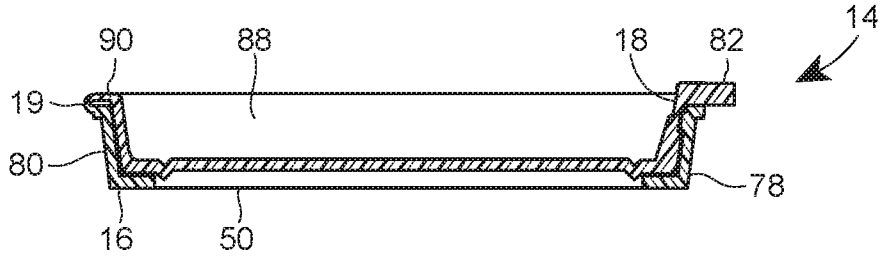
FIGS. 20*a*-20*c* are cross-sectional views of embodiments of the lid fitment of FIG. 2 taken through line 20-20.

As discussed previously, containers in accordance with the present disclosure such as those described herein may be stacked efficiently side-by-side in shipping cartons and on display shelves, and may be stacked vertically on top of each other. To facilitate vertical stacking, the bottom sides of the packages and the top surfaces of the lid fitments may be configured with complimentary shapes fostering stability in stacking the containers. Referring to FIG. 20*a*, the embodiment of the lid fitment 14 of FIG. 2 is shown in cross-section. The lid 18 and the base 16 of the lid fitment 14 have complimentary generally concave shapes so that the lid 18 nests within the base 16 and forms the necessary seal for the container 10. The lid 18 has an outer wall 88 extending around the lid 18 and having an upper edge 90 upon which the bottom side 44 of a container 10 stacked thereupon will rest. For the container 10 of FIGS. 2-8, the corner seals 62, 64 of the package 12 are aligned with the upper edge 90 of the lid 18. If necessary, the lid 18 may include an additional rim 92 extending upwardly from the upper edge 90 of the outer wall 88 and having its outer edge disposed inwardly from the outer edge of the outer wall 88 such that the corners seals 62, 64 slide over the rim. In some embodiments, the rim 92 may be disposed approximately one-eighth inch inwardly from the outer edge of the outer wall 88, and may extend approximately one-eighth inch upwardly from the upper edge 90 of the outer wall 88. The engagement between the rim and the corner seals 62, 64 may prevent relative horizontal movement between the stacked containers 10 that may cause instability of the stack.

Figure 20B:
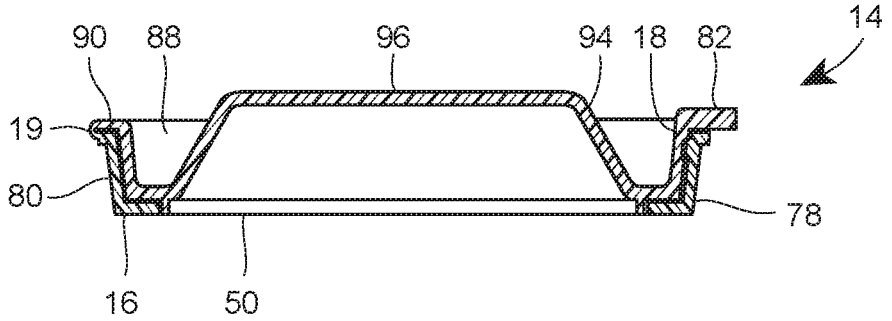

FIG. 20*b* illustrates an alternative embodiment of the lid fitment 14 that may further promote stable stacking of the containers 10 having corner seals 62, 64. Depending on the density of the product stored in the package 12, the bottom side 44 of the package 12 may tend to sag under the weight of the product because the bottom side 44 is normally disposed above the bottom edges of the corner seals 62, 64. To provide additional support for the bottom sides 44 when the containers 10 are stacked, the lid 18 may have an upwardly extending central raised portion 94 with a top surface 96 that is higher than the upper edge 90 of the outer wall 88. The vertical distance between the top surface 96 and the upper edge 90 may typically be less than or equal to the height of the corner seals 62, 64. Consequently, in some implementations the top surface 96 may be in the range of 1/16" to 1/4" above the upper edge 90. When one container 10 is stacked on another, the bottom side 44 of the upper container 10 may sag, but the central portion 94 of the lid 18 of the lower container 10 will prevent the bottom side 44 from sagging below the bottom edges of the corner seals 62, 64.

Figure 20C:
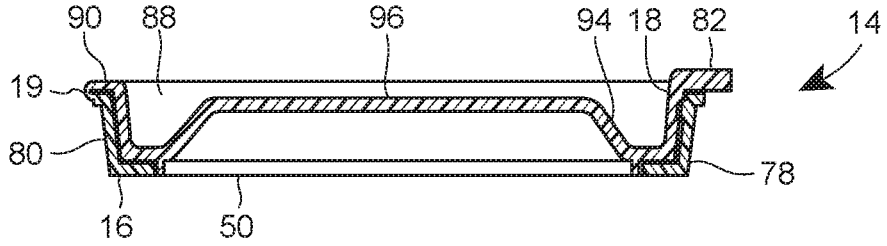

The bottom side 44 of the container 10 may also sag when stacked on the lid 19 of the lid fitment 14 of FIG. 20*a* where the corner seals 62, 64 are not present. Consequently, additional support for the bottom side 44 may also be necessary. FIG. 20*c* illustrates a further alternative embodiment of the lid fitment 14 wherein the top surface 96 of the central portion 94 of the lid 18 is raised. However, in this embodiment the top surface 96 is disposed lower than the upper edge 90 of the outer wall 88 to allow an acceptable amount of sagging of the bottom side 44 to occur. Similar to the embodiment of FIG. 20*b*, the top surface 96 may be in the range of 1/16" to 1/4" below the upper edge 90 in some implementations. When one container 10 is stacked on another, the bottom side 44 of the upper container 10 may sag, but the central portion 94 of the lid 18 of the lower container 10 will prevent excessive sagging of the bottom side 44. Other configurations of support structures of the lids 18 for providing additional support of a container 10 stacked thereon will be apparent to those skilled in the art and are contemplated by the inventors as having use with containers 10 in accordance with the present disclosure.

Figure 21:
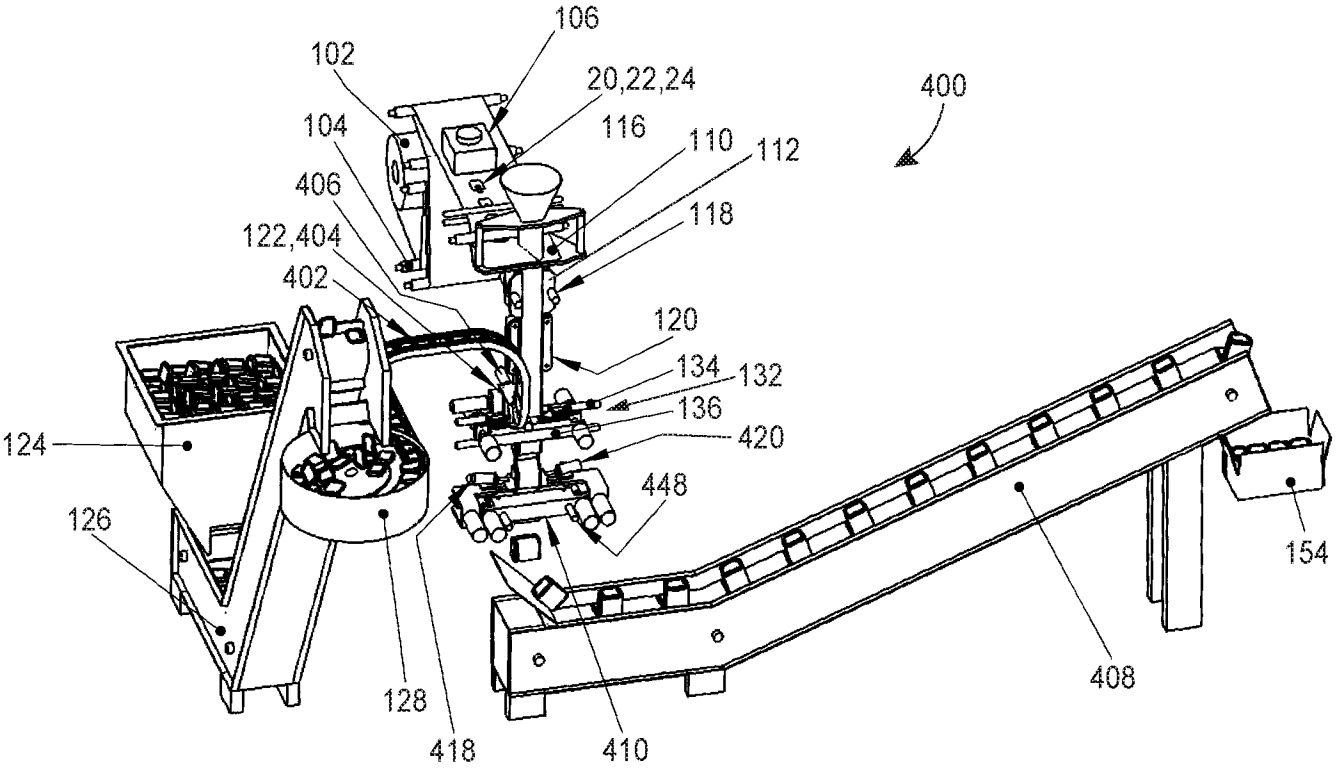
FIG. 21 is a schematic illustration of an alternative embodiment of a packaging machine configured to produce the flexible, stackable container of FIG. 1.

FIG. 21 schematically illustrates an alternative embodiment of a packaging machine 400 configured to form the container 10. For consistency, similar components of the packaging machine 100 of FIG. 9 are identified herein by the same reference numerals and where appropriate redundant description of similar components is omitted. The processing within the packaging machine 400 may begin in a similar manner as the package machine 100 with the web of film being fed from the film roll 102 to the forming station 108 and wrapped around the forming tube 112. The pre-processing station 106 as shown may apply an easy-open feature to the film in the form of the perforations 20 defining the flap 22, and with the complementary pull tab 24. Once wrapped around the forming tube 112, the film is pulled through to the seal station 118 by the pull belts 120 so that the corner seals 58-64 may be formed at the corners 52-56. Alternatively, pre-processed film may be provided on the film roll 102, or pre-processing, such as the application of easy-opening features, may be omitted from the process.

The lid fitments 14 may then be applied to the packages 12 at the lid application station 122 as previously described. In the present embodiment, a lid feed conveyor 402 may be configured to deliver the lid fitments 14 to a mandrel 404 of lid application station 122 through a route that allows the forming tube 112 to be shortened, and thereby making the packaging machine 400 more compact, which may be advantageous when packaging fragile products by reducing the drop height within the product fill tube 114. The lid feed conveyer 402 may approach the top side 42 of the package 12 from a position offset from the forming tube 112, turns downwardly and then turns toward the lid application station 122 from the side. When a lid fitment 14 arrives at the station 122, the lid mandrel 404 positions the lid fitment 14 against the outer surface of the top side 42 of the package 12, and a lid adhering bar 406 engages the package 12 and/or the lid fitment 14 to form the seal(s) therebetween. With the lid fitment 14 attached to the package 12, the seal bars 136 at the closing station 132 seal the leading edge 28 of the current package 12 and the trailing edge 30 of the preceding package 12 to form the leading and trailing seals 70, 72. The product may then be deposited into the package 12 through the funnel 116 and fill tube 114, after which the package 12 is advanced and the trailing edge 30 is sealed by the seal bars 136 to form the trailing seal 72. As discussed above, the closing station 132 may include a lifting mechanism to engage and lift the downstream package 12 sufficiently to relieve some or all of the tension in the film created by the weight of the product in the packages 12 such that the seals 70, 72 are properly formed.

In contrast to the packaging machine 100, the formation of the container 10 is completed before the container 10 is separated from the web of film and deposited on a take away conveyor 408 for transit to a location for storage, packaging, shipping or other further processing. The formation is completed at a separation and flap sealing station 410. After the package 12 is filled and sealed at the closing station 132, the joined packages 12 move along the transport path to the station 410. At the station 410, the film is cut between the seals 70, 72 of the adjoining packages 12, and the separated seals 70, 72 are folded over and sealed to the outer surfaces of the packages 12 as was performed at the folder/sealer stations 142, 146 of the packaging machine 100.

Because the packages 12 are still attached and hanging from the forming tube 112, product in the upper package 12 can be disposed in the loose portion of the film above the leading seal 70 and below the lateral side 84 of the lid fitment 14 if the leading seal 70 does not extend upwardly to the lateral side 84. In some implementations, in particular for dense products, the presence of the product in the loose portion of the film may create difficulty in folding the leading seal 70 over and into contact with the outer surface of the package 12. Interference by the product may be minimized by ensuring that a seal is formed proximate the lateral side 84 of the lid fitment 14 to prevent to retain the product within the portion of the package 12 defined by the lid fitment 14. For example, the seal bars 136 at the closing station 132 may be widened upwardly such that the leading seal 70 extends upwardly to the lateral side 84 of the lid fitment 14. Alternatively, an additional set of sealing bars may be provided that form a seal parallel to the leading seal 70 at the lateral side 84 of the lid fitment 14 when the leading seal 70 is formed. By forming the seal proximate the lateral side 84 of the lid fitment 14, the product will not drop below the lateral side 84 of the lid fitment 14 when poured into the package 12 through the fill tube 112, and consequently will not interfere with the folding and tacking of the leading seal 70.

Figure 22:
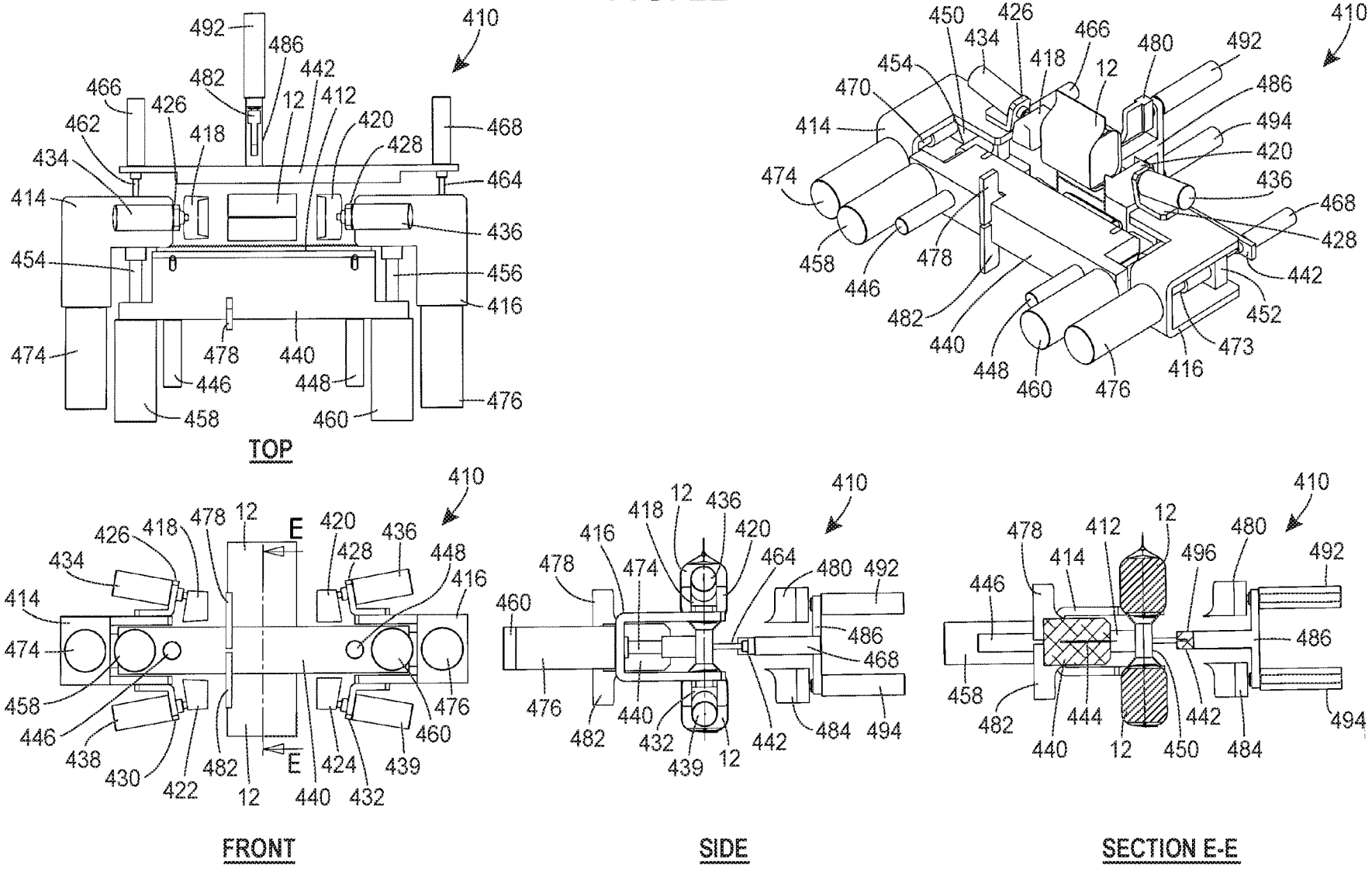
FIG. 22 is perspective, top, front, side and section views of the separation and flap sealing station of FIG. 21 in an open configuration with the knife blade extended.

FIGS. 22-26 illustrate an embodiment of the separation and flap seal station 410. Referring to FIG. 22, the station 410 is shown in the open position and with a knife blade 412 extended for the sake of illustration. The station 410 is configured to hold both packages 12 in place as the seals 70, 72 are cut, folded and sealed to the outer surfaces of the packages 12. The components of the station 410 are mounted to support brackets 414, 416 that are in turn mounted to the housing or other support structure of the packaging machine 400. To secure the packages 12 during the operation of the station 410, upper mandrels 418, 420 and lower mandrels 422, 424 may be mounted to the support brackets 414, 416 by mandrel brackets 426-432 along with mandrel actuators 434-439 that are selectively actuated to extend and retract the mandrels 418-424. The mandrels 418, 422 correspond to the top sides 42 and lid fitments 14 of the packages 12, and may be configured to conform to the inner surfaces of the lid fitments 14 to properly align the packages 12 within the station 410. The mandrels 420, 424 correspond to the bottom sides 44 of the packages 12 and are configured to be received within the corner seals 62, 64.

The packages 12 are separated, folded and sealed by the choreographed movements of the knife blade 412 and engagement bars 440, 442. The knife blade 412 is disposed and slidable within a slot 444 of the engagement bar 440, and may be extended and retracted in the slot 444 by knife actuators 446, 448. The engagement bar 440 is coupled to folding control plates 450, 452 via shafts 454, 456 and actuators 458, 460. The shafts 454, 456 are slidable within the actuators 458, 460 to move the engagement bar 440 toward and away from the plates 450, 452 and knife engagement bar 442. The knife engagement bar 442 is similarly mounted to the plates 450, 452 by shafts 462, 464 and actuators 466, 468 to move the bar 442 toward and away from the plates 450, 452. The folding control plates 450, 452 are mounted to the brackets 414, 416 by shafts 470, 472 and actuators 474, 476 such that the actuators 474, 476 extend and retract the shafts 470, 472 to move the plates 450, 452 and the engagement bars 440, 442 laterally with respect to the brackets 414, 416 and packages 12 as described more fully below.

Depending on the configuration of the particular container 10, it may be necessary to shape the seals 70, 72 and loose portions of the film to conform to the shape of the lid fitment 14. To further assist in the final shaping of the containers 10 during the folding and sealing operations, contour seal bars 478-484 may be provided to engage the outer surface of the package 12 proximate the lid fitment 14. Front contoured seal bars 478, 482 extend from the engagement bar 440 and engage the outer surfaces of the packages 12 when the actuators 474, 476 extend the plates 450, 452 and engagement bars 440, 442 rightward to fold the seals 70, 72 as shown in the side views of FIG. 26. The back contoured seal bars 480, 484 are mounted to the engagement bar 442 by a bracket 486 and are moveable relative to the engagement bar 442 via shafts 488, 490 and actuators 492, 494 as described below.

Figure 23:
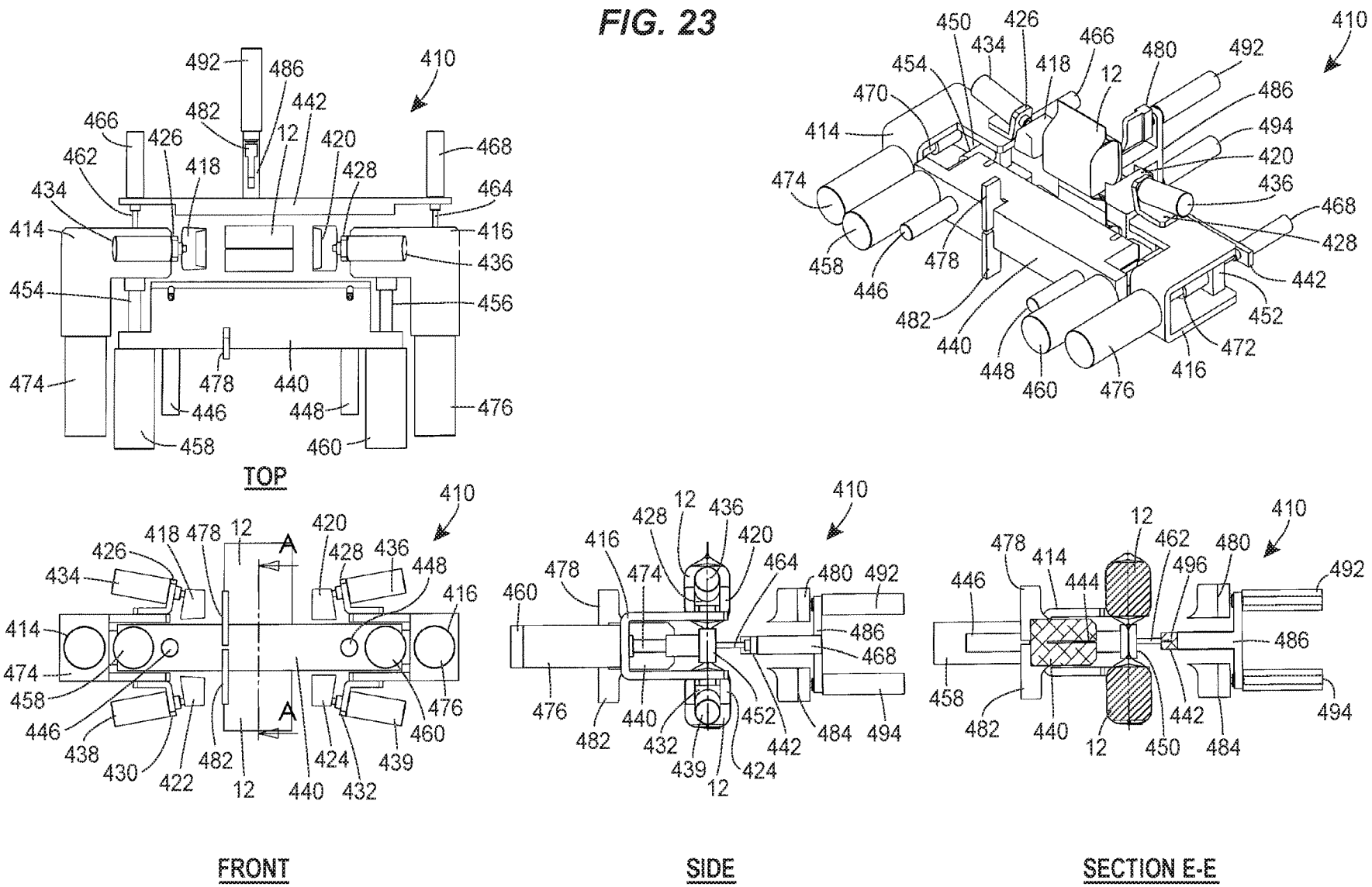
FIG. 23 is perspective, top, front, side and section views of the separation and flap sealing station of FIG. 21 in an open configuration with the knife blade retracted.

The operation of the separation and flap sealing station 410 will now be described with reference to FIGS. 23-26. Referring to FIG. 23, the station 410 is shown in a normal open position to allow for operation of the pull belts 120 to advance the next package 12. The shafts 454, 456, 462, 464 are extended by the actuators 458, 460, 466, 468 to separate the engagement bars 440, 442, and knife blade 412 is retracted within the slot 444 of the engagement bar 440 by the actuators 446, 448. With the engagement bars 440, 442 apart, the lowermost container 10 may be lowered between the bars 440, 442 until the seals 70, 72 of the two lowermost packages 12 are aligned with the slot 444 of the engagement bar 440 and a corresponding slot 496 of the engagement bar 442. The packages 12 are oriented with the lid fitments 14 facing the mandrels 418, 422.

Figure 24:
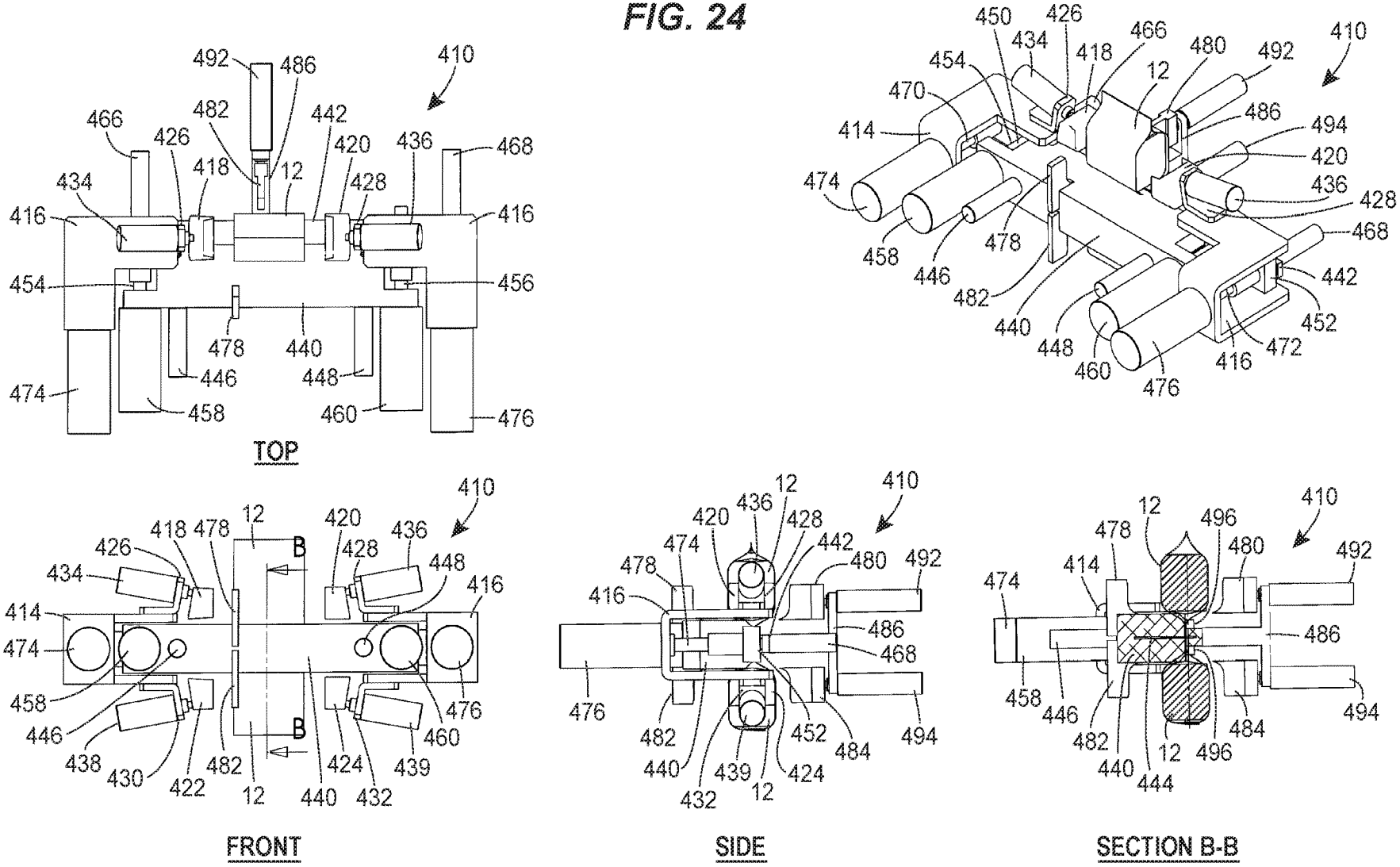
FIG. 24 is perspective, top, front, side and section views of the separation and flap sealing station of FIG. 21 with the engagement bars closed.
Figure 25:
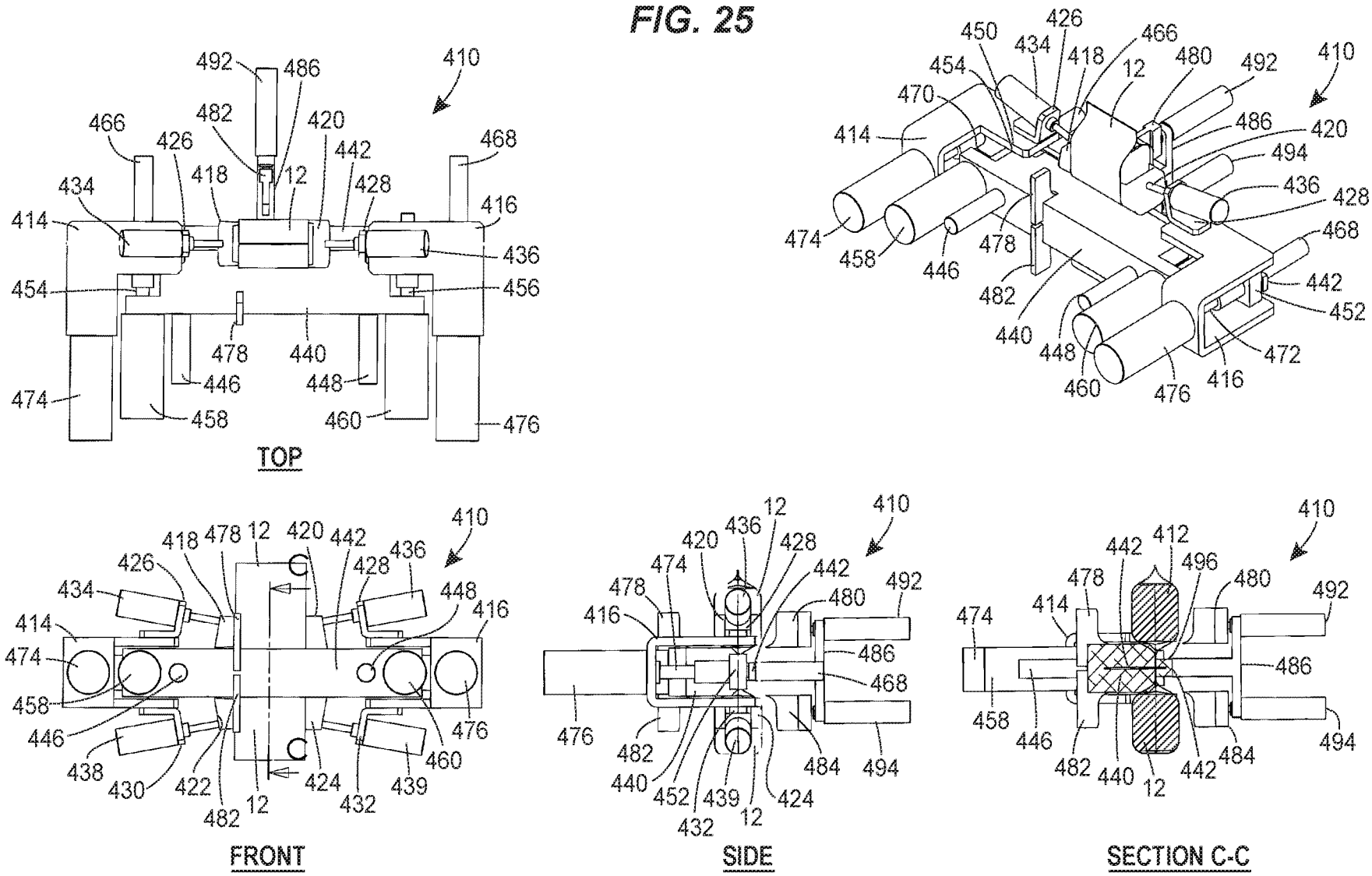
FIG. 25 is perspective, top, front, side and section views of the separation and flap sealing station of FIG. 21 with the engagement bars closed and the mandrels extended.

Once the packages 12 are disposed within the station 410, the engagement bars 440, 442 are moved together into contact with the seals 70, 72 of the packages 12 as shown in FIG. 24. Actuators 458, 460, 466, 468 operate to retract the shafts 454, 456, 462, 464 and move the engagement bars 440, 442 toward the folding control plates 450, 452. Eventually, the bars 440, 442 meet and engage the seals 70, 72. As the engagement bars 440, 442 are closed, or after the bars 440, 442 are closed as shown in FIG. 25, the mandrels 418-424 are extended by the actuators 434-439 to engage the top and bottom sides 42, 44 of the packages 12. As discussed above, the mandrels 418, 422 are configured to mate with the lid fitments 14 to align the packages 12 within the station 410. With the packages 12 aligned and supported by the mandrels 418-424, the actuators 446, 448 may operate to extend the knife blade 412 through the slot 444 and intersection of the seals 70, 72, and into the slot 496 of the engagement bar 442. The engagement of the lower package 12 by the bars 440, 442 and the mandrels 422, 424 prevent the package 12 from dropping onto the takeaway conveyor 408 after separation and prior to folding and sealing of the trailing seal 72.

Figure 26:
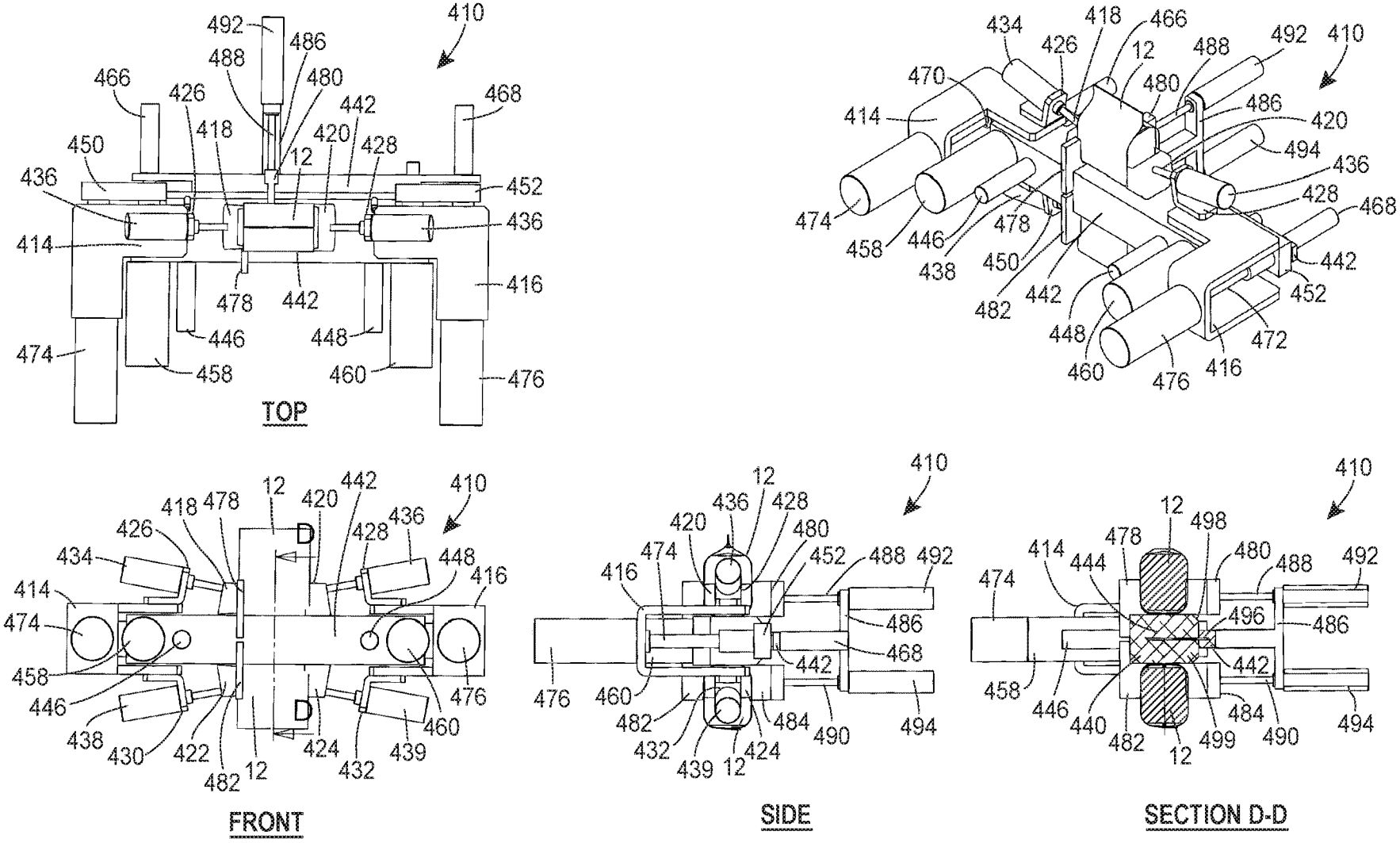
FIG. 26 is perspective, top, front, side and section views of the separation and flap sealing station of FIG. 21 with the engagement bars extended to fold and tack the edge seals.

After separation from each other, the seals 70, 72 of the adjacent packages 12 may be folded over and sealed to the outer surfaces of the packages 12. The seals 70, 72 and loose portions of the film are folded over by operating the actuators 474, 476 to extend the shafts 470, 472 and move the engagement bars 440, 442 relative to the packages 12 via the folding control plates 450, 452 as shown in FIG. 26. If necessary, the actuators 458, 460, 466, 468 may act to partially or fully separate the engagement bars 440, 442 and allow the seals 70, 72 to fold over. The leading edge of the engagement bar 442 is configured with upper and lower shoulders or chamfers 498, 499 to facilitate folding of the seals 70, 72 without tearing the film. Once folded, the seals 70, 72 may be tacked to the outer surfaces of the packages 12 using any appropriate fastening process, such as those described above. For example, the engagement bar 440 may be heated to heat seal the seals 70, 72 to the packages 12 as they are folded. The heat sealing may be facilitated by applying an appropriate coating to the film, or by using a film that self-seals under heat. As a further alternative, an adhesive applicator may be added to the station 410 to apply an adhesive that will tack the seals 70, 72 to the packages 12.

In addition to tacking the seals 70, 72, the corner seals 58, 60 may be sealed to the lateral sides 84, 86 of the lid fitments 14. As the engagement bar 440 moves rightward, the contoured seal bars 478, 482 engage the corner seals 58 and press the corner seals 58 against the lid fitments 14. At the same time, the actuators 492, 494 operate to extend the contoured seal bars 480, 484 into engagement with corner seals 60 and press the corner seals 60 against the lid fitments 14. The seal bars 478-484 may be configured in a similar manner as the lid adhering bar 406 at the lid application station 122 to complete the seal between the lid fitments 14 and the corner seals 58, 60. Once the seals 70, 72 are tacked and the corner seals 58, 60 are sealed to the lid fitments 14, the actuators 458, 460, 466, 468, 474, 476, 492, 494 may be operated to return the engagement bars 440, 442, control plates 450, 452 and seal bars 480, 484 to their normal open positions. The mandrels 418-424 may then be opened to release the containers 10 and allow the detached lower container 10 to drop onto the takeaway conveyor 408, and to permit the film to be advanced for separation and completion of the next container 10.

Figure 27:
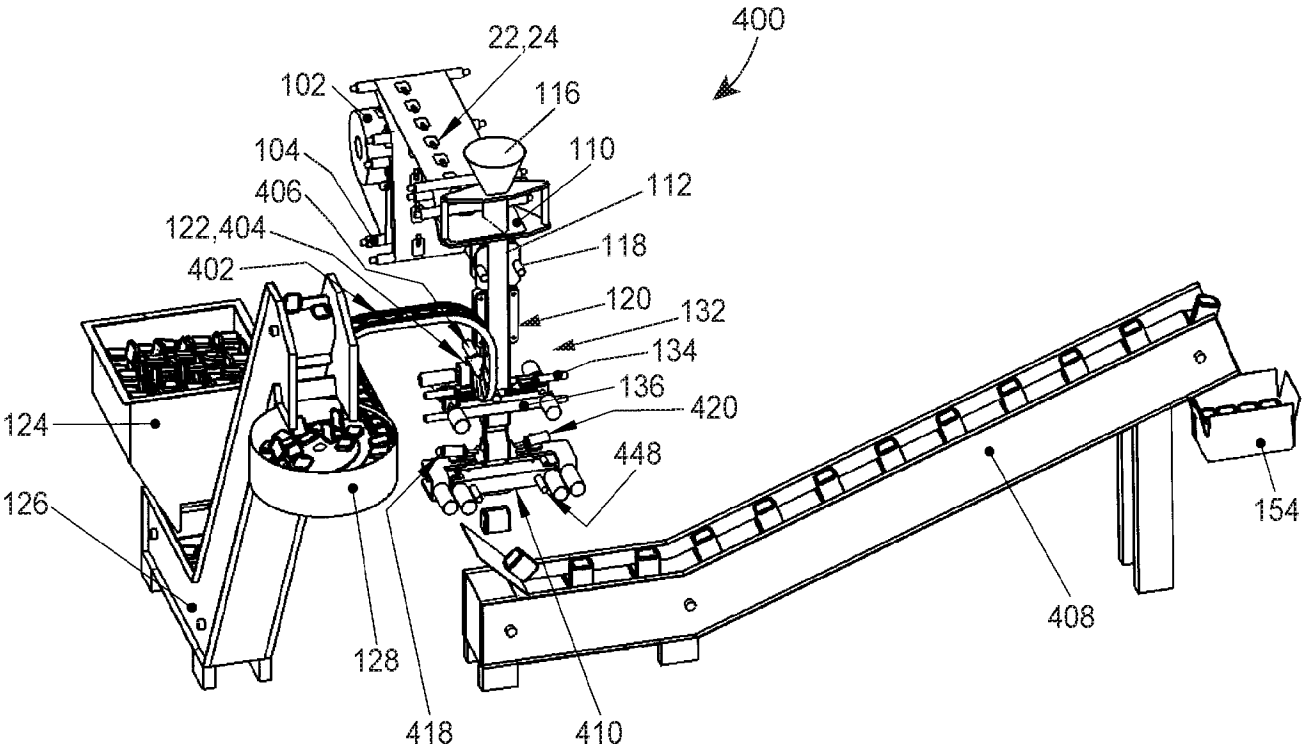
FIGS. 27 and 28 are schematic illustrations of alternative embodiments of the packaging machine of FIG. 21.

FIG. 27 is a schematic illustration of an alternative embodiment of the packaging machine 400 of FIG. 21 wherein the easy-opening feature, such as the flap 22 and corresponding tab 24, are applied to the web of film in the appropriate locations as the web of film is formed and accumulated on the film roll 102, and the pre-processing station 106 for applying the easy-opening feature to the web of film is omitted from the packaging machine.

Figure 28:
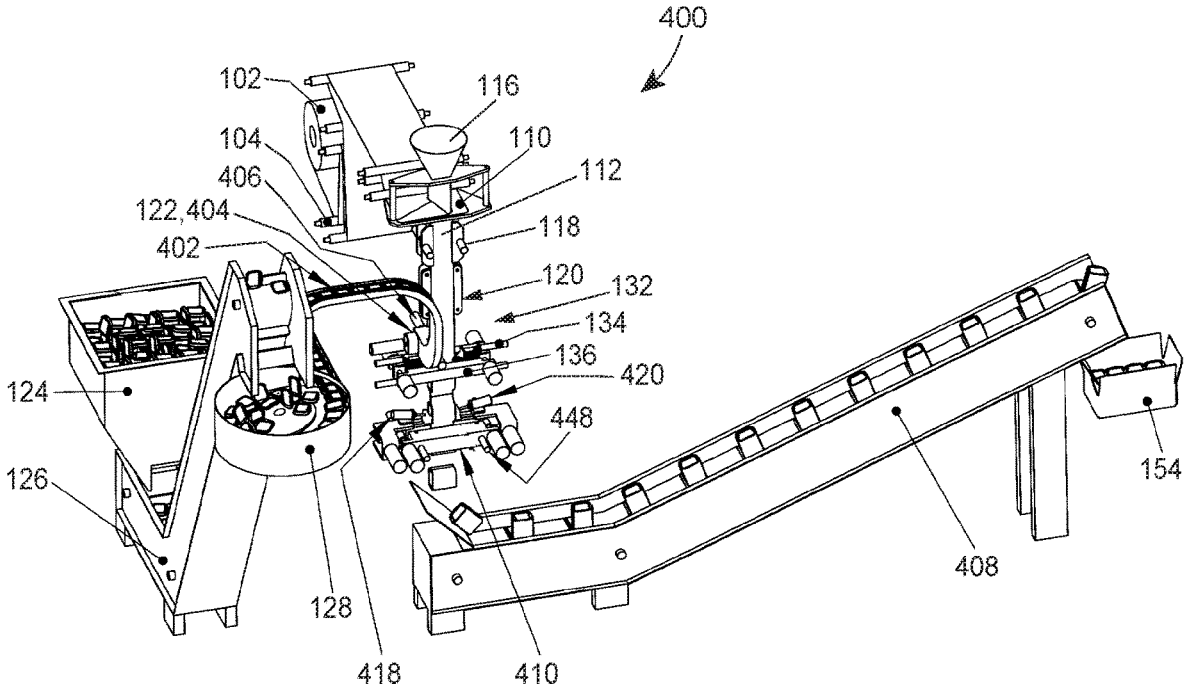

FIG. 28 is a schematic illustration of a further alternative embodiment of the packaging machine 400 of FIG. 21 wherein the easy-opening feature is omitted from the container 10 and the pre-processing station 106 for applying the easy-opening feature to the web of film is correspondingly omitted from the packaging machine.

Figure 29:
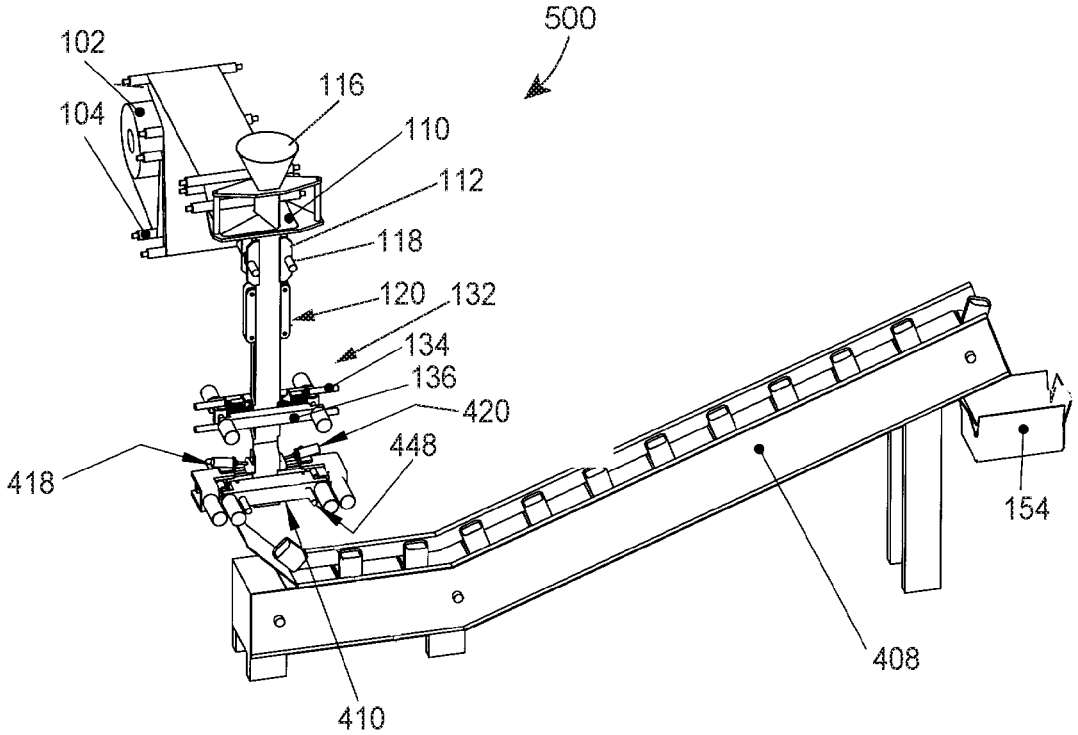
FIGS. 29-31 are schematic illustrations of alternative embodiments of packaging machines configured to produce the flexible, stackable container of FIG. 1 without attaching a lid fitment.

FIG. 29 is a schematic illustration of an embodiment of a packaging machine 500 configured to produce the package 12 of the flexible, stackable container 10 of FIG. 1 without attaching the lid fitment 14 and without applying an easy-opening feature 20, 22, 24 to the top side 42 of the package 12. The packages 12 formed by the packaging machine 500 of FIG. 29 may be transferred to additional equipment configured to attach the lid fitment 14 to the top side 42 of the package 12 and/or to apply an easy-opening feature, such as the flap 22 and corresponding tab 24, to the top side 42 of the package 12 if desired.

Figure 30:
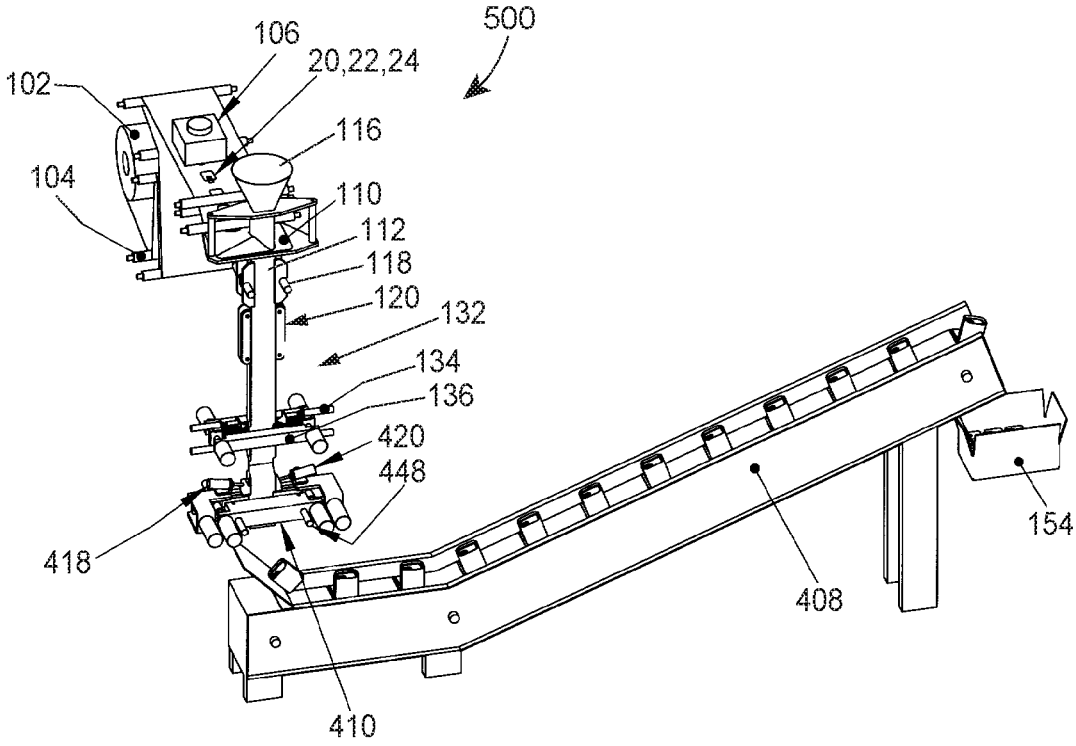

FIG. 30 is a schematic illustration of an embodiment of the packaging machine 500 configured to apply an easy-opening feature, such as the flap 22 and corresponding tab 24, to the web of film at a pre-processing station 106 and to produce the package 12 of the flexible, stackable container 10 of FIG. 1 without attaching the lid fitment 14. The packages 12 formed by the packaging machine 500 of FIG. 30 may be transferred to additional equipment configured to attach the lid fitment 14 to the top side 42 of the package 12 if desired.

Figure 31:
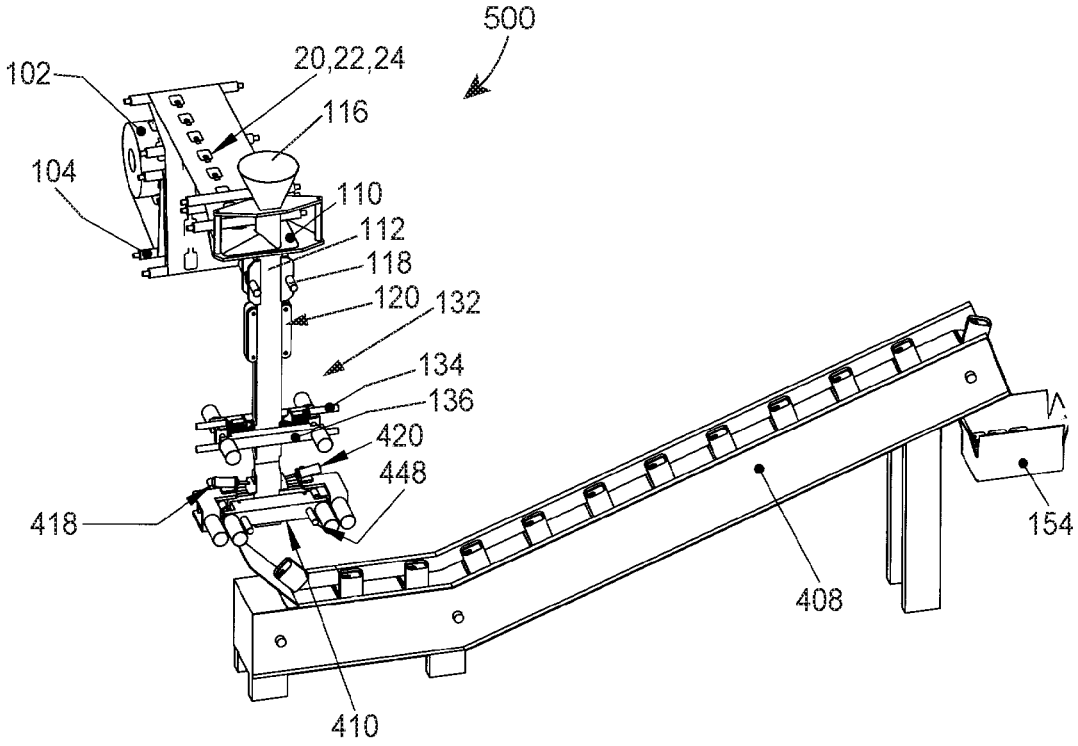

FIG. 31 is a schematic illustration of an embodiment of the packaging machine 500 configured to produce the package 12 of the flexible, stackable container 10 of FIG. 1 from a web of film having a pre-applied easy-opening feature, such as the flap 22 and corresponding tab 24, without attaching the lid fitment 14. The packages 12 formed by the packaging machine 500 of FIG. 31 may be transferred to additional equipment configured to attach the lid fitment 14 to the top side 42 of the package 12 if desired.

Figure 32:
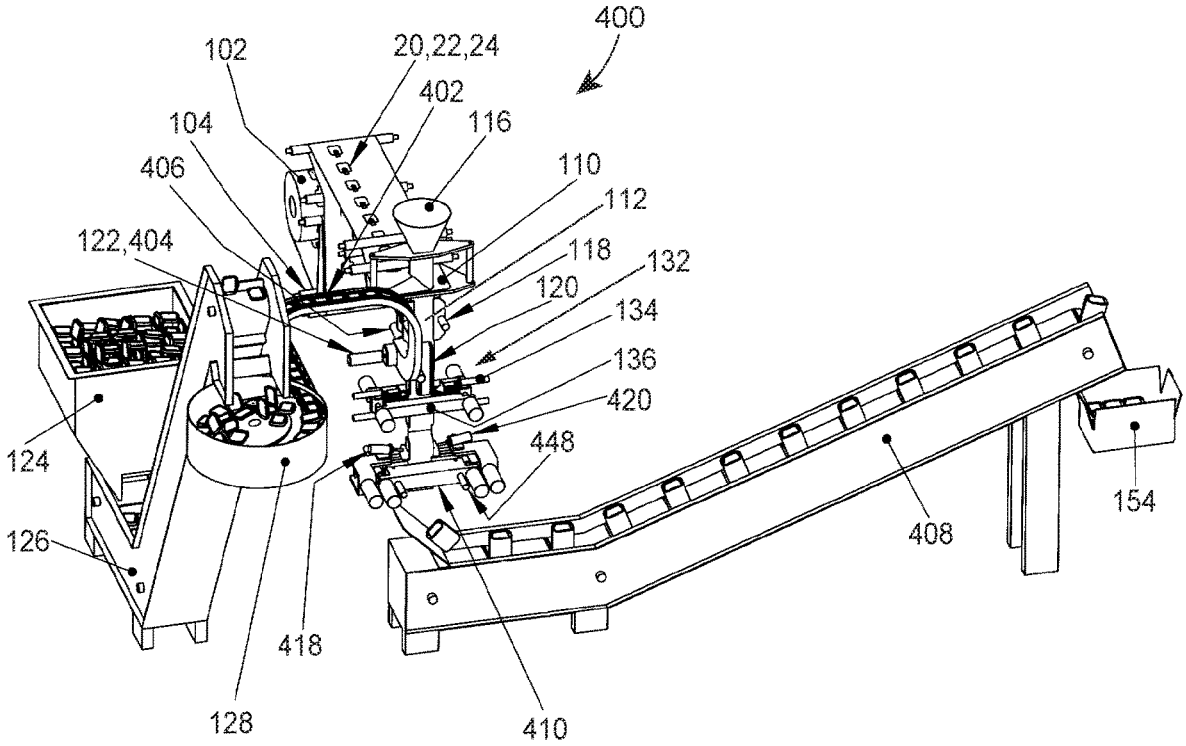
FIG. 32 is a schematic illustration of a further alternative embodiment of the packaging machine of FIG. 21.

FIG. 32 is a schematic illustration of a further alternative embodiment of the packaging machine 400 of FIG. 21 wherein the film pull belts 120 are oriented on the forming tube 112 to engage the portions of the formed web of film forming the rear and front sides 46, 48 of the package 12. Oriented in this way, the film pull belts 120 do not engage the easy-opening feature 20, 22, 24 on the web of film, thereby reducing the risk of inadvertently causing the flap 22 to become detached and compromising the sealing of the package 12. The orientation also allows the lid application station 122 to be disposed near the pull belts 120 so as to reduce the height of the forming tube 112 and place the pull belts 120 close to the bottom of the forming tube 112. The shortened forming tube 112 and placement of the pull belts 120 reduces the contact of the film with the tube 112 below the pull belts 120 and corresponding friction between the film and the tube 112, and assists in controlling and maintaining the alignment of the film along the transport path.

Figure 33:
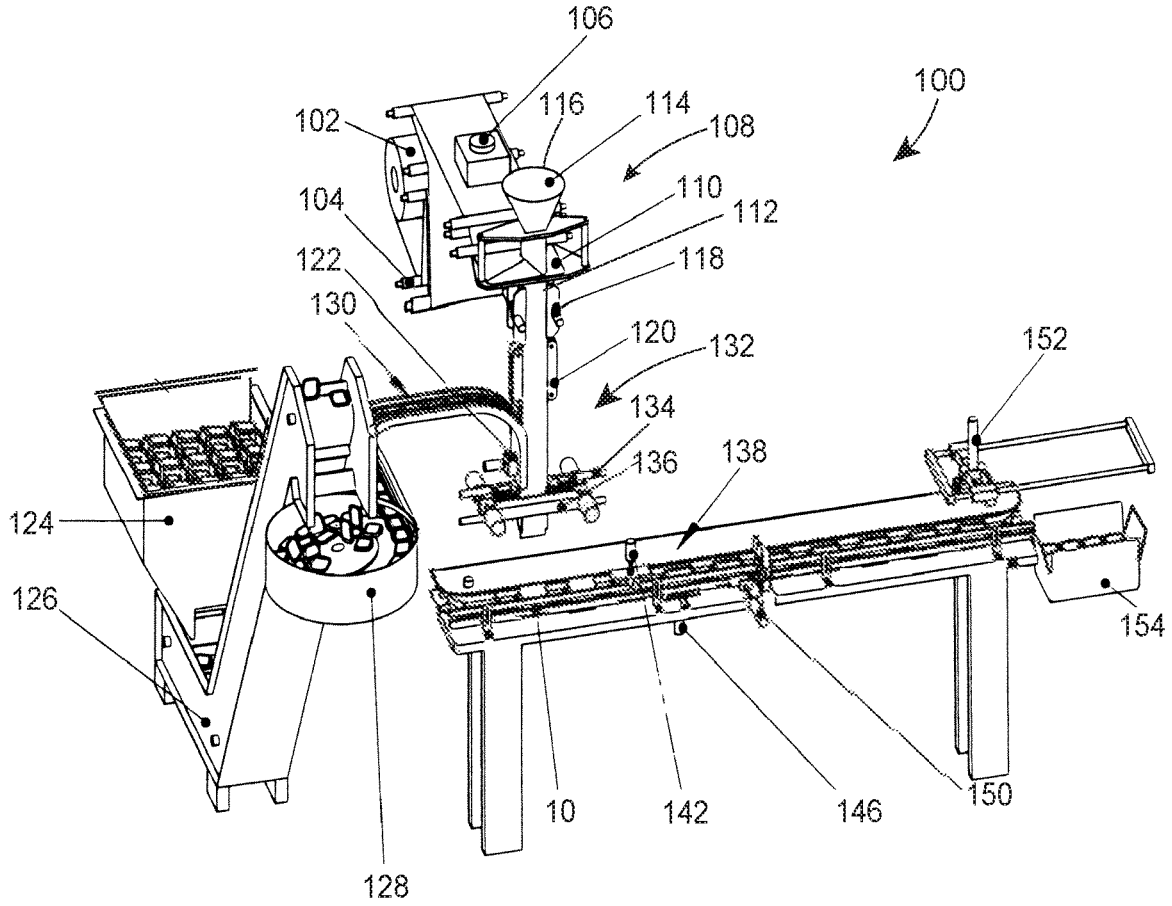
FIG. 33 is a schematic illustration of an alternative embodiment of the packaging machine of FIG. 9.

FIG. 33 is a schematic illustration of an alternative embodiment of the packaging machine 100 of FIG. 9 wherein the leading and trailing seals 70, 72 of the package 12 are folded over and tacked to the outer surface of the package 12 by folder/sealer stations 142, 146 without rotating the package 12. In this embodiment, the folder/sealer station 146 may be inverted, and the conveyor 138 may be configured to receive the leading edge seal 70 after the package 12 is detached and transferred from the closing station 132. Once the package 12 is in position, the folder/sealer station 146 may actuate to fold the leading edge seal 70 and attach the seal 70 to the surface of the package 12.

Figure 34:
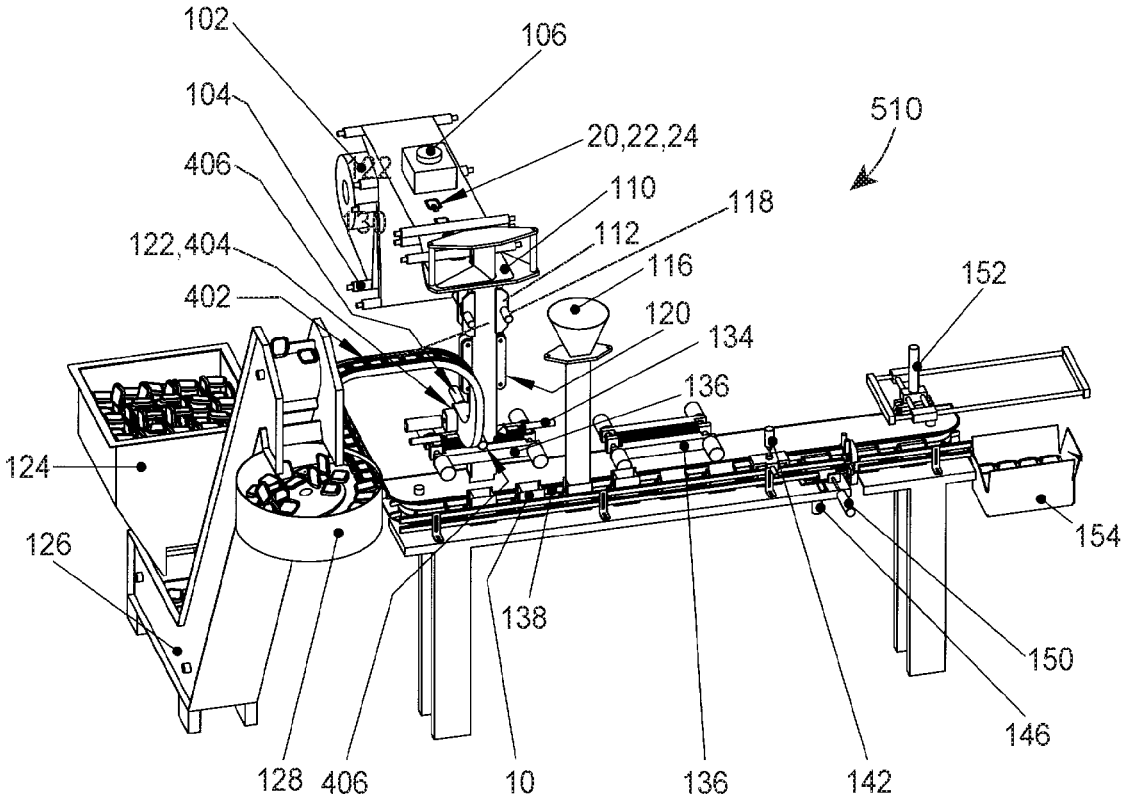
FIG. 34 is a schematic illustration of a further alternative embodiment of a packaging machine configured to produce the flexible, stackable container of FIG. 1 combining features of the packaging machines of FIGS. 10 and 21.

FIG. 34 is a schematic illustration of an alternative embodiment of a packaging machine 510 combining features of the packaging machines 100, 400 of FIGS. 10 and 21, respectively. The packaging machine 510 includes the lid application station 122 and lid feed conveyor 402 of the packaging machine 400 of FIG. 21, and the lug conveyor 138 and product fill tube 114 and funnel 116 of the packaging machine 100 of FIG. 10.

Figure 35:
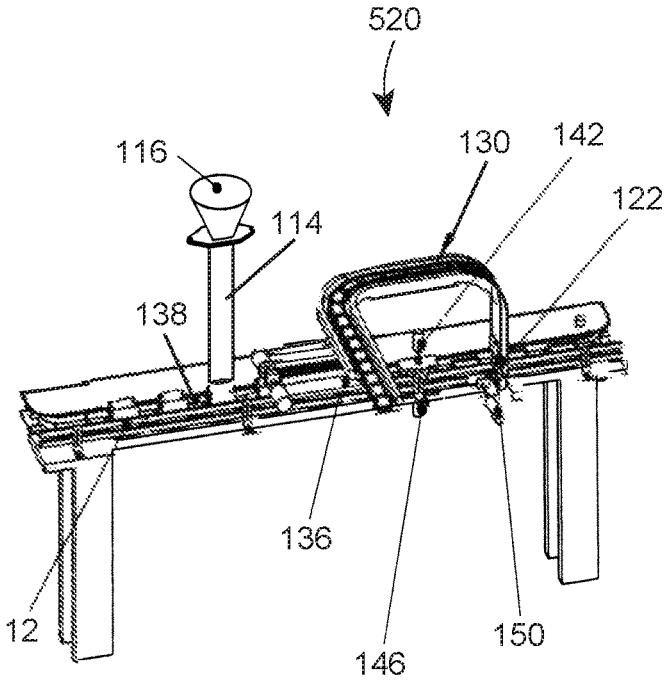
FIGS. 35 and 36 are schematic illustrations of embodiments of container filling stations that may be implemented in the packaging machines configured to produce the flexible, stackable container of FIG. 1.

FIG. 35 is a schematic illustration of a container filling and finishing station 520. The station 520 receives empty, pre-made packages 12 with the leading edge 28 sealed and the leading seal 70 folded over and attached to the surface of the package, and having the trailing edge 30 open. The pre-made packages 12 may be formed on forming tubes 112 in a similar manner as shown and described with respect to FIG. 10, but without attaching the lid fitment 14 when the sheet of film 26 is on the forming tube 112. Alternatively, the open-ended package 12 may be pre-formed by any other appropriate packaging machine. The lug conveyor 138 and associated equipment may be similar to that shown and described in FIG. 10, but with the addition of a lid feed application station 122 and lid feed conveyor 130 at an appropriate location along the conveyor 138, such as after the trailing seal 70 is formed and attached to the outer surface of the package 12.

Figure 36:
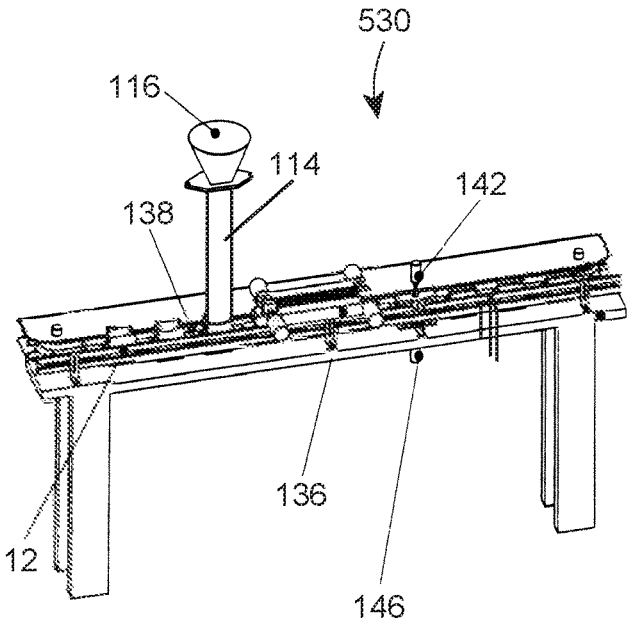

FIG. 36 is a schematic illustration of a container filling and finishing station 530 similar to the station 520 of FIG. 35 configured to fill and seal packages 12 having easy-opening features. As shown, the station 530 does not include lid application, lid conveyor and lid final sealer stations 122, 130, 150, respectively, as shown for the station 520 of FIG. 35. The container 10 in this embodiment may be provided without a lid fitment 14, or the package 12 may be conveyed to a separate piece of equipment for attachment of the lid fitment 14 to the top side 42 of the package 12 if desired.

Figure 37:
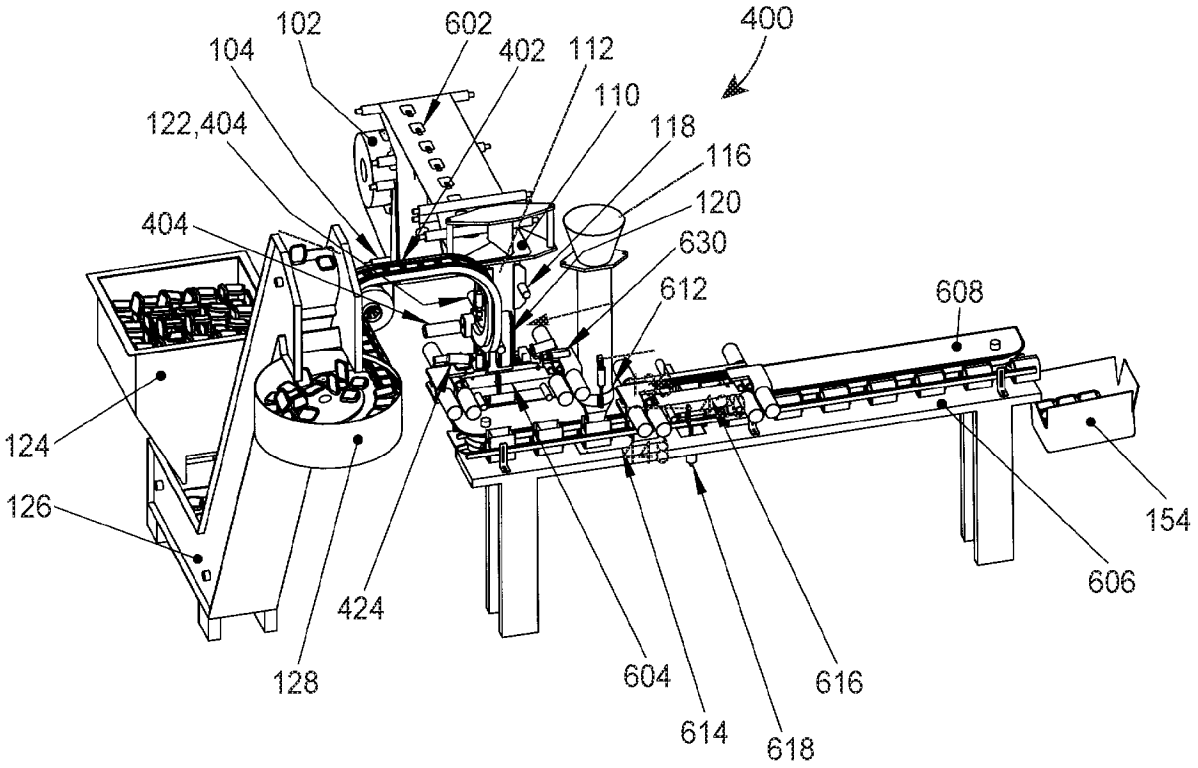
FIG. 37 is a schematic illustration of a still further alternative embodiment of a packaging machine configured to produce the flexible, stackable container of FIG. 1.

FIG. 37 illustrates a packaging machine 600 that may be similar to the packaging machine shown in FIG. 10 with a product fill tube 610 being disposed along a conveyer 606 instead of being part of the forming tube 112, and to the packaging machine 400 shown in FIG. 32 with the pull belts 120 engaging the sides 46, 48 of the sheet of film 26. In this embodiment, the web of film on the film roll 102 may have an easy-opening feature 602 pre-applied to the film so that an additional pre-processing station is not required in the packaging machine 600. Depending on product being disposed in the container 10, it may be difficult to fold over and attach the leading seal 70 if the product is poured in into the package 12 first. Therefore, it may be desirable to form, fold and tack the leading seal 70 before the product is disposed in the package 12, to detach the package 12 with the trailing edge 30 still opened, and then to fill the package 12 and form, fold and tack the trailing seal 72 to complete the formation of container 10. If necessary or desired, product settling may be performed after filling the package 12 and before sealing the package 12 to ensure that the store quantity of the product is with the portion of the package 12 defined by the sides 78, 80, 84, 86 of the lid fitment 14 when the seal 72 is folded and tacked to the outer surface of the package 12.

The packaging machine 600 is generally similar to those previously described. Similar components of the packaging machine 100, 400 are identified herein by the same reference numerals for consistency, and where appropriate redundant description of similar components is omitted. The processing within the packaging machine 600 may begin in a similar manner as the package machines 100, 400 with the web of film being fed from the film roll 102 to the forming station 108 and wrapped around the forming tube 112. Once wrapped around the forming tube 112, the film is pulled through to the seal station 118 by the pull belts 120 so that the corner seals 58-64 may be formed at the corners 52-56. The lid fitments 14 may then be applied to the packages 12 at the lid application station 122 as previously described. When a lid fitment 14 arrives at the station 122, the lid mandrel 404 or other positioning device positions the lid fitment 14 against the outer surface of the top side 42 of the package 12, and a lid adhering bar(s) 406 engages the package 12 and/or the lid fitment 14 to form the seal(s) between the lid fitment 14 and the top side 42 of the package and/or between the lid fitment 14 and the corner seals 58, 60.

Once the lid fitment 14 is attached to the top side 42 of the package 12, the leading seal 70 is formed and the package 12 is separated from the downstream package 12 at a first closing station 604. The first closing station 604 is configured to seal the leading edge 28 of a package 12 without sealing the corresponding trailing edge 30 of the downstream package 12. The first closing station 604 also separates the concurrent leading and trailing edges 28, 30, and folds and tacks the leading seal 70 of the upstream package 12. An example of a closing station 604 configured to function in this manner will be described more fully below. Because only the leading edge 28 is sealed, the downstream package 12 may be transferred to a conveyor or slide table 606 having a lug conveyor, chain or other similar conveyor mechanism 608 with the trailing edge 30 open and facing upwardly.

Each package 12 on the conveyor table 606 is moved into alignment with a bottom opening of the product fill tube 610 having funnel 116 attached thereto. The fill tube 610 may include a product lowerator 612 disposed at the lower end. The lowerator 612 may be conical or otherwise tapered with a lower opening configured to fit within the opening at the trailing edge 30 of the package 12. When a package 12 is disposed at the fill tube 610, the lowerator 612 may be actuated to move downwardly to insert the lower end into the package 12 through the opening at the trailing edge 30 to ensure that little or no product is spilled when the product is poured through the funnel 116 and fill tube 608 and into the package 12. The packaging machine 600 may further include a settling station 614 on the conveyor table 606 under the fill tube 610 that vibrates to cause the product to settle in the package 12 so that sufficient film exists to fold over and tack the trailing seal 72 to the outer surface of the package 12.

After the package 12 is filled, the lowerator 612 is removed from the package 12 and the conveyor mechanism 608 advances the package 12 along the conveyor table 606. The filled packages 12 are positioned beneath a second closing station 616 that will form the trailing seal 72, and fold and tack the trailing seal 72 to the outer surface of the package 12. Clearance may be provided to allow the open-ended packages 12 to pass underneath the second closing station 616. If such clearance is provided, the second closing station 616 may be movable to lower the closing station 616 into position to engage the package 12 and form the trailing seal 72. Alternatively, the conveyor table 606 may include a package lifter 618 below the second closing station 616 that is actuated to raise the package 12 into position to be closed by the second closing station 616. The relative movement between the second closing station 616 and the package 12 may further include the movement of the filled package toward the sealing bars of the second closing station 616 to ensure proper formation of the trailing seal 72, especially with heavier packages 12 as previously discussed above. After the trailing edge 30 is sealed to form the trailing seal 72, and folded and tacked to the outer surface of the package 12 by the second closing station 616 in a manner discussed more fully below, the package lifter 618 may lower the package 12 back to the conveyor table 606. The fully formed containers 10 are then transferred to a case packing station and placed into a carton 154 for storage and/or shipment to customers.

Figure 38:
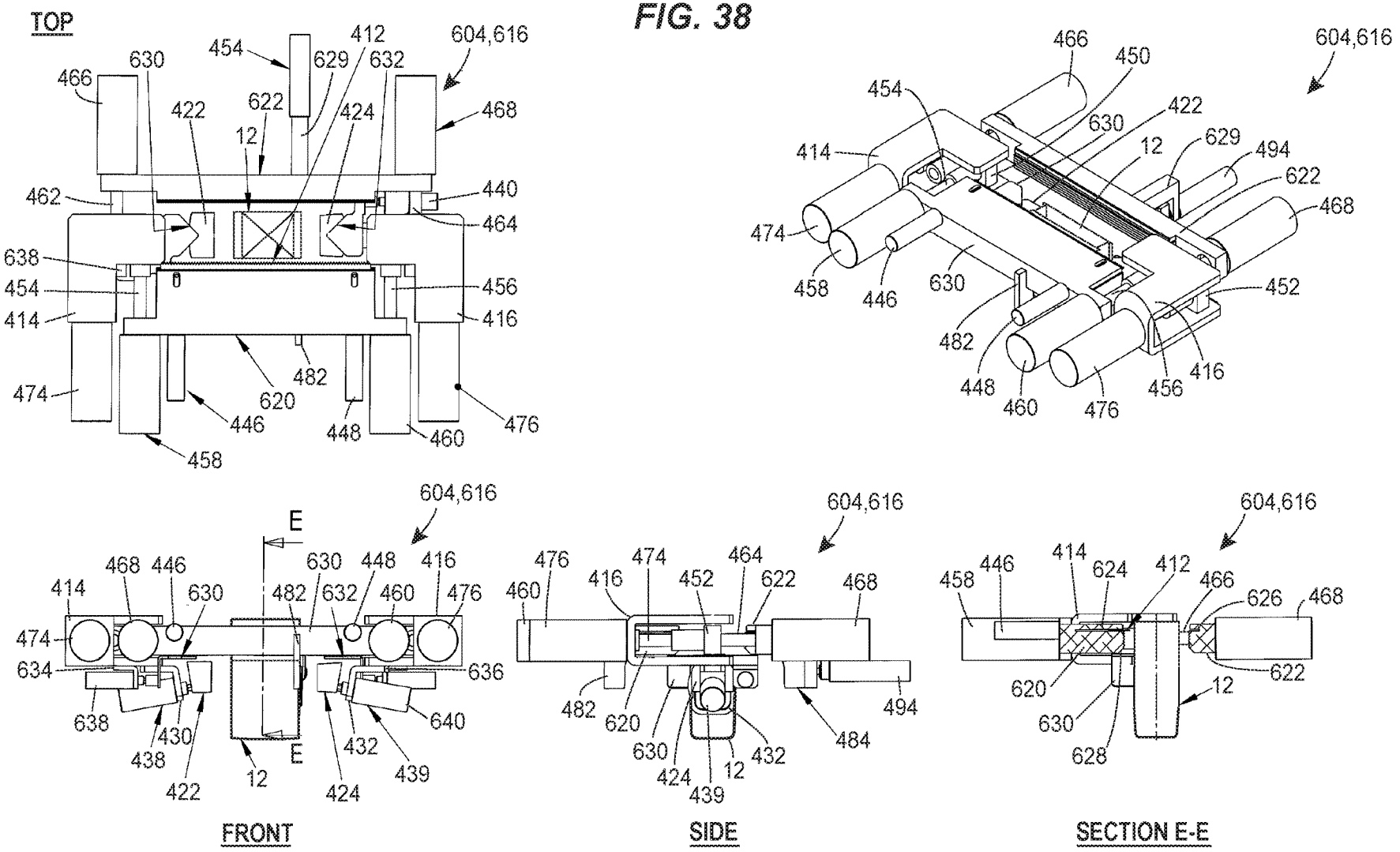
FIG. 38 is perspective, top, front, side and section views of the closing stations of FIG. 37 in an open configuration with the knife blade extended.

FIG. 38 illustrates one embodiment of the first and second closing stations 604, 616. Because the closing stations 604, 616 perform substantially similar functions, the stations 604, 616 may have the same configuration, with each station 604, 616 being oriented as necessary to form the necessary seals 70, 72 of the packages 12. The closing stations 604, 616 are also generally similar to the separation and flap sealing station 410 illustrated in FIGS. 21-26 and described in the accompanying text, but configured to seal and fold over only one of the leading and trailing seals 70, 72 of the package 12. Consequently, many of the elements of the closing stations 604, 616 are similar to the elements of the station 410 and operate in a similar manner. Where appropriate, similar elements are identified using the same reference numerals, such as the knife blade 412, brackets 414, 416, 430, 432, mandrels 422, 424, actuators 438, 439, 446, 448, 458, 460, 466, 468, 474, 476, 494, control plates 450, 452, shafts 454, 456, 462, 464, 470, 472, 490, and contour seal bars 482, 484. As illustrated in FIGS. 38-42, the closing station 604/616 is oriented as the second closing station 616 along the conveyor table 606 in FIG. 37. Those skilled in the art will understand that the closing station 604/616 may be oriented with the mandrels 422, 424 and the contour seal bars 482, 484 on the top of the closing station 604/616 when used as the first closing station 604 at the bottom end of the forming tube 112.

Turning to FIG. 38, the closing station 604/616 is configured to form a single seal 70 or 72 of a single package 12 as opposed to forming the leading and trailing seals 70, 72 on adjacent packages 12 as is done by the double seal bar closing station 132 in the packaging machines 100, 400 of FIGS. 9 and 21. Consequently, engagement bars 620, 622 may be single seal bars that engage the portion of the sheet of film 26 proximate the leading or trailing edge 28, 30 of the package 12 disposed therebetween. As a result, the engagement bars 620, 622 of the first closing station 604 engage the film proximate the leading edge 28 to form the leading seal 70 without forming the trailing seal 72 of the downstream package 12, and the engagement bars 620, 622 of the second closing station 616 engage the film proximate the trailing edge 30 of a package 12 on the conveyor table 606 to form the trailing seal 72 and close the package 12.

The engagement bars 620, 622 include slots 624, 626, respectively, accommodating the knife blade 412. The knife blade 412 is slidable within a slot 624 of the engagement bar 620 and may be extended and retracted within the slot 624 by the knife actuators 446, 448 as described above. The knife blade 412 is received into the slot 626 of the engagement bar 622 when the knife blade 412 is extended to sever the concurrent leading and trailing edges 28, 30 at the first closing station 604, or to cut off any excess film at the second closing station 616 that may be provided at the trailing edge 30 to ensure filling of the package 12 without spilling the product and to facilitate grasping of the film and forming the trailing seal 72 at the second closing station 616. If additional cutting is not necessary at the second closing station 616, the knife blade 412 and the slots 624, 626 may be omitted.

In addition to forming only one seal 70 or 72 at the closing station 604/616, only one seal 70 or 72 is folded over and attached to the outer surface of the package 12. Therefore, a shoulder or chamfer 628 is provided on an appropriate edge of the engagement bar 620 to facilitate folding of the seals 70, 72 without tearing the film. Similarly, only one contour seal bar 482 may be mounted to the engagement bar 620, and only a single contour seal bar 484 and associated actuator 494 and shaft 490 may be mounted to the engagement bar 622 by a bracket 629 such that the contour seal bars 482, 484 may engage the outer surface of the package 12 proximate the lid fitment 14 to assist in sealing the corner seals 58, 60 to the base 16 of the lid fitment 14.

In a similar manner as discussed above for the closing station 134, it may be necessary or desired to tuck the film between the corner seals 58/60 and 62/64 on the top and/or bottom sides 42, 44 of the package 12 at the time the leading and trailing seals 70, 72. To properly for the tucks 74, 76 in the top and bottom sides 42, 44 of the packages 12 during the operation of the station 604/616, tuck bars or fingers 630, 632 may be mounted to the support brackets 414, 416 on the same side of closing station 604/616 as the mandrels 422, 424 by brackets 634, 636. Tuck finger actuators 638, 640 that are selectively actuated to extend and retract the tuck fingers 630, 632 are also provided. When a package 12 is disposed between the engagement bars 620, 622, the tuck finger actuators 638, 640 may extend the tuck fingers 630, 632 into engagement with the sides 42, 44 of the package 12 prior to or concurrently with the closing of the engagement bars 620, 622 to properly form the tucks 74, 76 in the film.

Figure 39:
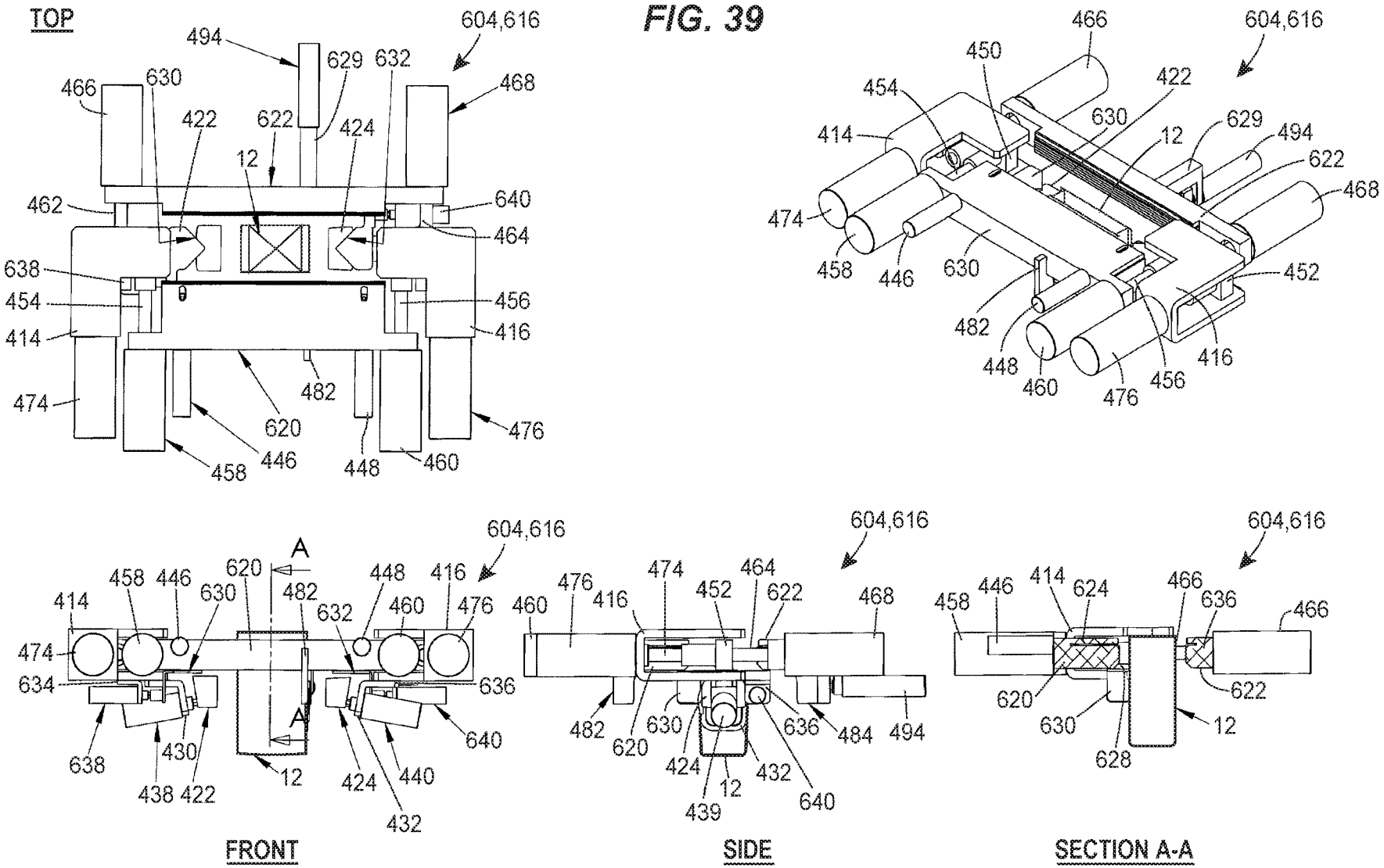
FIG. 39 is perspective, top, front, side and section views of the separation and flap sealing station of FIG. 37 in an open configuration with the knife blade retracted.

The operation of the closing station 604/616 will now be described with reference to FIGS. 39-42. Referring to FIG. 39, the closing station 604/616 is shown in a normal open position to allow for operation of the pull belts 120 or the conveyor mechanism 608 and package lifter 618 to advance the next package 12 between the engagement bars 620, 622. The shafts 454, 456, 462, 464 are extended by the actuators 458, 460, 466, 468 to separate the engagement bars 620, 622, and knife blade 412 is retracted within the slot 624 of the engagement bar 620 by the actuators 446, 448. With the engagement bars 620, 622 apart, the lowermost container 10 may be lowered between the bars 620, 622 of the first closing station 604 until the concurrent leading and trailing edges 28, 30 of the two lowermost packages 12 are aligned with the slots 624, 626 of the engagement bars 620, 622. For the second closing station 616, the trailing edge 30 of a package 12 is aligned with the slots 624, 626. The packages 12 are oriented with the lid fitments 14 facing the mandrel 424.

Figure 40:
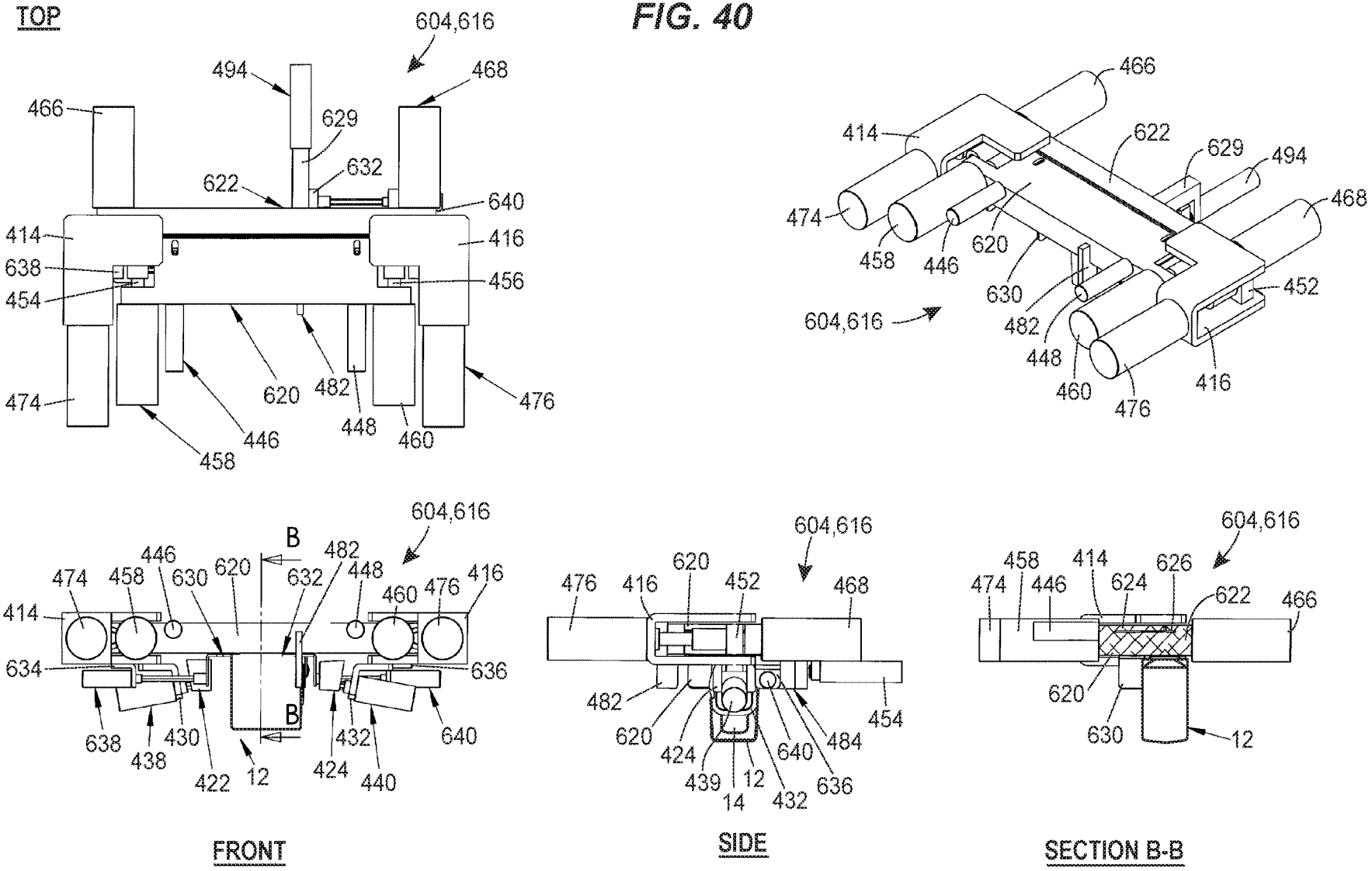
FIG. 40 is perspective, top, front, side and section views of the separation and flap sealing station of FIG. 37 with the engagement bars closed and the tuck fingers extended.

Once the packages 12 are disposed within the closing station 604/616, the engagement bars 620, 622 are moved together into contact with the film proximate the edges 28, 30 as shown in FIG. 40. Actuators 458, 460, 466, 468 operate to retract the shafts 454, 456, 462, 464 and move the engagement bars 620, 622 toward the folding control plates 450, 452. Eventually, the bars 620, 622 meet and engage the seals 70, 72. Prior to or at the same time as the engagement bars 620, 622 are extended, the actuators 638, 640 activate to extend the tuck fingers 630, 632 into engagement with sides 42, 44 or the package 12. Depending on the particular configuration of the engagement bars 620, 622 and the tuck fingers 630, 632, the tuck fingers 630, 632 may remain extended as the engagement bars 620, 622 are engaged, or may extend and retract before the engagement bars 620, 622 completely close down on the film. Once closed, the engagement bars 620, 622 form the seals 70, 72 by application of pressure, heat, adhesive, or other appropriate mechanisms or combination of mechanisms.

Figure 41:
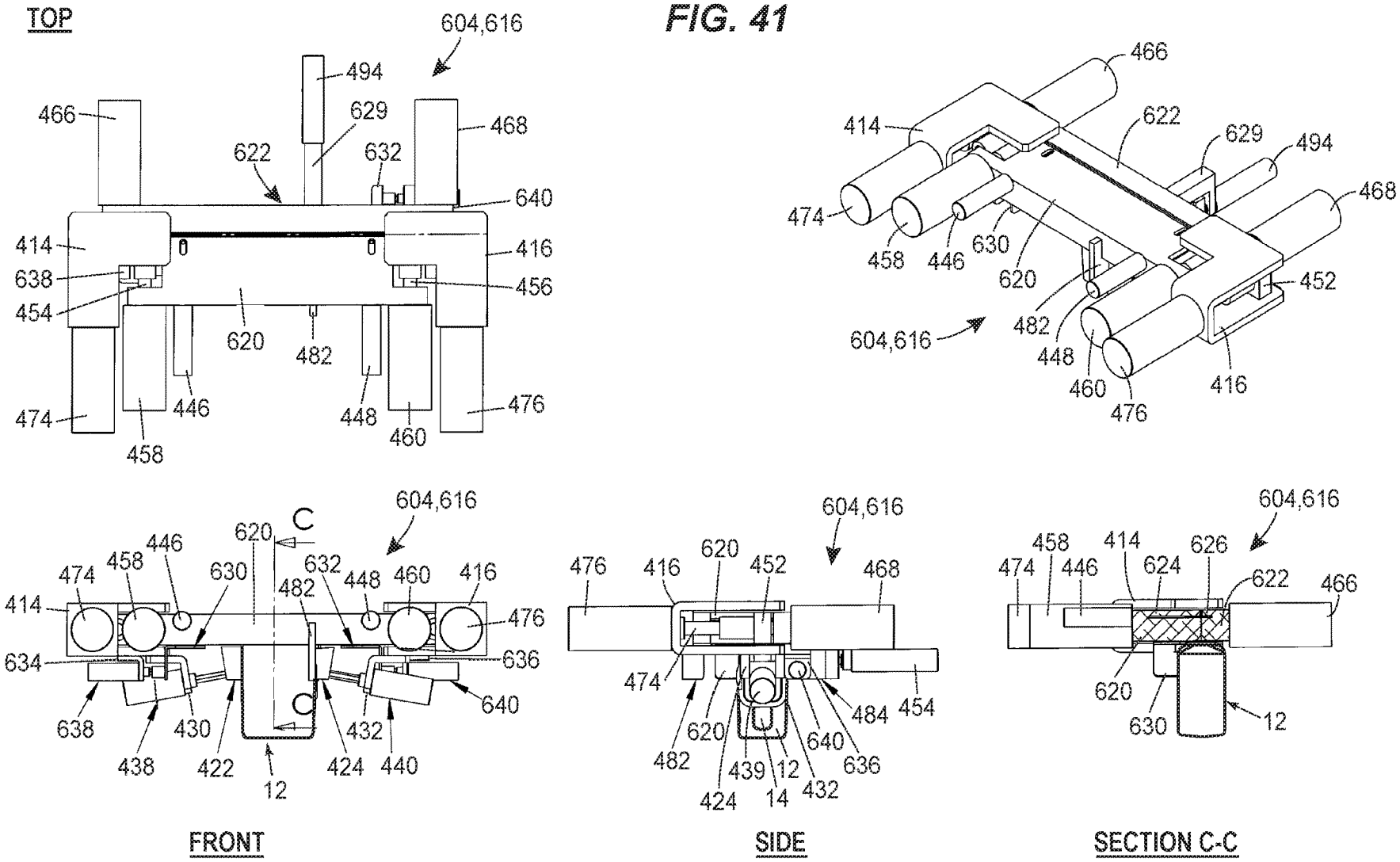
FIG. 41 is perspective, top, front, side and section views of the separation and flap sealing station of FIG. 37 with the engagement bars closed, the tuck fingers retracted, and the mandrels extended.

As the engagement bars 620, 622 are closed, or after the bars 620, 622 are closed as shown in FIG. 41, the mandrels 422, 424 are extended by the actuators 438, 439 to engage the top and bottom sides 42, 44 of the package 12. The mandrel 424 is configured to mate with the lid fitment 14 to align the package 12 within the closing station 604/616. With the package 12 aligned and supported by the mandrels 422, 424, the actuators 446, 448 may operate to extend the knife blade 412 through the slot 624 and intersection of the seals 70, 72, and into the slot 626 of the engagement bar 622. The engagement of the package 12 by the bars 620, 622 and the mandrels 422, 424 of the second closing station 616 holds the package 12 in place prior to folding and sealing of the trailing seal 72.

Figure 42:
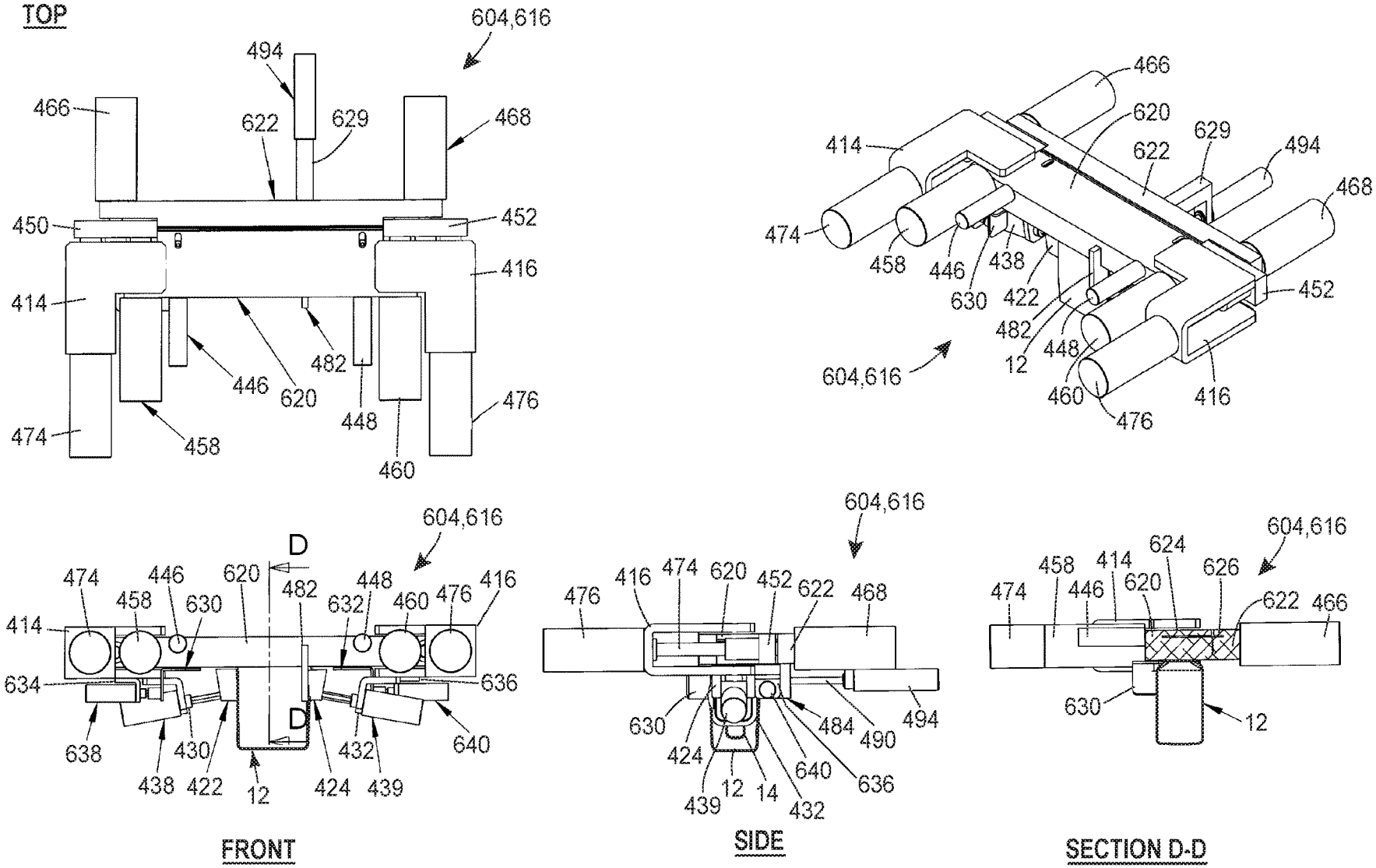
FIG. 42 is perspective, top, front, side and section views of the separation and flap sealing station of FIG. 37 with the engagement bars extended to fold and tack the edge seal.

After separation, the leading seal 70 of the upper package 12 may be folded over and sealed to the outer surface of the package 12 in the first closing station 604. Similarly, the trailing seal 72 of the package 12 at the second closing station 616 may be folded over and sealed. The seals 70, 72 and loose portions of the film are folded over by operating the actuators 474, 476 to extend the shafts 470, 472 and move the engagement bars 620, 622 relative to the packages 12 via the folding control plates 450, 452 as shown in FIG. 42. If necessary, the actuators 458, 460, 466, 468 may act to partially or fully separate the engagement bars 620, 622 and allow the seals 70, 72 to fold over. The chamfer 628 at the leading edge of the engagement bar 622 facilitates folding of the seals 70, 72 without tearing the film. Once folded, the seals 70, 72 may be tacked to the outer surfaces of the packages 12 using any appropriate fastening process, such as those described above. For example, the engagement bar 620 may be heated to heat seal the seals 70, 72 to the packages 12 as they are folded. The heat sealing may be facilitated by applying an appropriate coating to the film, or by using a film that self-seals under heat. As a further alternative, an adhesive applicator may be added to the closing station 604/616 to apply an adhesive that will tack the seals 70, 72 to the packages 12.

In addition to tacking the seals 70, 72, the corner seals 58, 60 may be sealed to the lateral sides 84, 86 of the lid fitment 14. As the engagement bar 620 moves rightward, the contoured seal bar 482 engages the corner seal 58 and presses the corner seal 58 against the lid fitment 14. At the same time, the actuator 494 operates to extend the contoured seal bar 484 into engagement with corner seal 60 and press the corner seal 60 against the lid fitment 14. The seal bars 482, 484 may be configured in a similar manner as the lid adhering bar 406 at the lid application station 122 to complete the seal between the lid fitment 14 and the corner seals 58, 60. Once the seals 70, 72 are tacked and the corner seals 58, 60 are sealed to the lid fitments 14, the actuators 458, 460, 466, 468, 474, 476, 494 may be operated to return the engagement bars 620, 622, control plates 450, 452 and seal bar 484 to their normal open positions. The mandrels 422, 424 may then be opened to release the container 10 and allow the container 10 to continue along the transport path of the packaging machine 600.

Figure 43:
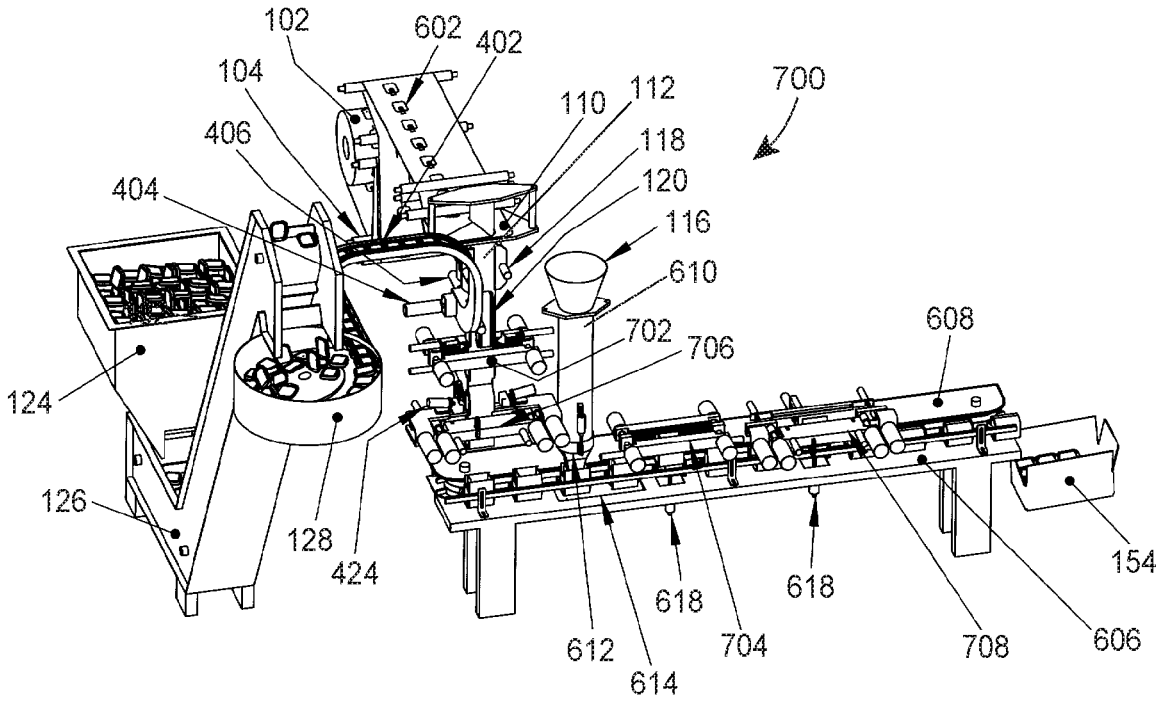
FIGS. 43 and 44 are a schematic illustrations of alternative embodiments of the packaging machine of FIG. 37.

FIG. 43 is a schematic illustration of an alternative embodiment of a packaging machine 700 similar to the packaging machine 600 of FIG. 37 wherein the first and second closing stations are each separated into a sealing station 702, 704 and a corresponding flap seal station 706, 708. At the first closing station, the first sealing station 702 seals the leading edge 30 of the upstream package 12 without forming the trailing seal 72 of the downstream package 12. The web of film then advances so that the concurrent leading and trailing edges 28, 30 are disposed at the first flap seal station 706 wherein the packages 12 are separated, and the leading seam 70 of the upstream package 12 is folded over and attached to the outer surface of the package 12. The separated downstream package 12 having the open trailing edge 30 is transferred to the conveyor 606. At the second closing station, the second sealing station 704 moves downward toward a package 12 or a package lifter 618 raises the package 12 to the second sealing station 704, and the seal bars of the second sealing station 704 close on the trailing edge 30 to form the trailing seal 72. Once sealed, the conveyor transfers the package 12 to the second flap seal station 708 wherein trailing seam 72 of the package 12 is folded over and attached to the outer surface of the package 12.

Figure 44:
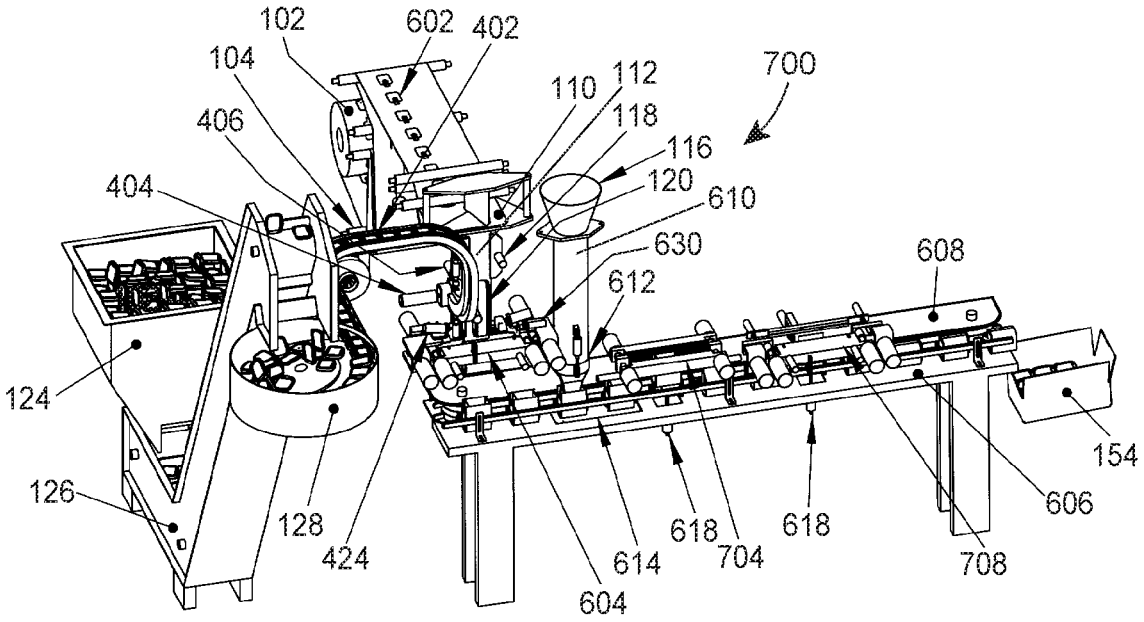

FIG. 44 is a schematic illustration of an alternative embodiment of the packaging machine 700 of FIG. 43 wherein only the second closing station is separated into a sealing station 704 and a corresponding flap seal station 706.

Figure 45:
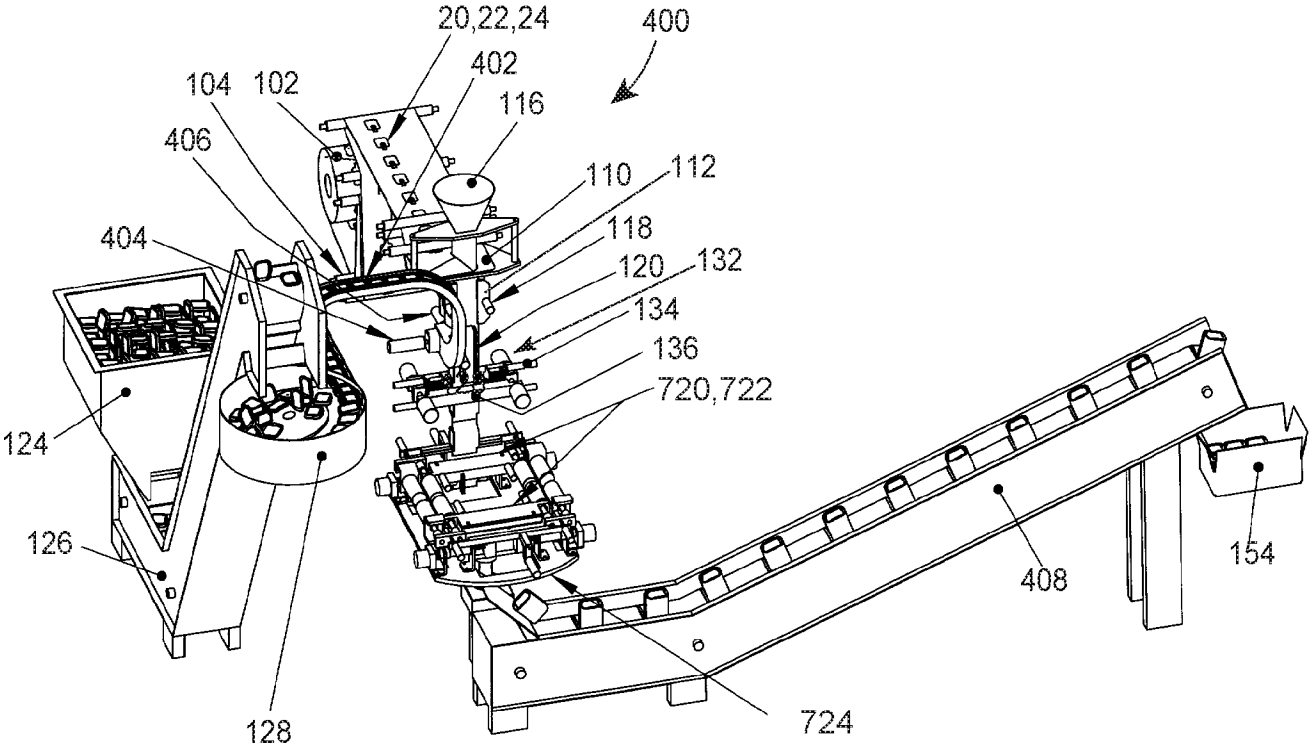
FIG. 45 is a schematic illustration of an additional alternative embodiment of the packaging machine of FIG. 21.

FIG. 45 is a schematic illustration of an additional alternative embodiment of the packaging machine 400 of FIG. 21 wherein the folding over and attachment of the leading and trailing seals 70, 72 is performed at two separate flap seal assemblies 720, 722. At the first flap seal assembly 720, the concurrent leading and trailing edges 28, 30 of adjacent packages 12 are separated, and the trailing seal 72 of the downstream package 12 is folded over and attached to the outer surface of the package 12. After the trailing seal 72 is attached, a turret 724 repositions the container 10 at the second flap seal assembly 722 for folding over and attaching the leading seal 70 to the outer surface of the package 12. The turret 724 rotates 180° to move the container 10 to the second flap seal assembly 722. At the same time, the container 10 is also rotated 180° so that the leading seal 70 is facing upwardly toward the second flap seal assembly 722. Once the container 10 is repositioned, the turret 724 raises the container 10 upwardly so that the second flap seal assembly 722 can engage the leading seal 70 and fold over and attach the leading seal 70 to the outer surface of the package 12. After the second folding and attachment operation, the completed container 10 is transferred to the conveyor 408. This embodiment of the packaging machine 400 may be particularly useful where product within the package 12 may interfere with folding over and attaching the leading seal 70 of the package 12 when the leading seal 70 is disposed at the bottom of the package 12.

Figure 47:
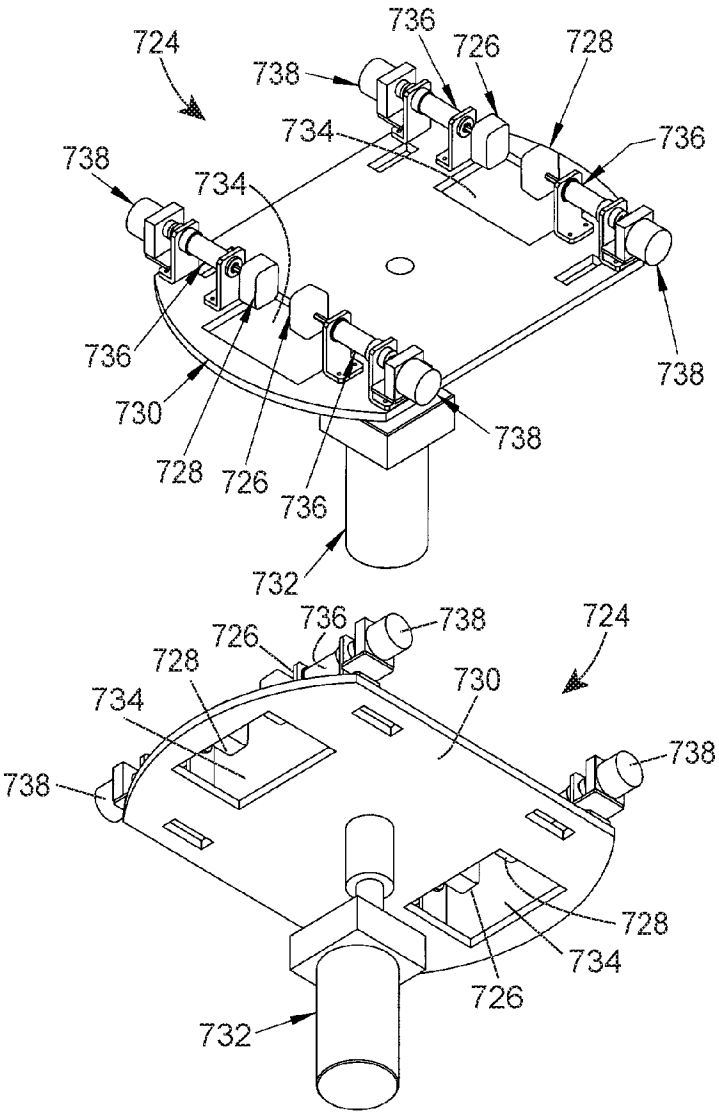
FIGS. 46-48 are top and bottom perspective views, and top, front and side views of an embodiment of the turret of the packaging machine of FIG. 45.
Figure 46:
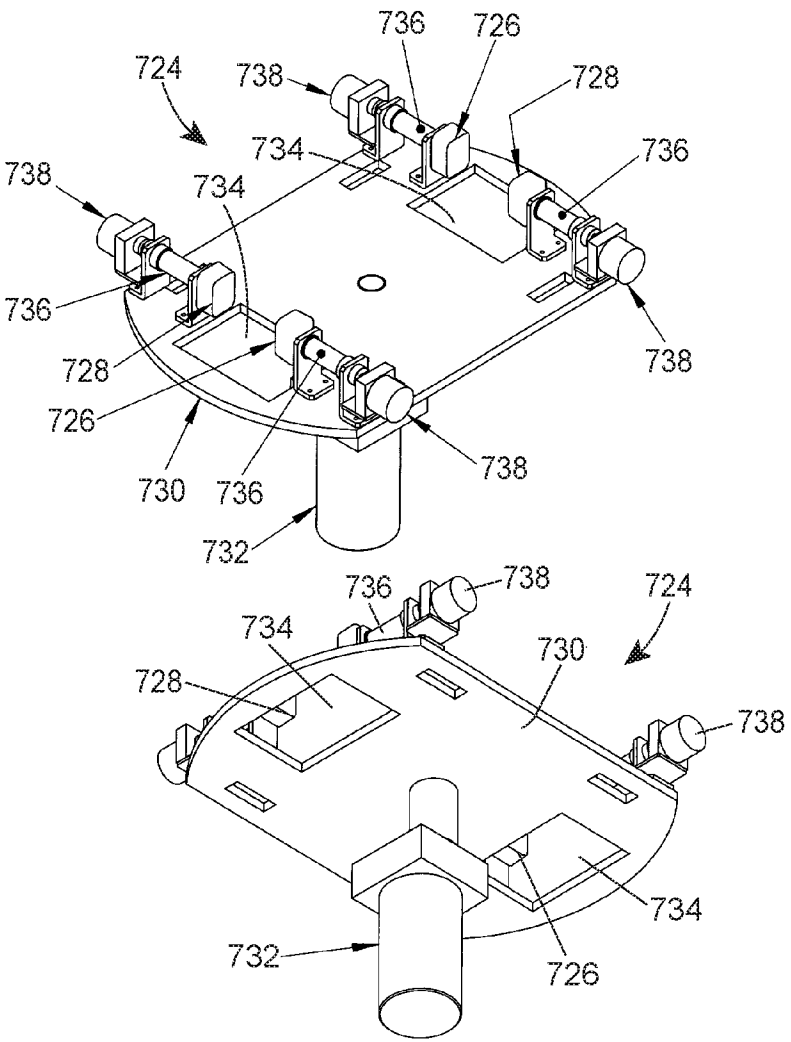
Figure 48:
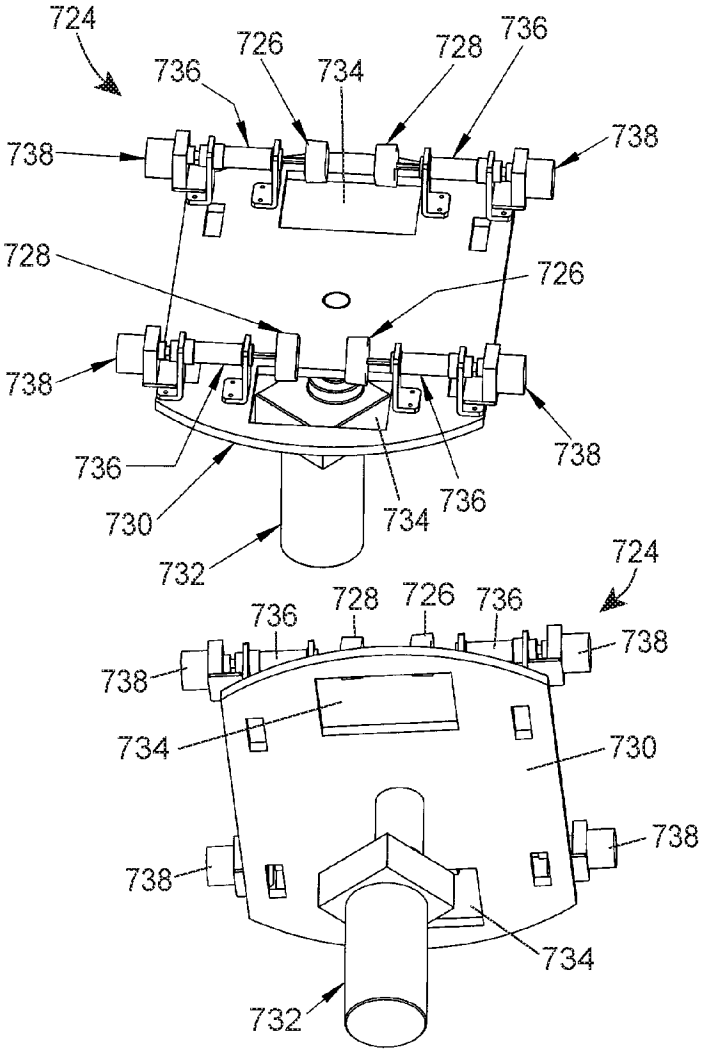

FIGS. 46-48 are top and bottom perspective views, and top, front and side views of an embodiment of the turret 724 of the packaging machine 400 of FIG. 45. Referring to FIG. 46, the turret 724 is illustrated in a downward position with mandrels 726, 728 retracted. The heads of the mandrels 726 may be shaped to conform to the inner recess of the top surface of the lid fitments 14 of the containers 10, and the heads of the mandrels 728 may be shaped to conform to the bottom surface of the package 12 for engaging the containers 12 and properly aligning the edge seals with the flap seal assemblies 720, 722. The turret 724 includes a mounting plate 730 mounted on a turret drive 732 that can extend the plate 730 upwardly as shown in FIG. 47 and rotate the plate 730 as shown in FIG. 48. At opposite ends of the plate 730, pairs of mandrels 726, 728 are mounted on either side of a plate opening 734 having dimensions allowing containers 10 to pass therethrough. Each mandrel 726, 728 has a corresponding actuator 736, such as an air cylinder, that operates to extend the mandrel 726, 728 inwardly toward the facing mandrel 726, 728. Each mandrel 726, 728 also has a corresponding mandrel turning drive 738 coupled to the actuator 736 to rotate the actuator 736 and mandrel 726, 728 and, correspondingly, a container 10 engaged by the mandrels 726, 728.

When adjacent packages 12 are positioned at the first flap seal assembly 720, the turret drive 732 operates to lift the mounting plate 73—upwardly to position one of the pairs of mandrels 726, 728 for engagement of the downstream package 12. The air cylinders 736 actuate to extend the mandrels 726, 728 into engagement with the downstream package 12. After the packages 12 are separated and the trailing seal 72 of the downstream package 12 is folded over and attached, the turret drive 732 may lower and rotate the plate 730 to reposition the leading seal 70 of the package 12 at the second flap seal assembly 722. As the plate 730 rotates, the turning drives 738 operate to rotate the air cylinders 736 and mandrels 726, 728 and, correspondingly, the package 12 engaged thereby. As the leading seal 70 is reoriented to the top of the package 12, the product within the package 12 empties from the loose portion of the film proximate the leading seal 70 to allow the leading seal 70 to be folded over. Once the package 12 is repositioned, the turret drive 732 again raises the plate 730 so that the second flap seal assembly 722 can engage the leading edge 70 of the package 12 to fold over and attach the leading seal 70. When the second flap seal assembly 722 disengages, the turret drive 732 lowers the turret 724 and the air cylinders 736 operate to retract the mandrels 726, 728 and allow the completed container 10 to pass through the plate opening 734 and fall or otherwise be transferred to the conveyor 408. The mandrels 726, 728 will once again be repositioned at the first flap seal assembly 720 when the plate 730 is rotated to move a container 12 engaged by the opposite mandrels 726, 728 into position for engagement by the second flap seal assembly 722.

Figure 49:
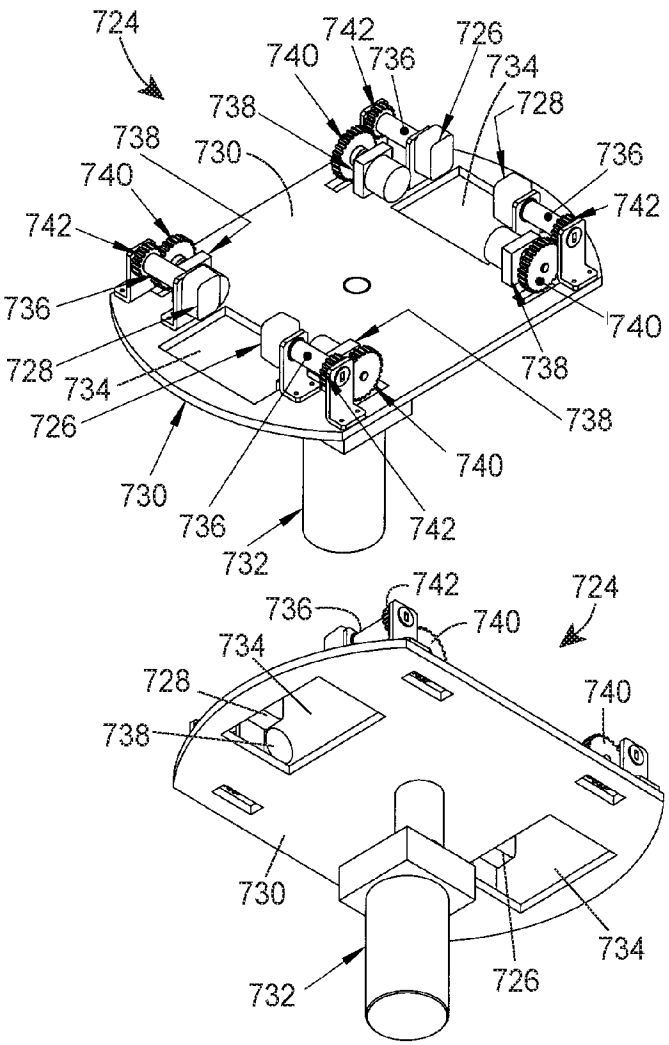
FIGS. 49 and 50 are top and bottom perspective views, and top, front and side views of alternative embodiments of the turret of FIG. 48.

FIG. 49 is top and bottom perspective views, and top, front and side views of an alternative embodiment of the turret 724 of FIG. 48 having the mandrel turning drives 738 operatively coupled to the corresponding air cylinders 736 by drive gears 740, 742 to rotate the mandrels 726, 728.

Figure 50:
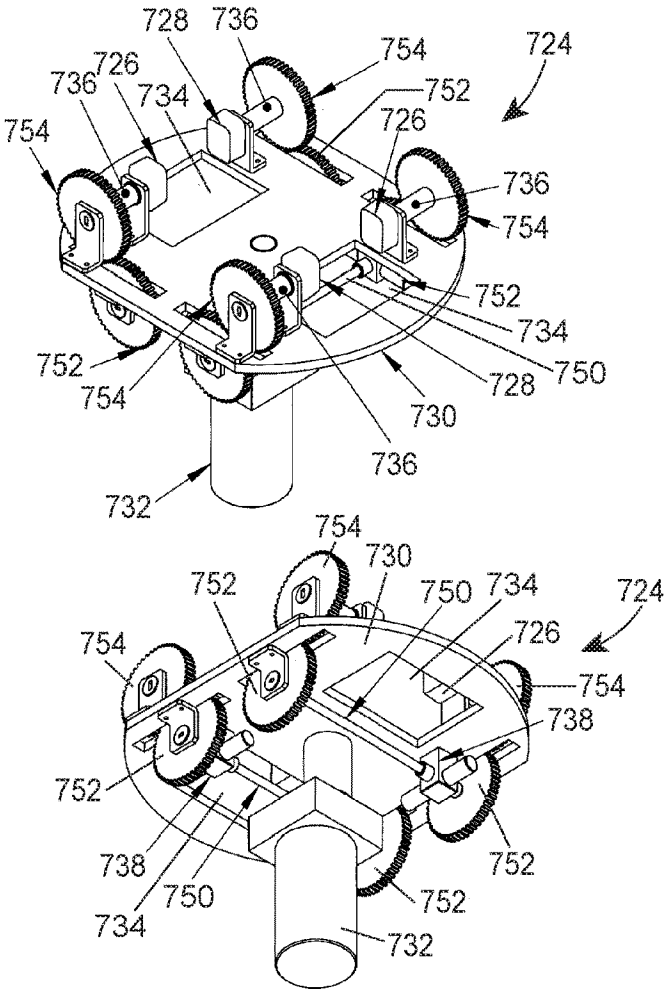

FIG. 50 is top and bottom perspective views, and top, front and side views of a further alternative embodiment of the turret 724 of FIG. 48 wherein each pair of mandrels 726, 728 has a single drive 738 operatively coupled to both mandrels 726, 728 and corresponding air cylinders 736 by a turning link shaft 750 and drive gears 752, 754, thereby reducing the total number of turning drives 738 of the turret 724.

Figure 51:
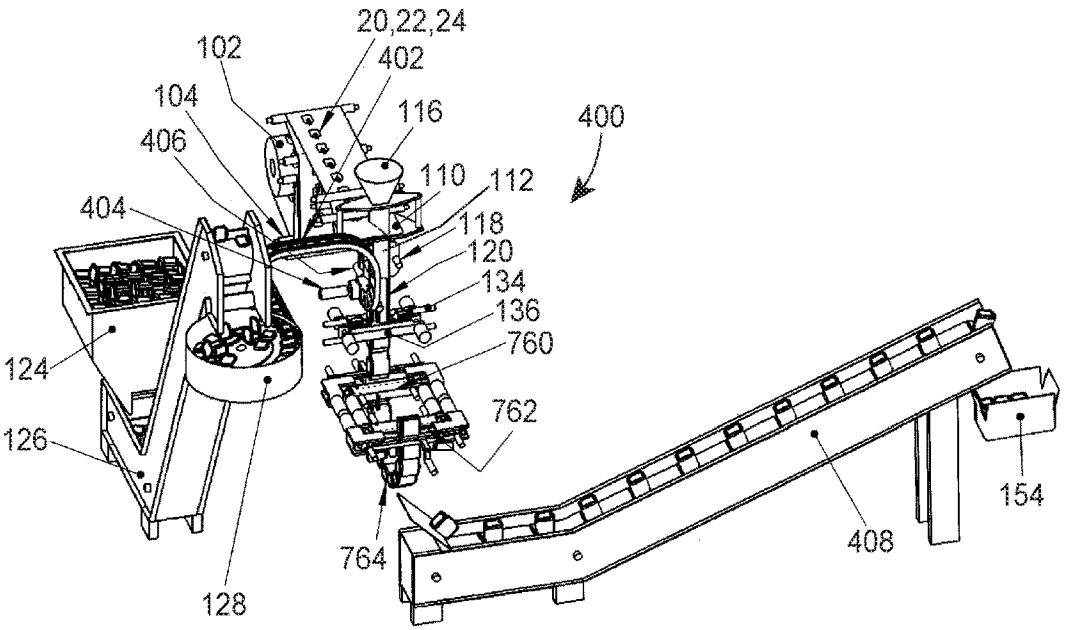
FIG. 51 is a schematic illustration of a still further alternative embodiment of the packaging machine of FIG. 21.

FIG. 51 is a schematic illustration of a still further alternative embodiment of the packaging machine 400 of FIG. 21 wherein the folding over and attachment of the leading and trailing seals 70,72 is performed at two separate flap seal assemblies 760, 762, with the packages 12 being separated at the second flap seal assembly 762. At the first flap seal assembly 760, the trailing seal 72 of the downstream package 12 is folded over and attached to the outer surface of the package 12 without separating the concurrent leading and trailing seals 70, 72. After the trailing seal 72 is attached, the packages 12 are conveyed to the second flap seal assembly 762 along a continuous package loop 764. As the package loop 764 progresses, the packages 12 are reoriented 180° so that the leading seal 70 is facing upwardly as the packages 12 arrive at the second flap seal assembly 762. Once a package 12 is repositioned at the second flap seal assembly 762, the concurrent leading and trailing edges 28, 30 of adjacent packages 12 are separated, and the leading seal 70 is folded over and attached to the outer surface of the package 12. After the second folding and attachment operation, the completed container 10 is transferred to the conveyor 408. As with the packaging machine 400 of FIG. 45, this embodiment of the packaging machine 400 may be particularly useful where product within the package 12 may interfere with folding over and attaching the leading seal 70 of the package 12 when the leading seal 70 is disposed at the bottom of the package 12.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A method of manufacturing a flexible, stackable container for storing a quantity of a product, the container including a sealed package formed from a single sheet of film and a lid fitment attached thereto, the sheet of film having oppositely disposed lateral edges and oppositely disposed leading and trailing edges, the method comprising:

wrapping the sheet of film inwardly with the lateral edges being disposed proximate each with one side of the sheet of film being the inner surface of the package and the opposite side of the sheet of film being the outer surface of the package;

forming at least three folds in the sheet of film parallel to the lateral edges of the sheet of film to form corners defining oppositely disposed first and second sides and oppositely disposed third and fourth sides of the package;

forming folds parallel to the folds defining the first and second sides of the package on the first and second sides of the package, each fold being made proximate a corresponding one of the folds defining the first or second sides and bringing the inner surface of the corresponding first or second side into contact with a corresponding portion of inner surface of the adjacent side of the package, and sealing the contacting inner surfaces to form corner seals;

sealing the portions of the sheet of film proximate the lateral edges to each other to form a fin seal;

bringing the third and fourth side portions of the leading edge of the sheet of film together and sealing the inner surfaces of the sheet of film proximate thereto together to form a leading seal of the package;

bringing the third and fourth side portions of the trailing edge of the sheet of film together and sealing the inner surfaces of the sheet of film proximate thereto together to form a trailing seal of the package such that the package is sealed once the fin seal, the leading seal and the trailing seal are formed;

folding the leading and trailing seals over toward corresponding portions of the outer surface of the package and attaching the leading and trailing seals thereto such that the leading and trailing seals and portions of the third and fourth sides of the package form lateral sides of the container, and the corners seals at the first side extend outwardly from and surround a first surface of the first side, and the corner seals at the second side extend outwardly from and surround a second surface of the second side; and attaching the lid fitment to the first side of the package, wherein the lid fitment comprises a base having a central opening and a lid having a complimentary shape to the base to form a seal therebetween when the lid is closed down onto the base, wherein the base is sealed to one of the first surface of the first side and the corner seals surrounding the first side such that a portion of the first surface of the first side is accessible from the exterior of the container when the lid is separated from the base of the lid fitment.

2. The method of manufacturing a flexible, stackable container of claim 1, comprising hermetically sealing the fin seal, the leading seal and the trailing seal to hermetically seal the package.

3. The method of manufacturing a flexible, stackable container of claim 1, comprising hermetically sealing the base of the lid fitment to one of the first surface of the first side and the corner seals surrounding the first side.

4. The method of manufacturing a flexible, stackable container of claim 1, comprising attaching the lid fitment to the first side of the package after forming the corner seals and prior to folding over and attaching the leading and trailing seals.

5. The method of manufacturing a flexible, stackable container of claim 1, wherein the base of the lid fitment comprises a front side, a rear side and oppositely disposed lateral sides, the method comprising sealing the front side and the rear side of the base of the lid fitment and the corresponding portions of the corner seals prior to folding over and attaching the leading and trailing seals.

6. The method of manufacturing a flexible, stackable container of claim 5, comprising sealing the lateral sides of the base of the lid fitment and the corresponding portions of the corner seals after folding over and attaching the leading and trailing seals.

7. The method of manufacturing a flexible, stackable container of claim 1, comprising attaching the lid fitment to the first side of the package after folding over and attaching the leading and trailing seals.

8. The method of manufacturing a flexible, stackable container of claim 1, comprising defining a flap on the first surface of the first side of the package with a line of reduced strength in the film forming the first surface such that the line of reduced strength yields first to separate the flap from the first surface when a force is applied to the first surface.

9. The method of claim 8, wherein the flap comprises a pull tab having a gripping portion.

10. The method of manufacturing a flexible, stackable container of claim 1, comprising attaching a pull tab having a gripping portion to the outer surface of the flap such that the flap detaches from the first surface along the line of reduced strength before the pull tab detaches from the flap when the gripping portion is pulled away from the package.

11. The method of manufacturing a flexible, stackable container of claim 1, wherein the container is sealed when a portion of the first surface of the first side is penetrated to expose the interior of the package and the lid is closed down onto the base of the lid fitment.

12. The method of manufacturing a flexible, stackable container of claim 1, comprising depositing a quantity of the produce in the package between the steps of forming the leading seal and the trailing seal.

13. The method of claim 1, wherein the edge seal is a combination edge and corner seal.

14. The method of claim 1, further comprising forming third folds on the second panel of the package parallel to the first folds defining the second panel of the package, each third fold being made proximate a corresponding one of the first folds defining the second panel and brining the inner surface of the corresponding portion of the second panel into contact with a corresponding portion of the inner surface of the adjacent side of the package, and sealing the contacting inner surfaces to form at least one corner seal extending outwardly from the second planar surface of the second panel in a substantially perpendicular direction, wherein the at least one corner seal surrounds more than two peripheral sides of the second panel.

15. The method of claim 1, wherein the sheet of film is provided on a film roll having a web of film comprising a plurality of sheets of film for forming a plurality of packages.

16. The method of claim 1, further comprising attaching a lid fitment to the first panel of the package, wherein the lid fitment comprises a base having a central opening and a lid having a complimentary shape to the base to form a seal therebetween when the lid is closed down onto the base, wherein the base is sealed to one of the first planar surface of the first panel and the corner seals surrounding the first panel such that a portion of the first planar surface of the first panel is accessible from the exterior of the container when the lid is separated from the base of the lid fitment.

* * * * *